US008991199B2

(12) United States Patent
Honda

(10) Patent No.: US 8,991,199 B2
(45) Date of Patent: Mar. 31, 2015

(54) HEAT PUMP SYSTEM

(75) Inventor: Masahiro Honda, Oostende (BE)

(73) Assignees: Daikin Industries, Ltd., Osaka (JP); Daikin Europe N.V., Oostende (BE)

( * ) Notice: Subject to any disclaimer, the term of this patent is extended or adjusted under 35 U.S.C. 154(b) by 698 days.

(21) Appl. No.: 13/202,623

(22) PCT Filed: Feb. 23, 2010

(86) PCT No.: PCT/JP2010/001188

§ 371 (c)(1),
(2), (4) Date: Aug. 22, 2011

(87) PCT Pub. No.: WO2010/098074

PCT Pub. Date: Sep. 2, 2010

(65) Prior Publication Data

US 2011/0302943 A1 Dec. 15, 2011

(30) Foreign Application Priority Data

Feb. 24, 2009 (JP) ..... 2009-041321

(51) Int. Cl.
*F25B 13/00* (2006.01)
*F25B 17/02* (2006.01)
(Continued)

(52) U.S. Cl.
CPC . *F25B 7/00* (2013.01); *F25B 13/00* (2013.01); *F25B 31/004* (2013.01); *F25B 2339/047* (2013.01)
USPC ..... 62/160; 62/192; 62/201; 62/222

(58) Field of Classification Search
USPC ..... 62/159, 160, 175, 201, 222, 503, 192, 62/470
See application file for complete search history.

(56) References Cited

U.S. PATENT DOCUMENTS 8,015,836 B2 * 9/2011 Kameyama et al. ..... 62/335
2008/0314063 A1 * 12/2008 Lifson et al. ..... 62/296
2010/0050675 A1 3/2010 Kameyama et al.

FOREIGN PATENT DOCUMENTS

JP 60-164157 A 8/1985
JP 61-83833 A 4/1986
(Continued)

OTHER PUBLICATIONS

International Preliminary Report of corresponding PCT Application No. PCT/JP2010/001188.
(Continued)

*Primary Examiner* — Marc Norman
(74) *Attorney, Agent, or Firm* — Global IP Counselors

(57) ABSTRACT

A heat pump system includes: a heat-source-side refrigerant circuit having a heat-source-side compressor, a first usage-side heat exchanger operable as a radiator of heat-source-side refrigerant, and a heat-source-side heat exchanger operable as an evaporator of heat-source-side refrigerant; and a usage-side refrigerant circuit having a usage-side compressor arranged to compress usage-side refrigerant with a pressure of the usage-side refrigerant corresponding to a saturated gas temperature of 65° C. that is 2.8 MPa or less at gauge pressure, a refrigerant-water heat exchanger operable as a radiator of usage-side refrigerant to heat an aqueous medium, and a first usage-side heat exchanger operable as an evaporator of usage-side refrigerant by the radiation of heat-source-side refrigerant. The weight of usage-side refrigerant enclosed in the usage-side refrigerant circuit is one to three times the weight of refrigeration machine oil enclosed to lubricate the usage-side compressor.

3 Claims, 18 Drawing Sheets

(51) Int. Cl.

| | |
|---|---|
| ***F25B 49/00*** | (2006.01) |
| ***F25B 7/00*** | (2006.01) |
| ***F25B 31/00*** | (2006.01) |

(56) References Cited

FOREIGN PATENT DOCUMENTS

| | | | |
|---|---|---|---|
| JP | 5-36257 | U | 5/1993 |
| JP | 7-12439 | A | 1/1995 |
| JP | 9-100483 | A | 4/1997 |
| JP | 11-223428 | A | 8/1999 |
| JP | 2000-002468 | A | 1/2000 |
| JP | 2001-19944 | A | 1/2001 |
| JP | 2001-349629 | A | 12/2001 |
| JP | 2006-250378 | A | 9/2006 |
| JP | 2007-93153 | A | 4/2007 |
| JP | 2007-178029 | A | 7/2007 |
| WO | WO 2008/117408 | A1 | 10/2008 |
| WO | WO2008/117408 | A1 | 10/2008 |

OTHER PUBLICATIONS

Information Disclosure Statement filed by a third party of corresponding Japanese Application No. 2009-41321 dated Jun. 5, 2012.
JAR Thermodynamic Tables, vol. 1; HFCs and HCFCs, Ver. 1.0; Jul. 15, 1994; Japan.
International Search Report of corresponding PCT Application No. PCT/JP2010/001188.

* cited by examiner

HEAT PUMP SYSTEM

CROSS-REFERENCE TO RELATED APPLICATIONS

This U.S. National stage application claims priority under 35 U.S.C. §119(a) to Japanese Patent Application No. 2009-041321, filed in Japan on Feb. 24, 2009, the entire contents of which are hereby incorporated herein by reference.

TECHNICAL FIELD

The present invention relates to a heat pump system, and particularly relates to a heat pump system capable of heating an aqueous medium by utilizing a heat pump cycle.

BACKGROUND ART

Heat pump water heaters, such as the one described in Japanese Laid-open Patent Publication No. 60-164157, are known which are capable of utilizing a heat pump cycle to heat water. Such a heat pump water heater has primarily a compressor, a refrigerant/water heat exchanger, and a heat-source-side heat exchanger, and is configured so that water is heated by the radiation of refrigerant in the refrigerant/water heat exchanger, and the hot water thereby obtained is fed to a storage tank.

SUMMARY

With the conventional heat pump water heater described above, an auxiliary heater as well as a refrigerant/water heat exchanger must be used in combination to heat water, to increase the discharge pressure of the compressor, and to otherwise operate under conditions of poor operating efficiency in order to supply high-temperature hot water to a hot-water storage tank, and such a situation is not preferred.

An object of the present invention is to provide a high-temperature aqueous medium in a heat pump system capable of heating an aqueous medium using a heat pump cycle.

A heat pump system according to a first aspect comprises a heat-source-side refrigerant circuit and a usage-side refrigerant circuit. The heat-source-side refrigerant circuit has a heat-source-side compressor for compressing a heat-source-side refrigerant, a first usage-side heat exchanger capable of functioning as a radiator of the heat-source-side refrigerant, and a heat-source-side heat exchanger capable of functioning as an evaporator of the heat-source-side refrigerant. The usage-side refrigerant circuit has a usage-side compressor for compressing a usage-side refrigerant whose pressure corresponding to a saturated gas temperature of 65° C. is 2.8 MPa or less at gauge pressure, a refrigerant-water heat exchanger capable of functioning as a radiator of the usage-side refrigerant and heating an aqueous medium, and a first usage-side heat exchanger capable of functioning as an evaporator of the usage-side refrigerant by the radiation of the heat-source-side refrigerant. The usage-side compressor, the first usage-side heat exchanger, and the refrigerant-water heat exchanger constitute a first usage unit, the length of a refrigerant tube from the first usage-side heat exchanger functioning as an evaporator of the usage-side refrigerant to the usage-side compressor is 3 m or less, the usage-side refrigerant circuit is not provided with an oil separating mechanism for separating refrigeration machine oil contained in the usage-side refrigerant discharged from the usage-side compressor and returning the oil to the intake of the usage-side compressor, and the weight of the usage-side refrigerant enclosed in the usage-side refrigerant circuit is one to three times the weight of the refrigeration machine oil enclosed for lubricating the usage-side compressor.

In this heat pump system, in the first usage-side heat exchanger, the usage-side refrigerant circulating through the usage-side refrigerant circuit is heated by the radiated heat of the heat-source-side refrigerant circulating through the heat-source-side refrigerant circuit, and the usage-side refrigerant circuit can use the heat obtained from the heat-source-side refrigerant to achieve a refrigeration cycle of a higher temperature than the refrigeration cycle in the heat-source-side refrigerant circuit; therefore, a high-temperature aqueous medium can be obtained due to the heat radiation of the usage-side refrigerant in the refrigerant-water heat exchanger.

At this time, considering a circuit configuration such as that of this heat pump system wherein the usage-side refrigerant circuit is included in the first usage unit, and the refrigerant tube is short with a length of 3 m or less from the first usage-side heat exchanger functioning as an evaporator of the usage-side refrigerant to the usage-side compressor; since there is little chance of refrigeration machine oil getting backed up in portions of the usage-side refrigerant circuit other than the usage-side compressor, it is essentially believed that the amount of refrigeration machine oil enclosed with the usage-side refrigerant in the usage-side refrigerant circuit can be reduced.

For the sake of obtaining a high-temperature aqueous medium, the usage-side refrigerant is preferably a refrigerant with a high boiling point such as a refrigerant whose pressure corresponding to a saturation gas temperature of 65° C. is 2.8 MPa or less at gauge pressure (i.e., a refrigerant having low-pressure saturation characteristics), as is the case in this heat pump system, but when such a refrigerant having low-pressure saturation characteristics is used for the objective of obtaining a high-temperature aqueous medium, the gaseous usage-side refrigerant blended in with the refrigeration machine oil is increased by this use of refrigerant under high-temperature conditions. As a result, the coefficient of viscosity of the refrigeration machine oil decreases, a greater amount of refrigeration machine oil is discharged with the refrigerant from the usage-side compressor, and there is a risk of lubrication inside the usage-side compressor being insufficient; therefore, it is believed that the amount of refrigeration machine oil enclosed with the usage-side refrigerant in the usage-side refrigerant circuit must be increased.

When the temperature of the refrigeration machine oil in the usage-side compressor is lower than the condensation temperature of the usage-side refrigerant, there is a risk that the usage-side refrigerant will condense in the usage-side compressor and dilute the refrigeration machine oil, but particularly in a system for obtaining a high-temperature aqueous medium such as this heat pump system, the refrigeration machine oil is diluted quite readily because of the high condensation temperature of the usage-side refrigerant. As a result, there is a risk that the coefficient of viscosity of the refrigeration machine oil will decrease, the amount of refrigeration machine oil discharged with the refrigerant from the usage-side compressor will increase, and the lubrication inside the usage-side compressor will be insufficient; therefore, for this reason as well it is believed that the amount of refrigeration machine oil enclosed with the usage-side refrigerant in the usage-side refrigerant circuit must be increased.

Thus, when the amount of refrigeration machine oil is increased, an oil separation mechanism is preferably provided for separating the refrigeration machine oil discharged synchronously with the usage-side refrigerant discharged from the usage-side compressor and returning the oil to the intake of the usage-side compressor.

However, during use under high-temperature conditions such as those of this heat pump system, since the gaseous usage-side refrigerant blended in with the refrigeration machine oil increases and the refrigeration machine oil is readily diluted as described above, the amount of refrigeration machine oil discharged along with the usage-side refrigerant discharged from the usage-side compressor also increases. Therefore, when an oil separation mechanism is provided, a greater amount of usage-side refrigerant is returned to the intake of the usage-side compressor together with the refrigeration machine oil, and there is a risk of operating efficiency being reduced.

In view of this, in this heat pump system, considering the objective of obtaining a high-temperature aqueous medium (promoting dilution of the refrigeration machine oil due to a greater amount of gaseous usage-side refrigerant with a high condensation temperature being dissolved in the refrigeration machine oil, and due to condensation of the usage-side refrigerant) as well as the low risk of refrigeration machine oil backing up in portions of the usage-side refrigerant circuit other than the usage-side compressor (i.e., circuit structural characteristics, which are that the usage-side refrigerant circuit is included in the first usage unit, and the refrigerant tube has a short length of 3 m or less from the first usage-side heat exchanger functioning as an evaporator of the usage-side refrigerant to the usage-side compressor), the usage-side refrigerant circuit is not provided with an oil separation mechanism for separating refrigeration machine oil included in the usage-side refrigerant discharged from the usage-side compressor and returning the oil to the intake of the usage-side compressor, and the weight of usage-side refrigerant enclosed in the usage-side refrigerant circuit is one to three times the weight of the refrigeration machine oil enclosed for lubricating the usage-side compressor, unlike the conventional practice concerning the weight of refrigeration machine oil.

It is thereby possible in this heat pump system to obtain a high-temperature aqueous medium while allowing a greater amount of usage-side refrigerant to be returned with the refrigeration machine oil to the intake of the usage-side compressor and suppressing both the resulting decrease in operating efficiency and insufficient lubrication inside the usage-side compressor.

A heat pump system according to a second aspect is the heat pump system according to the first aspect, wherein the pressure of the usage-side refrigerant corresponding to a saturated gas temperature of 65° C. is 2.0 MPa (gauge pressure) or less.

In this heat pump system, since the refrigerant used as the usage-side refrigerant is a refrigerant whose pressure corresponding to a saturated gas temperature of 65° C. is 2.0 MPa or less at gauge pressure and which has low-pressure saturation characteristics, an even higher-temperature aqueous medium can be obtained, and the operational effects of the heat pump system according to the first aspect are more pronounced.

A heat pump system according to a third aspect is the heat pump system according to the first or second aspect, wherein the usage-side refrigerant circuit further has an accumulator capable of temporarily storing the usage-side refrigerant in the intake of the usage-side compressor, and a refrigerant-water heat-exchange-side flow rate adjustment valve capable of varying the flow rate of the usage-side refrigerant flowing through the refrigerant-water heat exchanger; and when a determination has been made that the refrigeration machine oil is insufficient in the usage-side compressor, an oil recovery operation is performed for returning the usage-side refrigerant containing the refrigeration machine oil in the refrigerant-water heat exchanger to the accumulator via the refrigerant-water heat-exchange-side flow rate adjustment valve and the first usage-side heat exchanger.

In the heat pump system according to the first or second aspect, since an oil separation mechanism is not provided, the refrigeration machine oil is readily led with the usage-side refrigerant into the refrigerant-water heat exchanger functioning as a radiator of the usage-side refrigerant, and under high-temperature conditions, biphasic separation of liquid usage-side refrigerant and refrigeration machine oil occurs readily inside the refrigerant-water heat exchanger. Therefore, the refrigeration machine oil likely backs up inside the refrigerant-water heat exchanger functioning as a radiator of the usage-side refrigerant.

In view of this, in this heat pump system, insufficiency of refrigeration machine oil in the usage-side compressor can be prevented by further providing the usage-side refrigerant circuit with a usage-side accumulator capable of temporarily storing the usage-side refrigerant in the intake of the usage-side compressor and a refrigerant-water heat-exchange-side flow rate adjustment valve capable of varying the flow rate of the usage-side refrigerant flowing through the refrigerant-water heat exchanger, and by performing an oil recovery operation when it has been determined that the refrigeration machine oil is insufficient in the usage-side compressor, whereby the usage-side refrigerant containing the refrigeration machine oil in the refrigerant-water heat exchanger is passed through the refrigerant-water heat-exchange-side flow rate adjustment valve and the first usage-side heat exchanger and returned to the usage-side accumulator under low-temperature conditions in which biphasic separation of liquid usage-side refrigerant and refrigeration machine oil does not occur readily. During this oil recovery operation, it is possible to continue the operation of making the refrigerant-water heat exchanger function as a radiator of the usage-side refrigerant and heating the aqueous medium.

A heat pump system according to a fourth aspect is the heat pump system according to the third aspect, wherein the determination of whether or not the refrigeration machine oil is insufficient in the usage-side compressor is performed based on the temperature of the usage-side refrigerant in the discharge of the usage-side compressor or the temperature of the aqueous medium in the outlet of the refrigerant-water heat exchanger.

In this heat pump system, since the determination of whether or not the refrigeration machine oil is insufficient in the usage-side compressor is performed based on the temperature of the usage-side refrigerant in the discharge of the usage-side compressor or the temperature of the aqueous medium in the outlet of the refrigerant-water heat exchanger, the determination of whether or not the refrigeration machine oil is insufficient in the usage-side compressor can be appropriately performed while taking into account the extent to which the usage-side refrigerant is blended in with the refrigeration machine oil in the usage-side compressor as well as the extent of biphasic separation of the usage-side refrigerant and the refrigeration machine oil in the refrigerant-water heat exchanger.

DESCRIPTION OF EMBODIMENTS

Embodiments of the heat pump system according to the present invention will be described based on the drawings.

(First Embodiment)

<Configuration>

—Overall Configuration—

Figure 1:
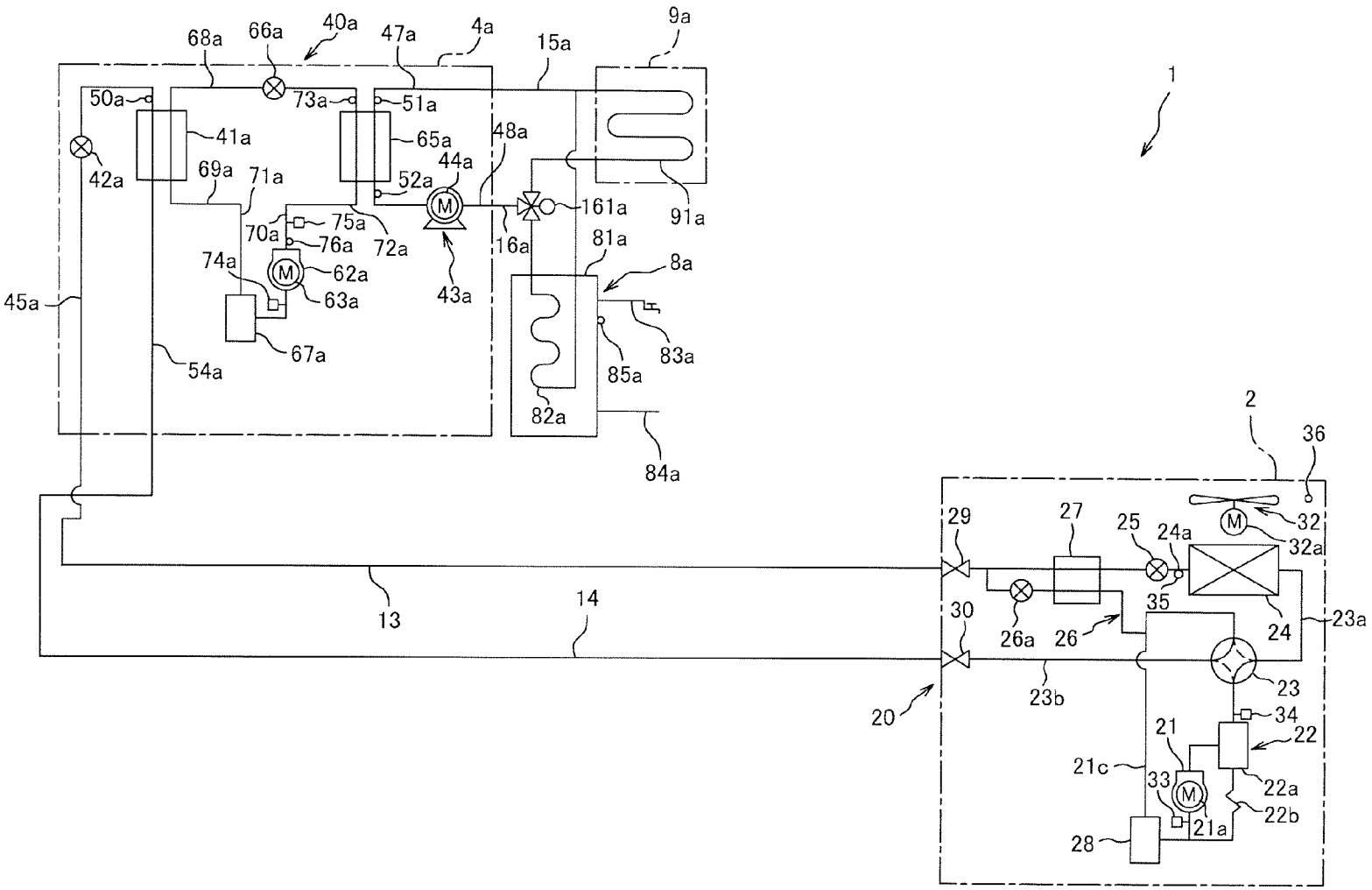
FIG. 1 is a schematic structural diagram of a heat pump system according to the first embodiment and Modification 1 of the present invention.

FIG. 1 is a view showing the general configuration of a heat pump system 1 according to a first embodiment of the present invention. The heat pump system 1 is an apparatus capable of operation for heating an aqueous medium, and other operation by utilizing a vapor compression heat pump cycle.

The heat pump system 1 mainly has a heat source unit 2, a first usage unit 4*a*, a liquid refrigerant communication tube 13, a gas refrigerant communication tube 14, a hot-water storage unit 8*a*, a hot-water air-warming unit 9*a*, an aqueous medium communication tube 15*a*, and an aqueous medium communication tube 16*a*. The heat source unit 2 and the first usage unit 4*a* constitute a heat-source-side refrigerant circuit 20 by being connected via the refrigerant communication tubes 13, 14. The first usage unit 4*a* constitutes a usage-side refrigerant circuit 40*a*. The first usage unit 4*a*, the hot-water storage unit 8*a*, and the hot-water air-warming unit 9*a* constitute an aqueous medium circuit 80*a* by being connected via the aqueous medium communication tubes 15*a*, 16*a*. HFC-410A, which is a type of HFC-based refrigerant, is enclosed inside the heat-source-side refrigerant circuit 20 as a heat-source-side refrigerant, and an ester-based or ether-based refrigeration machine oil having compatibility with respect to the HFC-based refrigerant is enclosed for lubrication of a heat-source-side compressor 21 (described later). Also, HFC-134a, which is a type of HFC-based refrigerant, is enclosed inside the usage-side refrigerant circuit 40*a* as a usage-side refrigerant, and an ester-based or ether-based refrigeration machine oil having compatibility with respect to the HFC-based refrigerant is enclosed for lubrication of a usage-side compressor 62*a*. The usage-side refrigerant is preferably one in which the pressure that corresponds to a saturated gas temperature of 65° C. is a maximum gauge pressure of 2.8 MPa or less, and is more preferably a refrigerant of 2.0 MPa or less from the viewpoint of using a refrigerant that is advantageous for a high-temperature refrigeration cycle. The weight of the usage-side refrigerant enclosed in the usage-side refrigerant circuit 40*a* is one to three times the weight of the refrigeration machine oil enclosed in order to lubricate the usage-side compressor 62*a*. HFC-134a is a type of refrigerant having such saturation pressure characteristics. Water is used as the aqueous medium in the aqueous medium circuit 80*a*.

—Heat Source Unit—

The heat source unit 2 is disposed outdoors, and is connected to the first usage unit 4*a* via the refrigerant communication tubes 13, 14 and constitutes a portion of the heat-source-side refrigerant circuit 20.

The heat source unit 2 mainly has a heat-source-side compressor 21, an oil separation mechanism 22, a heat-source-side switching mechanism 23, a heat-source-side heat exchanger 24, a heat-source-side expansion valve 25, an intake return tube 26, a subcooler 27, a heat-source-side accumulator 28, a liquid-side shutoff valve 29, and a gas-side shutoff valve 30.

The heat-source-side compressor 21 is a mechanism for compressing the heat-source-side refrigerant. The heat-source-side compressor 21 used herein is an airtight compressor in which a rotary-type, scroll-type, or other positive-displacement compression element (not shown) housed in a casing (not shown) is driven by a heat-source-side compressor motor 21*a* which is also housed in the casing. A high-pressure space (not shown) filled by the heat-source-side refrigerant after compression in the compression element is formed inside the casing of the heat-source-side compressor 21, and refrigeration machine oil is stored in the high-pressure space. The rotation speed (i.e., the operating frequency) of the heat-source-side compressor motor 21*a* can be varied by an inverter apparatus (not shown), and the capacity of the heat-source-side compressor 21 can thereby be controlled.

The oil separation mechanism 22 is a mechanism for separating refrigeration machine oil included in the heat-source-side refrigerant that is discharged from the heat-source-side compressor 21 and returning the refrigeration machine oil to the intake of the heat-source-side compressor. The oil separation mechanism 22 has primarily an oil separator 22*a* provided to a heat-source-side discharge tube 21*b* of the heat-source-side compressor 21; and an oil return tube 22*b* for connecting the oil separator 22*a* and a heat-source-side intake tube 21*c* of the heat-source-side compressor 21. The oil separator 22*a* is a device for separating refrigeration machine oil included in the heat-source-side refrigerant that is discharged from the heat-source-side compressor 21. The oil return tube 22*b* has a capillary tube, and is a refrigerant tube for returning the refrigeration machine oil separated from the heat-source-side refrigerant in the oil separator 22*a* to the heat-source-side intake tube 21*c* of the heat-source-side compressor 21.

The heat-source-side switching mechanism 23 is a four-way switching valve capable of switching between a heat-source-side radiating operation state in which the heat-source-side heat exchanger 24 functions as a radiator of the heat-source-side refrigerant, and a heat-source-side evaporating operation state in which the heat-source-side heat exchanger 24 functions as a evaporator of the heat-source-side refrigerant. The heat-source-side switching mechanism 23 is connected to the heat-source-side discharge tube 21*b*, the heat-source-side intake tube 21*c*, a first heat-source-side gas refrigerant tube 23*a* connected to the gas side of the heat-source-side heat exchanger 24, and a second heat-source-side gas refrigerant tube 23*b* connected to the gas-side shutoff valve 30. The heat-source-side switching mechanism 23 is capable of switching for communicating the heat-source-side discharge tube 21*b* with the first heat-source-side gas refrigerant tube 23*a*, and communicating the second heat-source-side gas refrigerant tube 23*b* with the heat-source-side intake tube 21*c* (this switching corresponding to the heat-source-side radiating operation state, indicated by solid lines in the heat-source-side switching mechanism 23 in FIG. 1). The heat-source-side switching mechanism 23 is also capable of switching for communicating the heat-source-side discharge tube 21*b* with the second heat-source-side gas refrigerant tube 23*b*, and communicating the first heat-source-side gas refrigerant tube 23*a* with the heat-source-side intake tube 21*c* (this switching corresponding to the heat-source-side evaporating operation state, indicated by dashed lines in the heat-source-side switching mechanism 23 in FIG. 1). The heat-source-side switching mechanism 23 is not limited to a four-way switching valve, and may configured so as to have a function for switching the same directions of heat-source-side refrigerant flow as those described above, through the use of a combination of a plurality of solenoid valves or the like, for example.

The heat-source-side heat exchanger 24 is a heat exchanger for functioning as a radiator or evaporator of the heat-source-side refrigerant by exchanging heat between the heat-source-side refrigerant and outdoor air. A heat-source-side liquid refrigerant tube 24*a* is connected to the liquid side of the heat-source-side heat exchanger 24, and the first heat-source-side gas refrigerant tube 23*a* is connected to the gas side thereof. The outdoor air for heat exchange with the heat-source-side refrigerant in the heat-source-side heat exchanger 24 is fed by a heat-source-side fan 32 which is driven by a heat-source-side fan motor 32*a*.

The heat-source-side expansion valve 25 is an electrical expansion valve for performing such functions as depressurizing the heat-source-side refrigerant flowing through the heat-source-side heat exchanger 24, and is provided to the heat-source-side liquid refrigerant tube 24*a*.

The intake return tube 26 is a refrigerant tube for diverting a portion of the heat-source-side refrigerant flowing through the heat-source-side liquid refrigerant tube 24*a* and returning the diverted refrigerant to the intake of the heat-source-side compressor 21, and in the present embodiment, one end of the intake return tube 26 is connected to the heat-source-side liquid refrigerant tube 24*a*, and the other end is connected to the heat-source-side intake tube 21*c*. An intake return expansion valve 26*a*, the opening degree of which can be controlled, is provided to the intake return tube 26. The intake return expansion valve 26*a* is composed of an electrical expansion valve.

The subcooler 27 is a heat exchanger for exchanging heat between the heat-source-side refrigerant flowing through the heat-source-side liquid refrigerant tube 24*a* and the heat-source-side refrigerant flowing through the intake return tube 26 (more specifically, the heat-source-side refrigerant that has been depressurized by the intake return expansion valve 26*a*).

The heat-source-side accumulator 28 is provided to the heat-source-side intake tube 21*c*, and is a container for temporarily storing the heat-source-side refrigerant circulated through the heat-source-side refrigerant circuit 20 before the heat-source-side refrigerant is drawn into the heat-source-side compressor 21 from the heat-source-side intake tube 21*c*.

The liquid-side shutoff valve 29 is a valve provided at the connection between the heat-source-side liquid refrigerant tube 24*a* and the liquid refrigerant communication tube 13. The gas-side shutoff valve 30 is a valve provided at the connection between the second heat-source-side gas refrigerant tube 23*b* and the gas refrigerant communication tube 14.

Various types of sensors are provided to the heat source unit 2. Specifically, the heat source unit 2 is provided with a heat-source-side intake pressure sensor 33 for detecting a heat-source-side intake pressure Ps1, which is the pressure of the heat-source-side refrigerant in the intake of the heat-source-side compressor 21; a heat-source-side discharge pressure sensor 34 for detecting a heat-source-side discharge pressure Pd1, which is the pressure of the heat-source-side refrigerant in the discharge of the heat-source-side compressor 21; a heat-source-side heat exchange temperature sensor 35 for detecting a heat-source-side heat exchanger temperature Thx, which is the temperature of the heat-source-side refrigerant in the liquid side of the heat-source-side heat exchanger 24; and an outside-air temperature sensor 36 for detecting the outside air temperature To.

—Liquid Refrigerant Communication Tube—

The liquid refrigerant communication tube 13 is connected to the heat-source-side liquid refrigerant tube 24*a* via the liquid-side shutoff valve 29, and the liquid refrigerant communication tube 13 is a refrigerant tube capable of directing the heat-source-side refrigerant to the outside of the heat source unit 2 from the outlet of the heat-source-side heat exchanger 24 which functions as a radiator of the heat-source-side refrigerant when the heat-source-side switching mechanism 23 is in the heat-source-side radiating operation state. The liquid refrigerant communication tube 13 is also a refrigerant tube capable of introducing the heat-source-side refrigerant from outside the heat source unit 2 into the inlet of the heat-source-side heat exchanger 24 which functions as an evaporator of the heat-source-side refrigerant when the heat-source-side switching mechanism 23 is in the heat-source-side evaporating operation state.

—Gas Refrigerant Communication Tube—

The gas refrigerant communication tube 14 is connected to the second heat-source-side gas refrigerant tube 23*b* via the gas-side shutoff valve 30. The gas refrigerant communication tube 14 is a refrigerant tube capable of introducing the heat-source-side refrigerant into the intake of the heat-source-side compressor 21 from outside the heat source unit 2 when the heat-source-side switching mechanism 23 is in the heat-source-side radiating operation state. The gas refrigerant communication tube 14 is also a refrigerant tube capable of directing the heat-source-side refrigerant to the outside of the heat source unit 2 from the discharge of the heat-source-side compressor 21 when the heat-source-side switching mechanism 23 is in the heat-source-side evaporating operation state.

—First Usage Unit—

The first usage unit 4*a* is disposed indoors, and is connected to the heat source unit 2 via the refrigerant communication tubes 13, 14. The first usage unit 4*a* constitutes a portion of the heat-source-side refrigerant circuit 20. The first usage unit 4*a* constitutes the usage-side refrigerant circuit 40*a*. The first usage unit 4*a* is furthermore connected to the hot-water storage unit 8*a* and the hot-water air-warming unit 9*a* via the aqueous medium communication tubes 15*a*, 16*a*, and constitutes a portion of the aqueous medium circuit 80*a*.

The first usage unit 4*a* mainly has a first usage-side heat exchanger 41*a*, the first usage-side flow rate adjustment valve 42*a*, the usage-side compressor 62*a*, the refrigerant/water heat exchanger 65*a*, a refrigerant/water heat exchange-side flow rate adjustment valve 66*a*, a usage-side accumulator 67*a*, and a circulation pump 43*a*.

The first usage-side heat exchanger 41*a* is a heat exchanger that functions as a radiator of the heat-source-side refrigerant by performing heat exchange between the heat-source-side refrigerant and the usage-side refrigerant. The first usage-side liquid refrigerant tube 45*a* is connected to the liquid side of the channel through which the heat-source-side refrigerant flows. The first usage-side gas refrigerant tube 54*a* is connected to the gas side of the channel through which the heat-source-side refrigerant flows. The cascade-side liquid-refrigerant tube 68*a* is connected to the liquid side of the channel through which the usage-side refrigerant flows. The second cascade-side gas-refrigerant tube 69*a* is connected to the gas side of the channel through which the usage-side refrigerant flows. The liquid refrigerant communication tube 13 is connected to the first usage-side liquid refrigerant tube 45*a*. The gas-refrigerant communication tube 14 is connected to the first usage-side gas refrigerant tube 54*a*. The refrigerant/water heat exchanger 65*a* is connected to the cascade-side liquid-refrigerant tube 68*a*. The usage-side compressor 62*a* is connected to the second cascade-side gas-refrigerant tube 69*a*.

The first usage-side flow fate adjustment valve 42*a* is an electrical expansion valve that can vary the flow rate of the heat-source-side refrigerant that flows through the first usage-side heat exchanger 41*a* by controlling the opening degree, and is provided to the first usage-side liquid refrigerant tube 45*a*.

The usage-side compressor 62*a* is a mechanism for compressing the usage-side refrigerant, and in this case, is a sealed compressor having rotary elements, scroll elements, or other type of positive displacement compression elements (not shown) accommodated in a casing (not shown), and is driven by a usage-side compression motor 63*a* accommodated in the same casing. A high-pressure space (not shown) which is filled with the usage-side refrigerant that has been compressed in the compression element is formed inside the casing of the usage-side compressor 62*a*, and refrigeration machine oil is accumulated in this high-pressure space. The rotational speed (i.e., operational frequency) of the usage-side compression motor 63*a* can be varied by using an inverter device (not shown), whereby the capacity of the usage-side compressor 62*a* can be controlled. A cascade-side discharge tube 70*a* is connected to the discharge of the usage-side compressor 62*a*, and a cascade-side intake tube 71*a* is connected to the intake of the usage-side compressor 62*a*. The cascade-side gas-refrigerant tube 71*a* is connected to the second cascade-side gas-refrigerant tube 69*a*. The length of the refrigerant tube from the first usage-side heat exchanger 41*a* functioning as an evaporator of usage-side refrigerant to the usage-side compressor 62*a* (more specifically, to the intake of the usage-side compressor 62*a*) (i.e., the total combined length of the second cascade-side gas refrigerant tube 69*a* and the cascade-side intake tube 71*a*) is extremely short at 3 m or less.

The refrigerant/water heat exchanger 65*a* is a heat exchanger that functions as a radiator of the usage-side refrigerant by heat exchange between the usage-side refrigerant and the aqueous medium. A cascade-side liquid-refrigerant tube 68*a* is connected to the liquid side of the channel through which the usage-side refrigerant flows. A first cascade-side gas-refrigerant tube 72*a* is connected to the gas side of the channel through which the usage-side refrigerant flows. A first usage-side water inlet tube 47*a* is connected to the inlet side of the channel through which the aqueous medium flows. A first usage-side water outlet tube 48*a* is connected to the outlet side of the channel through which the aqueous medium flows. The first cascade-side gas-refrigerant tube 72*a* is connected to the cascade-side discharge tube 70*a*. An aqueous medium communication tube 15*a* is connected to the first usage-side water inlet tube 47*a* and an aqueous medium communication tube 16*a* is connected to the first usage-side water outlet tube 48*a*.

The refrigerant/water heat exchange-side flow rate adjustment valve 66*a* is an electrical expansion valve that can vary the flow rate of the usage-side refrigerant that flows through the refrigerant/water heat exchanger 65*a* by controlling the opening degree, and is provided to the cascade-side liquid-refrigerant tube 68*a*.

The usage-side accumulator 67*a* is a container provided to the cascade-side intake tube 71*a* and is used for temporarily accumulating the usage-side refrigerant circulating through the usage-side refrigerant circuit 40*a* before the usage-side refrigerant is taken from the cascade-side intake tube 71*a* into the usage-side compressor 62*a*.

In this manner, the usage-side compressor 62*a*, the refrigerant/water heat exchanger 65*a*, the refrigerant/water heat exchange-side flow rate adjustment valve 66*a*, and the first usage-side heat exchanger 41*a* are connected via the refrigerant tubes 71*a*, 70*a*, 72*a*, 68*a*, 69*a* to thereby constitute the usage-side refrigerant circuit 40*a*. Unlike the heat-source-side refrigerant circuit 20, the usage-side refrigerant circuit 40*a* is not provided with an oil separation mechanism for separating the refrigeration machine oil contained in the usage-side refrigerant discharged from the usage-side compressor 62*a* and returning the oil to the intake of the usage-side compressor 62*a*.

The circulation pump 43*a* is a mechanism for increasing the pressure of the aqueous medium, and in this configuration, is a pump in which a centrifugal and/or positive-displacement pump element (not shown) is driven by a circulation pump motor 44*a*. The circulation pump 43*a* is provided to the first usage-side water outlet tube 48*a*. The rotational speed (i.e., operational frequency) of the circulation pump motor 44*a* can be varied by using an inverter device (not shown), whereby the capacity of the circulation pump 43*a* can be controlled.

The first usage unit 4*a* thereby causes the first usage-side heat exchanger 41*a* to function as a radiator of the heat-source-side refrigerant introduced from the gas-refrigerant communication tube 14, whereby hot-water supply operation is made possible in which the heat-source-side refrigerant having released heat in the first usage-side heat exchanger 41*a* is directed out to the liquid refrigerant communication tube 13, the usage-side refrigerant circulating through the usage-side refrigerant circuit 40*a* is heated by the heat released by the heat-source-side refrigerant in the first usage-side heat exchanger 41*a*, the usage-side refrigerant thus heated is compressed in the usage-side compressor 62*a*, and the aqueous medium is thereafter heated by the heat released in the refrigerant/water heat exchanger 65*a*.

Various types of sensors are provided to the first usage unit 4*a*. Specifically provided to the first usage unit 4*a* are a first usage-side heat exchange temperature sensor 50*a* for detecting a first usage-side refrigerant temperature Tsc1, which is the temperature of the heat-source-side refrigerant in the liquid side of the first usage-side heat exchanger 41*a*; a first refrigerant/water heat exchange temperature sensor 73*a* for detecting a cascade-side refrigerant temperature Tsc2, which is the temperature of the usage-side refrigerant in the liquid side of the refrigerant/water heat exchanger 65*a*; an aqueous medium inlet temperature sensor 51*a* for detecting an aqueous medium inlet temperature Twr, which is the temperature of the aqueous medium in the inlet of the refrigerant/water heat exchanger 65*a*; an aqueous medium outlet temperature sensor 52*a* for detecting an aqueous medium outlet temperature Tw1, which is the temperature of the aqueous medium in the outlet of the refrigerant/water heat exchanger 65*a*; a usage-side intake pressure sensor 74*a* for detecting a usage-side intake pressure Ps2, which is the pressure of the usage-side refrigerant in the intake of the usage-side compressor 62*a*; a usage-side discharge pressure sensor 75*a* for detecting the usage-side discharge pressure Pd2, which is the pressure of the usage-side refrigerant in the discharge of the usage-side compressor 62*a*; and a usage-side discharge temperature sensor 76*a* for detecting the usage-side discharge temperature Td2, which is the temperature of the usage-side refrigerant in the discharge of the usage-side compressor 62*a*.

—Hot-Water Storage Unit—

The hot-water storage unit 8*a* is installed indoors, is connected to the first usage unit 4*a* via the aqueous medium communication tubes 15*a*, 16*a*, and constitutes a portion of the aqueous medium circuit 80*a*.

The hot-water storage unit 8*a* has primarily a hot-water storage tank 81*a* and a heat exchange coil 82*a*.

The hot-water storage tank 81*a* is a container for storing water as the aqueous medium for the hot water supply, a hot-water supply tube 83*a* for sending the aqueous medium as hot water to a faucet, shower, or the like is connected to the top of the hot-water storage tank 81*a*, and a water supply tube 84*a* for replenishing the aqueous medium expended by the hot-water supply tube 83*a* is connected to the bottom of the hot-water storage tank 81*a*.

The heat exchange coil 82*a* is provided inside the hot-water storage tank 81*a*, and is a heat exchanger for functioning as a heater of the aqueous medium in the hot-water storage tank 81*a* by exchanging heat between the aqueous medium circulating through the aqueous medium circuit 80*a* and the aqueous medium inside the hot-water storage tank 81*a*. The aqueous medium communication tube 16*a* is connected to the inlet of the heat exchange coil 82*a*, and the aqueous medium communication tube 15*a* is connected to the outlet thereof.

The hot-water storage unit 8*a* is thereby capable of heating the aqueous medium inside the hot-water storage tank 81*a* through the use of the aqueous medium circulating through the aqueous medium circuit 80*a*, which has been heated in the first usage unit 4*a*, and storing the heated aqueous medium as hot water. The type of hot-water storage unit 8*a* used herein is a hot-water storage unit for storing, in a hot-water storage tank, the aqueous medium heated by heat exchange with the aqueous medium heated in the first usage unit 4*a*, but a type of hot-water storage unit for storing an aqueous medium heated in the first usage unit 4*a* in a hot-water storage tank may also be used.

Various sensors are also provided to the hot-water storage unit 8*a*. Specifically, the hot-water storage unit 8*a* is provided with a hot-water storage temperature sensor 85*a* for detecting a hot-water storage temperature Twh, which is the temperature of the aqueous medium stored in the hot-water storage tank 81*a*.

—Hot-Water Air-Warming Unit—

The hot-water air-warming unit 9*a* is installed indoors, is connected to the first usage unit 4*a* via the aqueous medium communication tubes 15*a*, 16*a*, and constitutes a portion of the aqueous medium circuit 80*a*.

The hot-water air-warming unit 9*a* has primarily a heat exchange panel 91*a*, and is composed of a radiator and/or a floor heating panel and other components.

The heat exchange panel 91*a* is provided alongside a wall or elsewhere indoors when configured as a radiator, and is provided under the floor or elsewhere indoors when configured as a floor heating panel. The heat exchange panel 91*a* is a heat exchanger for functioning as a radiator or heater of the aqueous medium circulated through the aqueous medium circuit 80*a*, and the aqueous medium communication tube 16*a* is connected to the inlet of the heat exchange panel 91*a*, and the aqueous medium communication tube 15*a* is connected to the outlet of the heat exchange panel 91*a*.

—Aqueous Medium Communication Tubes—

The aqueous medium communication tube 15*a* is connected to the outlet of the heat exchange coil 82*a* of the hot-water storage unit 8*a*, and the outlet of the heat exchange panel 91*a* of the hot-water air-warming unit 9*a*. The aqueous medium communication tube 16*a* is connected to the inlet of the heat exchange coil 82*a* of the hot-water storage unit 8*a*, and the inlet of the heat exchange panel 91*a* of the hot-water air-warming unit 9*a*. The aqueous medium communication tube 16*a* is provided with an aqueous-medium-side switching mechanism 161*a* capable of switching between feeding the aqueous medium circulated through the aqueous medium circuit 80*a* to both the hot-water storage unit 8*a* and the hot-water air-warming unit 9*a*, or to any one of the hot-water storage unit 8*a* and the hot-water air-warming unit 9*a*. The aqueous-medium-side switching mechanism 161*a* is composed of a three-way valve.

A controller (not shown) for performing the following operations and/or various controls is provided to the heat pump system 1.

<Operation>

The operation of the heat pump system 1 will be described next.

An operating mode of the heat pump system 1 is a hot-water supply operation mode for performing a hot-water supply operation (i.e., operation of the hot-water storage unit 8*a* and the hot-water air-warming unit 9*a*) of the first usage unit 4*a*.

Operation in the hot-water supply operation mode of the heat pump system 1 is described below.

—Hot-Water Supply Operation Mode—

In the case that hot-water supply operation of the first usage unit 4*a* is to be performed, the heat-source-side switching mechanism 23 is switched to a heat-source-side evaporating operation state (the state indicated by the broken line of the heat-source-side switching mechanism 23 of FIG. 1) and the intake-return expansion valve 26*a* is set in a closed state in the heat-source-side refrigerant circuit 20. Also, in the aqueous medium circuit 80*a*, the aqueous-medium-side switching mechanism 161*a* is switched to a state in which the aqueous medium is fed to the hot-water storage unit 8*a* and/or hot-water air-warming unit 9*a*.

In the heat-source-side refrigerant circuit 20 in such a state, the low-pressure, heat-source-side refrigerant in the refrigeration cycle is taken into the heat-source-side compressor 21 via the heat-source-side intake tube 21*c*, and is discharged to a heat-source-side discharge tube 21*b* after having been compressed to a high pressure in the refrigeration cycle. The high-pressure, heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* via the oil return tube 22*b*. The high-pressure, heat-source-side refrigerant from which the refrigeration machine oil has been separated out is sent from the heat source unit 2 to the gas-refrigerant communication tube 14 via the heat-source-side switching mechanism 23, the second heat-source-side gas refrigerant tube 23*b*, and the gas-side shutoff valve 30.

The high-pressure, heat-source-side refrigerant sent to the gas-refrigerant communication tube 14 is sent to the first usage unit 4*a*. The high-pressure, heat-source-side refrigerant sent to the first usage unit 4*a* is sent to the first usage-side heat exchanger 41*a* via the first usage-side gas refrigerant tube 54*a*. The high-pressure, heat-source-side refrigerant sent to the first usage-side heat exchanger 41*a* undergoes heat exchange with the low-pressure, usage-side refrigerant in the refrigeration cycle that is circulating through the usage-side refrigerant circuit 40*a* and releases heat in the first usage-side heat exchanger 41*a*. The high-pressure, heat-source-side refrigerant having released heat in the first usage-side heat exchanger 41*a* is sent from the first usage unit 4*a* to the liquid refrigerant communication tube 13 via the first usage-side flow rate adjustment valve 42*a* and the first usage-side liquid refrigerant tube 45*a*.

The heat-source-side refrigerant sent to the liquid refrigerant communication tube 13 is sent to the heat source unit 2. The heat-source-side refrigerant sent to the heat source unit 2 is sent to the subcooler 27 through the liquid-side shutoff valve 29. Since the heat-source-side refrigerant does not flow in the intake return tube 26, the heat-source-side refrigerant sent to the subcooler 27 is sent to the heat-source-side expansion valve 25 without exchanging heat. The heat-source-side refrigerant sent to the heat-source-side expansion valve 25 is depressurized in the heat-source-side expansion valve 25 to a low-pressure gas-liquid two-phase state, and sent to the heat-source-side heat exchanger 24 through the heat-source-side liquid refrigerant tube 24*a*. The low-pressure refrigerant sent to the heat-source-side heat exchanger 24 is heat-exchanged with the outdoor air fed by the heat-source-side fan 32 and evaporated in the heat-source-side heat exchanger 24. The low-pressure heat-source-side refrigerant evaporated in the heat-source-side heat exchanger 24 is sent to the heat-source-side accumulator 28 through the first heat-source-side gas refrigerant tube 23*a* and the heat-source-side switching mechanism 23. The low-pressure heat-source-side refrigerant sent to the heat-source-side accumulator 28 is again drawn into the heat-source-side compressor 21 through the heat-source-side intake tube 21*c*.

In the usage-side refrigerant circuit 40*a*, the low-pressure, usage-side refrigerant in the refrigeration cycle that is circulating through the usage-side refrigerant circuit 40*a* is heated and evaporated by the radiation of the heat-source-side refrigerant in the first usage-side heat exchanger 41*a*. The low-pressure, usage-side refrigerant evaporated in the first usage-side heat exchanger 41*a* is sent to the usage-side accumulator 67*a* via the second cascade-side gas-refrigerant tube 69*a*. The low-pressure, usage-side refrigerant sent to the usage-side accumulator 67*a* is taken into the usage-side compressor 62*a* via the cascade-side intake tube 71*a*, is compressed to high pressure in the refrigeration cycle, and is thereafter discharged to the cascade-side discharge tube 70*a*. The high-pressure, usage-side refrigerant discharged to the cascade-side discharge tube 70*a* is sent to the refrigerant/water heat exchanger 65*a* via the first cascade-side gas-refrigerant tube 72*a*. The high-pressure, usage-side refrigerant sent to the refrigerant/water heat exchanger 65*a* undergoes heat exchange with the aqueous medium being circulated through the aqueous medium circuit 80*a* by the circulation pump 43*a* and releases heat in the refrigerant/water heat exchanger 65*a*. The high-pressure, usage-side refrigerant having released heat in the refrigerant/water heat exchanger 65*a* is depressurized in the refrigerant/water heat exchange-side flow rate adjustment valve 66*a* to become a low-pressure gas-liquid two-phase state, and is then sent again to the first usage-side heat exchanger 41*a* by way of the cascade-side liquid-refrigerant tube 68*a*.

In the aqueous medium circuit 80*a*, the aqueous medium circulating through the aqueous medium circuit 80*a* is heated by the radiation of the usage-side refrigerant in the refrigerant/water heat exchanger 65*a*. The aqueous medium heated in the refrigerant/water heat exchanger 65*a* is taken into the circulation pump 43*a* by way of the first usage-side water outlet tube 48*a* and pressurized, and is then sent from the first usage unit 4*a* to the aqueous medium communication tube 16*a*. The aqueous medium sent to the aqueous medium communication tube 16*a* is sent to the hot-water storage unit 8*a* and/or the hot-water air-warming unit 9*a* by way of the aqueous-medium-side switching mechanism 161*a*. The aqueous medium sent to the hot-water storage unit 8*a* undergoes heat exchange with the aqueous medium inside the hot-water storage tank 81*a* and releases heat in the heat exchange coil 82*a*, whereby the aqueous medium inside the hot-water storage tank 81*a* is heated. The aqueous medium sent to the hot-water air-warming unit 9*a* releases heat in the heat exchange panel 91*a*, whereby indoor walls or the like are heated and indoor floors are heated.

Operation in the hot-water supply operation mode for performing only hot-water supply operation of the first usage unit 4*a* is performed in this manner.

—Discharge Saturation Temperature Control of Each Refrigerant Circuit and Degree-of-Subcooling Control of Each Heat Exchanger Outlet—

Described next is the discharge saturation temperature control of the refrigerant circuits 20, 40*a* and the degree-of-subcooling control of the outlet of the heat exchangers 41*a*, 65*a* in the hot-water supply operation described above.

In the heat pump system 1, the usage-side refrigerant circulating through the usage-side refrigerant circuit 40*a* is heated by heat released by the heat-source-side refrigerant circulating through the heat-source-side refrigerant circuit 20 in the first usage-side heat exchanger 41*a*, as described above, and the usage-side refrigerant circuit 40*a* can achieve a higher temperature refrigeration cycle than the refrigeration cycle in the heat-source-side refrigerant circuit 20 by using the heat obtained from the heat-source-side refrigerant.

Therefore, a high-temperature aqueous medium can be obtained by heat released from the usage-side refrigerant in the refrigerant/water heat exchanger 65*a*. At this time, it is preferred that control be performed so that the refrigeration cycle in the heat-source-side refrigerant circuit 20 and the refrigeration cycle in the usage-side refrigerant circuit 40*a* both become stable in order to stably obtain a high-temperature aqueous medium.

In view of the above, in the heat pump system 1, the compressors 21, 62*a* of the two refrigerant circuits 20, 40*a* are both variable capacity compressors, and discharge saturation temperatures Tc1, Tc2 become predetermined target discharge saturation temperatures Tc1*s*, Tc2*s* using saturation temperatures that correspond to the pressure of the refrigerant in the discharge of the compressors 21, 62*a* (i.e., the heat-source-side discharge saturation temperature Tc1 and the usage-side discharge saturation temperature Tc2) as representative values of the pressure of the refrigerant of the refrigeration cycles.

Here, the heat-source-side discharge saturation temperature Tc1 is a value obtained by converting the heat-source-side discharge pressure Pd1, which is the pressure of the heat-source-side refrigerant in the discharge of the heat-source-side compressor 21, to a saturation temperature corresponding to this pressure value, and the usage-side discharge saturation temperature Tc2 is a value obtained by converting the usage-side discharge pressure Pd2, which is the pressure of the usage-side refrigerant in the discharge of the usage-side compressor 62*a*, to a saturation temperature that corresponds to this pressure value.

Control is performed in the heat-source-side refrigerant circuit 20 so that the rotational speed (i.e., the operational frequency) of the heat-source-side compressor 21 is increased to increase the operating capacity of the heat-source-side compressor 21 in the case that the heat-source-side discharge saturation temperature Tc1 is less than the target heat-source-side discharge saturation temperature Tc1*s*; and the rotational speed (i.e., the operational frequency) of the heat-source-side compressor 21 is reduced to thereby decrease the operating capacity of the heat-source-side compressor 21 in the case that the heat-source-side discharge saturation temperature Tc1 is greater than the target heat-source-side discharge saturation temperature Tc1*s*. Control is performed in the usage-side refrigerant circuit 40*a* so that the rotational speed (i.e., the operational frequency) of the usage-side compressor 62*a* is increased to increase the operating capacity of the usage-side compressor 62*a* in the case that the usage-side discharge saturation temperature Tc2 is less than the target usage-side discharge saturation temperature Tc2*s*; and the rotational speed (i.e., the operational frequency) of the usage-side compressor 62*a* is reduced to thereby decrease the operating capacity of the usage-side compressor 62*a* in the case that the usage-side discharge saturation temperature Tc2 is greater than the target usage-side discharge saturation temperature Tc2*s*.

The pressure of the heat-source-side refrigerant flowing through the first usage-side heat exchanger 41*a* in the heat-source-side refrigerant circuit 20 is thereby made stable and the pressure of the usage-side refrigerant flowing through the refrigerant/water heat exchanger 65*a* in the usage-side refrigerant circuit 40*a* is made stable. Therefore, the state of the refrigeration cycle in the two refrigerant circuits 20, 40*a* can be made stable and a high-temperature aqueous medium can be stably obtained.

At this point, it is preferred that the target discharge saturation temperatures Tc1*s*, Tc2*s* be suitably set in order to obtain an aqueous medium with a desired temperature.

In view of the above, in this heat pump system 1, a predetermined target aqueous medium outlet temperature Tw1*s*, which is the terget value of the temperature of the aqueous medium in the outlet of the refrigerant/water heat exchanger 65*a*, is first set for the first usage-side heat exchanger 41*a*, and the target usage-side discharge saturation temperature Tc2*s* is set as a value varied by the target aqueous medium outlet temperature Tw1*s*. In this situation, these temperatures are set by conversion into a function in a range of 30° C. to 85° C. so that the target aqueous medium outlet temperature Tw1*s* is set to a high temperature, and in accompaniment therewith, the target usage-side discharge saturation temperature Tc2*s* also becomes a high temperature and becomes a slightly higher temperature than the target aqueous medium outlet temperature Tw1*s*, for example, so that the target usage-side discharge saturation temperature Tc2*s* is set to 85° C. in the case that the target aqueous medium outlet temperature Tw1*s* is set to 80° C., and the target usage-side discharge saturation temperature Tc2*s* is set to 30° C. in the case that the target aqueous medium outlet temperature Tw1*s* is set to 25° C. and the like. The target usage-side discharge saturation temperature Tc2*s* is thereby suitably set in accordance with the target aqueous medium outlet temperature Tw1*s*. A desired target aqueous medium outlet temperature Tws is therefore readily obtained and control can be performed with good responsiveness even when the target aqueous medium outlet temperature Tws has been modified.

In relation to the heat-source-side refrigerant circuit 20, the target heat-source-side discharge saturation temperature Tc1*s* is set as a value that can vary according to the target usage-side discharge saturation temperature Tc2*s* or the target aqueous medium outlet temperature Tws. Here, these temperatures are set by conversion into a function in a range of 10° C. to 40° C. so that the target usage-side discharge saturation temperature Tc2*s* or the target aqueous medium outlet temperature Tws is set to a high temperature, and in accompaniment therewith, the target heat-source-side discharge saturation temperature Tc1*s* also reaches a high temperature range and also reaches a lower temperature range than the target usage-side discharge saturation temperature Tc2*s* or the target aqueous medium outlet temperature Tws, for example, so that the target heat-source-side discharge saturation temperature Tc1*s* is set to a temperature range of 35° C. to 40° C. in the case that, e.g., the target usage-side discharge saturation temperature Tc2*s* or the target aqueous medium outlet temperature Tws is set to 75° C. or 80° C.; and the target heat-source-side discharge saturation temperature Tc1*s* is set to a temperature range of 10° C. to 15° C. in the case that the target usage-side discharge saturation temperature Tc2*s* or the target aqueous medium outlet temperature Tws is set to 30° C. or 25° C. The target usage-side discharge saturation temperature Tc2*s* is preferably set to a single temperature as described above for the purpose of accurately obtaining the target aqueous medium outlet temperature Tws. However, the target heat-source-side discharge saturation temperature Tc1*s* is not required to have an exact setting as does the target usage-side discharge saturation temperature Tc2, and is preferably provided with a certain temperature width allowance. The target heat-source-side discharge saturation temperature Tc1*s* is therefore preferably set in the temperature range as described above. Since the target heat-source-side discharge saturation temperature Tc1*s* is thereby suitably set in accordance with the target usage-side discharge saturation temperature Tc2*s* or the target aqueous medium outlet temperature Tws, the refrigeration cycle can be suitably controlled in the heat-source-side refrigerant circuit 20 in accordance with the state of the refrigeration cycle in the usage-side refrigerant circuit 40*a*.

In this heat pump system 1, the first usage-side flow rate adjustment valve 42*a* is provided as a mechanism for main depressurization of the heat-source-side refrigerant flowing through the heat-source-side refrigerant circuit 20, and the refrigerant/water heat-exchange-side flow rate adjustment valve 66*a* is provided as a mechanism for main depressurization of the usage-side refrigerant flowing through the usage-side refrigerant circuit 40*a*; and the opening degree of the first usage-side flow rate adjustment valve 42*a* is performed in the heat-source-side refrigerant circuit 20 so that the heat-source-side refrigerant degree-of-subcooling SC1, which is the heat-source-side refrigerant degree-of-subcooling in the outlet of the first usage-side heat exchanger 41*a*, becomes a target heat-source-side refrigerant degree-of-subcooling SC1*s*, and the opening degree of the refrigerant/water heat-exchange-side flow rate adjustment valve 66*a* is performed in the usage-side refrigerant circuit 40*a* so that the usage-side refrigerant degree-of-subcooling SC2, which is the usage-side refrigerant degree-of-subcooling in the outlet of the refrigerant/water heat exchanger 65*a*, becomes a target usage-side refrigerant degree-of-subcooling SC2*s*.

Here, the heat-source-side refrigerant degree-of-subcooling SC1 is a value obtained by subtracting the first usage-side refrigerant temperature Tsc1 from the heat-source-side discharge saturation temperature Tc1, and the usage-side refrigerant degree-of-subcooling SC2 is a value obtained by subtracting the cascade-side refrigerant temperature Tsc2 from the usage-side discharge saturation temperature Tc2.

In the heat-source-side refrigerant circuit 20, the flow rate of the heat-source-side refrigerant flowing through the first usage-side heat exchanger 41*a* is reduced by reducing the opening degree of the first usage-side flow rate adjustment valve 42*a* in the case that the heat-source-side refrigerant degree-of-subcooling SC1 is less than the target heat-source-side refrigerant degree-of-subcooling SC1*s*, and the flow rate of the heat-source-side refrigerant flowing through the first usage-side heat exchanger 41*a* is increased by increasing the opening degree of the first usage-side flow rate adjustment valve 42*a* in the case that the heat-source-side refrigerant degree-of-subcooling SC1 is greater than the target heat-source-side refrigerant degree-of-subcooling SC1*s*. In the usage-side refrigerant circuit 40*a*, the flow rate of the usage-side refrigerant flowing through the refrigerant/water heat exchanger 65*a* is reduced by reducing the opening degree of the refrigerant/water heat-exchange-side flow rate adjustment valve 66*a* in the case that the usage-side refrigerant degree-of-subcooling SC2 is less than the target usage-side refrigerant degree-of-subcooling SC2*s*; and the flow rate of the usage-side refrigerant flowing through the refrigerant/water heat exchanger 65*a* is increased by increasing the opening degree of the refrigerant/water heat-exchange-side flow rate adjustment valve 66*a* in the case that the usage-side refrigerant degree-of-subcooling SC2 is greater than the target usage-side refrigerant degree-of-subcooling SC2*s*. The target refrigerant degrees-of-subcooling SC1*s*, SC2*s* are set with consideration given, inter alia, to the design conditions of the heat exchange capacity of the first usage-side heat exchanger 41*a* and the refrigerant/water heat exchanger 65*a*.

The flow rate of the heat-source-side refrigerant flowing through the first usage-side heat exchanger 41*a* in the heat-source-side refrigerant circuit 20 is stabilized thereby, and the flow rate of the usage-side refrigerant flowing through the refrigerant/water heat exchanger 65*a* in the usage-side refrigerant circuit 40*a* is stabilized thereby. Therefore, operation can be performed in conditions suitable to the heat exchange capacity of the first usage-side heat exchanger 41*a* and the refrigerant/water heat exchanger 65*a*, thereby contributing to the stabilization of the state of the refrigeration cycle in the two refrigerant circuits 20, 40*a*.

In this manner, in the heat pump system 1, the pressure and flow rate of the refrigerant in the refrigerant circuits 20, 40*a* is stabilized by controlling the discharge saturation temperature of the refrigerant circuits 20, 40*a* and by controlling the degree of subcooling in the outlet of the heat exchangers 41*a*, 65*a*, whereby the state of the refrigeration cycle in the two refrigerant circuits 20, 40*a* can be stabilized and a high-temperature aqueous medium can be stably obtained.

<Characteristics>

This heat pump system 1 has the following characteristics.

—A—

In the first usage-side heat exchanger 41*a* in this heat pump system 1, the usage-side refrigerant circulating through the usage-side refrigerant circuit 40*a* is heated by the heat radiation of the heat-source-side refrigerant circulating through the heat-source-side refrigerant circuit 20, and the usage-side refrigerant circuit 40*a* can use the heat obtained from the heat-source-side refrigerant to achieve a refrigeration cycle higher in temperature than the refrigeration cycle in the heat-source-side refrigerant circuit 20; therefore, a high-temperature aqueous medium can be obtained by the heat radiation of the usage-side refrigerant in the refrigerant-water heat exchanger 65*a*.

At this time, considering a circuit configuration such as that of this heat pump system 1 wherein the usage-side refrigerant circuit 40*a* is included in the first usage unit 4*a*, and the refrigerant tube is short with a length of 3 m or less from the first usage-side heat exchanger 41*a* functioning as an evaporator of the usage-side refrigerant to the usage-side compressor 62*a* (i.e., the total combined length of the second cascade-side gas refrigerant tube 69*a* and the cascade-side intake tube 71*a*); since there is little chance of refrigeration machine oil getting backed up in portions of the usage-side refrigerant circuit 40*a* other than the usage-side compressor 62*a*, it is essentially believed that the amount of refrigeration machine oil enclosed with the usage-side refrigerant in the usage-side refrigerant circuit 40*a* can be reduced.

Considering that that the objective is to obtain a high-temperature aqueous medium, the usage-side refrigerant is preferably a refrigerant with a high boiling point such as a refrigerant whose pressure corresponding to a saturation gas temperature of 65° C. is 2.8 MPa or less, or preferably 2.0 MPa or less at gauge pressure (i.e., a refrigerant having low-pressure saturation characteristics; HFC-134a in this example), as is the case in this heat pump system 1, but when such a refrigerant having low-pressure saturation characteristics is used for the objective of obtaining a high-temperature aqueous medium, the gaseous usage-side refrigerant blended in with the refrigeration machine oil is increased by this use of refrigerant under high-temperature conditions. As a result, the coefficient of viscosity of the refrigeration machine oil decreases, a greater amount of refrigeration machine oil is discharged with the refrigerant from the usage-side compressor 62*a*, and there is a risk of lubrication inside the usage-side compressor 62*a* being insufficient; therefore, it is believed that the amount of refrigeration machine oil enclosed with the usage-side refrigerant in the usage-side refrigerant circuit 40*a* must be increased.

When the temperature of the refrigeration machine oil in the usage-side compressor 62*a* is lower than the condensation temperature of the usage-side refrigerant, there is a risk that the usage-side refrigerant will condense in the usage-side compressor 62*a* and dilute the refrigeration machine oil, but particularly in a system for obtaining a high-temperature aqueous medium such as this heat pump system 1, the refrigeration machine oil is diluted quite readily because of the high condensation temperature of the usage-side refrigerant. As a result, there is a risk that the coefficient of viscosity of the refrigeration machine oil will decrease, the amount of refrigeration machine oil discharged with the refrigerant from the usage-side compressor 62*a* will increase, and the lubrication inside the usage-side compressor 62*a* will be insufficient;

therefore, for this reason as well it is believed that the amount of refrigeration machine oil enclosed with the usage-side refrigerant in the usage-side refrigerant circuit 40*a* must be increased. The usage-side refrigerant condenses readily and the refrigeration machine oil is diluted readily particularly with a structure such as the usage-side compressor 62*a* in this heat pump system 1, wherein a high-pressure space (not shown) filled with heat-source-side refrigerant that has been compressed in a compression element is formed inside the casing of the usage-side compressor 62*a*, and the refrigeration machine oil accumulates in this high-pressure space.

Thus, when the amount of refrigeration machine oil is increased, an oil separation mechanism is preferably provided for separating the refrigeration machine oil discharged synchronously with the usage-side refrigerant discharged from the usage-side compressor 62*a* and returning the oil to the intake of the usage-side compressor 62*a*.

However, during use under high-temperature conditions such as those of this heat pump system 1, since the gaseous usage-side refrigerant blended in with the refrigeration machine oil increases and the refrigeration machine oil is readily diluted as described above, the amount of refrigeration machine oil discharged along with the usage-side refrigerant discharged from the usage-side compressor 62*a* also increases. Therefore, when an oil separation mechanism is provided, a greater amount of usage-side refrigerant is returned to the intake of the usage-side compressor 62*a* together with the refrigeration machine oil, and there is a risk of operating efficiency being reduced.

In view of this, in this heat pump system 1, considering the objective of obtaining a high-temperature aqueous medium (promoting dilution of the refrigeration machine oil due to a greater amount of gaseous usage-side refrigerant with a high condensation temperature being dissolved in the refrigeration machine oil, and due to condensation of the usage-side refrigerant) as well as the low risk of refrigeration machine oil backing up in portions of the usage-side refrigerant circuit 40*a* other than the usage-side compressor 62*a* (i.e., circuit structural characteristics, which are that the usage-side refrigerant circuit 40*a* is included in the first usage unit 4*a*, and the refrigerant tube has a short length of 3 m or less from the first usage-side heat exchanger 41*a* functioning as an evaporator of the usage-side refrigerant to the usage-side compressor 62*a*), the usage-side refrigerant circuit 40*a* is not provided with an oil separation mechanism for separating refrigeration machine oil included in the usage-side refrigerant discharged from the usage-side compressor 62*a* and returning the oil to the intake of the usage-side compressor 62*a*, and the weight of usage-side refrigerant enclosed in the usage-side refrigerant circuit 40*a* is one to three times the weight of the refrigeration machine oil enclosed for lubricating the usage-side compressor, unlike the conventional practice concerning the weight of refrigeration machine oil.

It is thereby possible in this heat pump system 1 to obtain a high-temperature aqueous medium while allowing a greater amount of usage-side refrigerant to be returned with the refrigeration machine oil to the intake of the usage-side compressor 62*a* and suppressing both the resulting decrease in operating efficiency and insufficient lubrication inside the usage-side compressor 62*a*.

Particularly, in this heat pump system 1, since HFC-134a is used as the usage-side refrigerant, an even higher-temperature aqueous medium can be obtained, and the operational effects described above are more pronounced.

—B—

In this heat pump system 1, to stably obtain a high-temperature aqueous medium, the refrigeration cycle in the heat-source-side refrigerant circuit 20 and the refrigeration cycle in the usage-side refrigerant circuit 40*a* are both preferably controlled so as to be stable, but in this heat pump system 1, the compressors 21, 62*a* of the refrigerant circuits 20, 40*a* are both variable capacity compressors, the saturation temperatures corresponding to the refrigerant pressures in the discharges of the compressors 21, 62*a* (i.e. the heat-source-side discharge saturation temperature Tc1 and the usage-side discharge saturation temperature Tc2) are used as values representing refrigerant pressures of the refrigeration cycles, and capacity control of the compressors 21, 62*a* is performed so that the discharge saturation temperatures Tc1, Tc2 reach the target discharge saturation temperatures Tc1*s*, Tc2*s*; therefore, the refrigeration cycle states in the refrigerant circuits 20, 40*a* can be stabilized and a high-temperature aqueous medium can thereby be stably obtained. Moreover, in this heat pump system 1, the first usage-side heat exchanger 41*a* is a heat exchanger which directly transfers heat by heat exchange between the heat-source-side refrigerant and the usage-side refrigerant, and there is little heat loss during a transfer of heat from the heat-source-side refrigerant circuit 20 to the usage-side refrigerant circuit 40*a*, which contributes to obtaining a high-temperature aqueous medium.

(1) Modification 1

In the heat pump system 1 described above, since an oil separation mechanism is not provided to the discharge of the usage-side compressor 62*a*, refrigeration machine oil is readily led with the usage-side refrigerant into the refrigerant-water heat exchanger 65*a* functioning as a radiator of the usage-side refrigerant, and under high-temperature conditions, biphasic separation of the liquid usage-side refrigerant and the refrigeration machine oil occurs readily in the refrigerant-water heat exchanger 65*a*, and refrigeration machine oil therefore readily backs up within the refrigerant-water heat exchanger 65*a* functioning as a radiator of the usage-side refrigerant. As described above, when subcooling degree control of the outlet of the refrigerant-water heat exchanger 65*a* is performed, the liquid usage-side refrigerant accumulates in the refrigerant-water heat exchanger 65*a* in an amount corresponding to the usage-side refrigerant degree of subcooling SC2, therefore making biphasic separation of the liquid usage-side refrigerant and the refrigeration machine oil occur even more readily.

Figure 2:
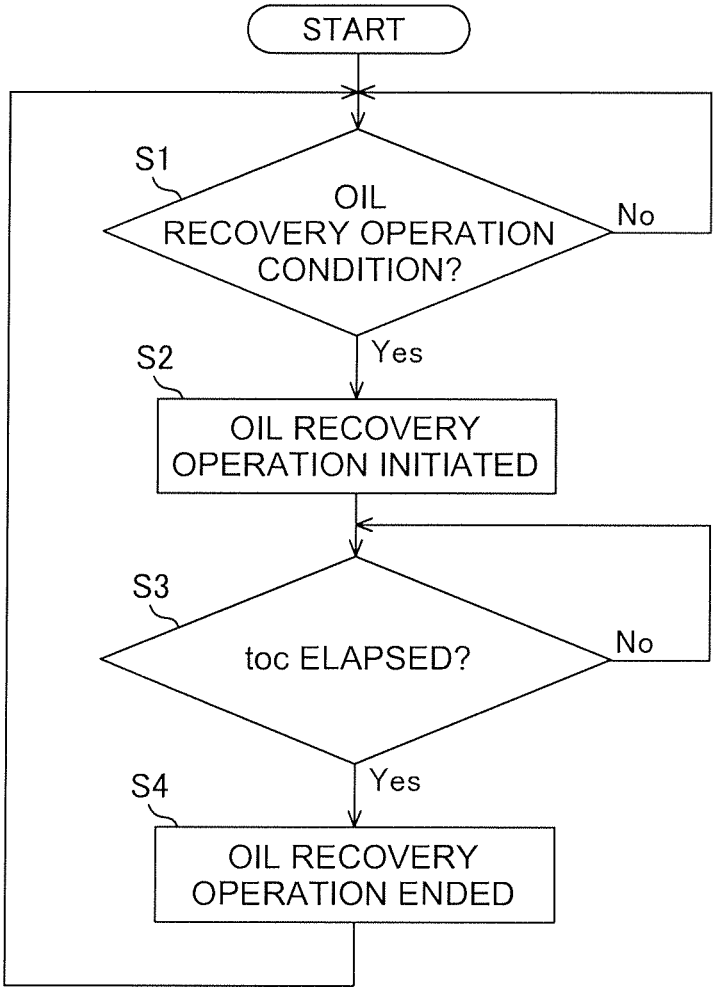
FIG. 2 is a flowchart showing oil recovery operation control of the usage-side refrigerant circuit in Modification 1 of the first embodiment, Modification 1 of the second embodiment, and Modification 1 of the third embodiment.

In view of this, in this heat pump system 1, as shown in FIG. 2, when it has been determined that the refrigeration machine oil in the usage-side compressor 62*a* is insufficient (step S1), an oil recovery operation is performed in which the usage-side refrigerant including refrigeration machine oil in the refrigerant-water heat exchanger 65*a* is passed through the refrigerant-water heat-exchange-side flow rate adjustment valve 66*a* and the first usage-side heat exchanger 41*a*, and returned to the usage-side accumulator 67*a* which is in a low-temperature condition in which biphasic separation of the liquid usage-side refrigerant and refrigeration machine oil does not occur readily (step S2).

The determination of whether or not refrigeration machine oil is insufficient in the usage-side compressor 62*a* is performed based on a usage-side discharge temperature Td2, which is the temperature of the usage-side refrigerant in the discharge of the usage-side compressor 62*a*, or an aqueous medium outlet temperature Tw1, which is the temperature of the aqueous medium in the outlet of the refrigerant-water heat exchanger 65*a*. More specifically, when the operation has continued for a predetermined oil insufficiency operation time to1 or longer in a state in which the usage-side discharge temperature Td2 is higher than a predetermined oil insufficiency discharge temperature Toc1 and the operating frequency 12 of the usage-side compressor 62*a* is higher than a predetermined oil insufficiency frequency foc1, or when the operation has continued for a predetermined oil insufficiency operation time to 2 or longer in a state in which the aqueous medium outlet temperature Tw1 is higher than a predetermined oil insufficiency outlet temperature Toc2 and the operating frequency 12 of the usage-side compressor 62*a* is higher than a predetermined oil insufficiency frequency foc2, the refrigeration machine oil in the usage-side compressor 62*a* is determined to be insufficient. Thereby, the determination of whether or not the refrigeration machine oil in the usage-side compressor 62*a* is insufficient can be appropriately made while taking into account the extent to which the usage-side refrigerant is blended into the refrigeration machine oil in the usage-side compressor 62*a* and the extent of biphasic separation of the usage-side refrigerant and refrigeration machine oil in the refrigerant-water heat exchanger 65*a*.

In the oil recovery operation (step S2), the refrigerant-water heat-exchange-side flow rate adjustment valve 66*a* is fully opened, and the operating frequency f2 of the usage-side compressor 62*a* is set to an oil recovery operation frequency foc, which is a lower frequency than the oil insufficiency frequencies foc1 foc2. Thereby, the amount of refrigeration machine oil discharged with the usage-side refrigerant from the usage-side compressor 62*a* can be reduced, and the refrigeration machine oil backed up in the refrigerant-water heat exchanger 65*a* can be quickly expelled. Moreover, in this heat pump system 1, since the refrigerant tube from the first usage-side heat exchanger 41*a* functioning as an evaporator of usage-side refrigerant to the usage-side compressor 62*a* has a short length of 3 m or less, the refrigeration machine oil expelled from the refrigerant-water heat exchanger 65*a* can be quickly returned to the usage-side accumulator 67*a* without getting backed up in the refrigerant tube from the first usage-side heat exchanger 41*a* functioning as an evaporator of usage-side refrigerant to the usage-side compressor 62*a*.

After a predetermined oil recovery operation time toc has elapsed (step S3), the first usage unit 4*a* is returned to the operation state prior to the oil recovery operation (step S4).

It is thereby possible in this heat pump system 1 to ensure that there will be no insufficiency of refrigeration machine oil in the usage-side compressor 62*a*. During the oil recovery operation, the operation of making the refrigerant-water heat exchanger 65*a* function as a radiator of usage-side refrigerant and heating the aqueous medium can be continued, and the adverse effect that the oil recovery operation has on the hot-water-supply operation can thereby be reduced as much as possible.

(2) Modification 2

Figure 3:
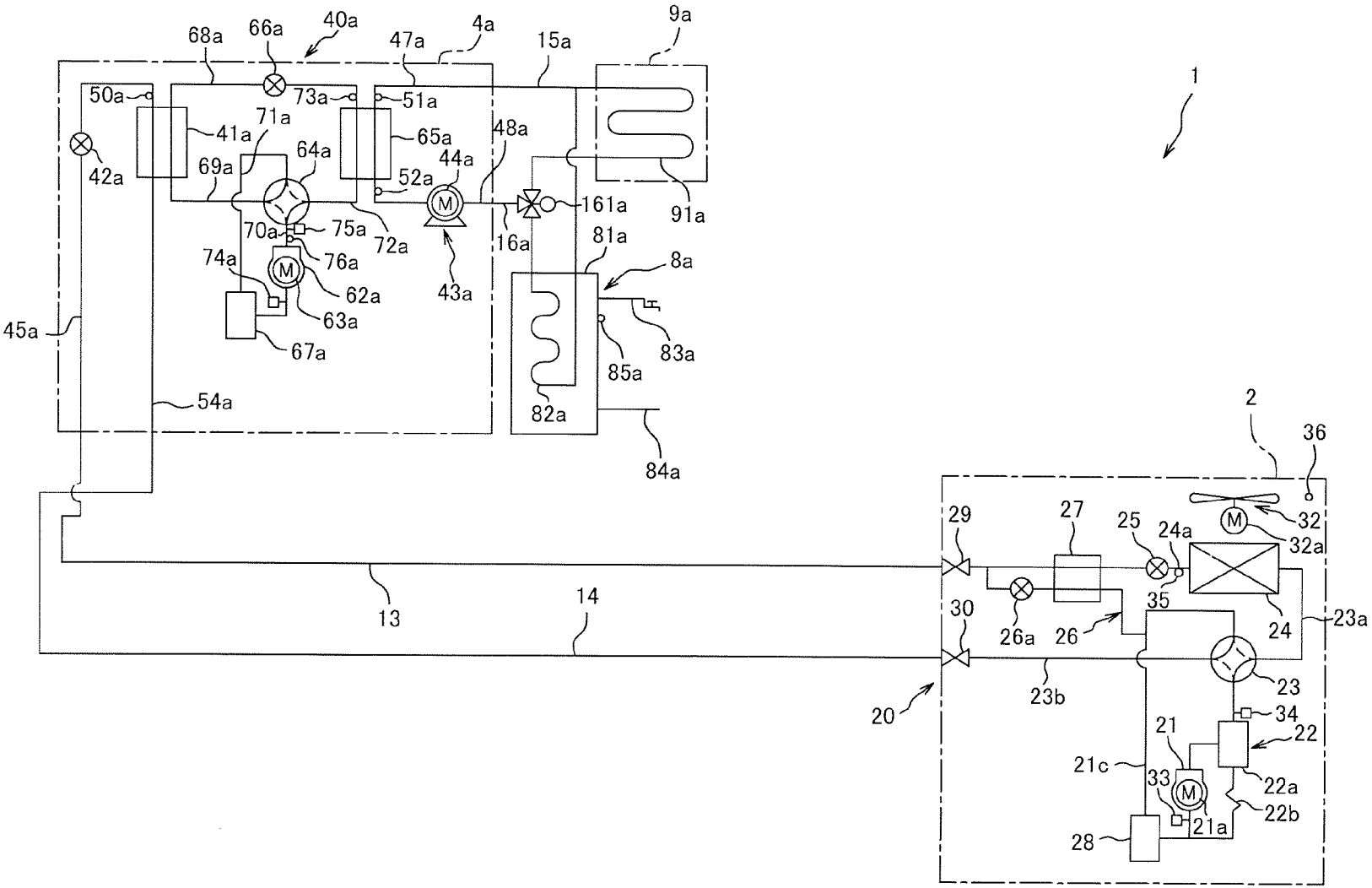
FIG. 3 is a schematic structural diagram of a heat pump system according to Modification 2 of the first embodiment.

In the heat pump system 1 described above (see FIG. 1), the usage-side refrigerant circuit 40*a* may be further provided with a first usage-side switching mechanism 64*a* for switching between a usage-side radiating operation state in which the refrigerant/water heat exchanger 65*a* is made to function as a radiator of the usage-side refrigerant and the first usage-side heat exchanger 41*a* is made to function as an evaporator of the usage-side refrigerant, and a usage-side evaporating operation state in which the refrigerant/water heat exchanger 65*a* is made to function as an evaporator of the usage-side refrigerant and the first usage-side heat exchanger 41*a* is made to function as a radiator of the usage-side refrigerant, as shown in FIG. 3.

Here, the first usage-side switching mechanism 64*a* is a four-way switching valve, and is connected to the cascade-side discharge tube 70*a*, the cascade-side intake tube 71*a*, the first cascade-side gas-refrigerant tube 72*a*, and the second cascade-side gas-refrigerant tube 69*a*. The first usage-side switching mechanism 64*a* is capable of switching between placing the cascade-side discharge tube 70*a* and the first cascade-side gas-refrigerant tube 72*a* in communication and the second cascade-side gas-refrigerant tube 69*a* and the cascade-side intake tube 71*a* in communication (corresponding to the usage-side radiating operation state; see the solid line of the first usage-side switching mechanism 64*a* in FIG. 3), and placing the cascade-side discharge tube 70*a* and the second cascade-side gas-refrigerant tube 69*a* in communication and the first cascade-side gas-refrigerant tube 72*a* and the cascade-side intake tube 71*a* in communication (corresponding to the usage-side evaporating operation state; see the broken line of first usage-side switching mechanism 64*a* in FIG. 3). The first usage-side switching mechanism 64*a* is not limited to being a four-way switching valve, but may also be, e.g., a configuration in which a plurality of solenoid valves are used in combination to achieve a function similar to that described above for switching the direction of flow of the usage-side refrigerant.

With the heat pump system 1 having such a configuration, in the case that defrosting of the heat-source-side heat exchanger 24 has been determined to be required by operation of the hot-water supply operation mode, defrosting operation can be performed such that the heat-source-side switching mechanism 23 is set in the heat-source-side radiating operation state, whereby the heat-source-side heat exchanger 24 is made to function as a radiator of the heat-source-side refrigerant; and the first usage-side switching mechanism 64*a* is set in the usage-side evaporating operation state, whereby the refrigerant/water heat exchanger 65*a* is made to function as an evaporator of the usage-side refrigerant and the first usage-side heat exchanger 41*a* is made to function as a radiator of the usage-side refrigerant.

Figure 4:
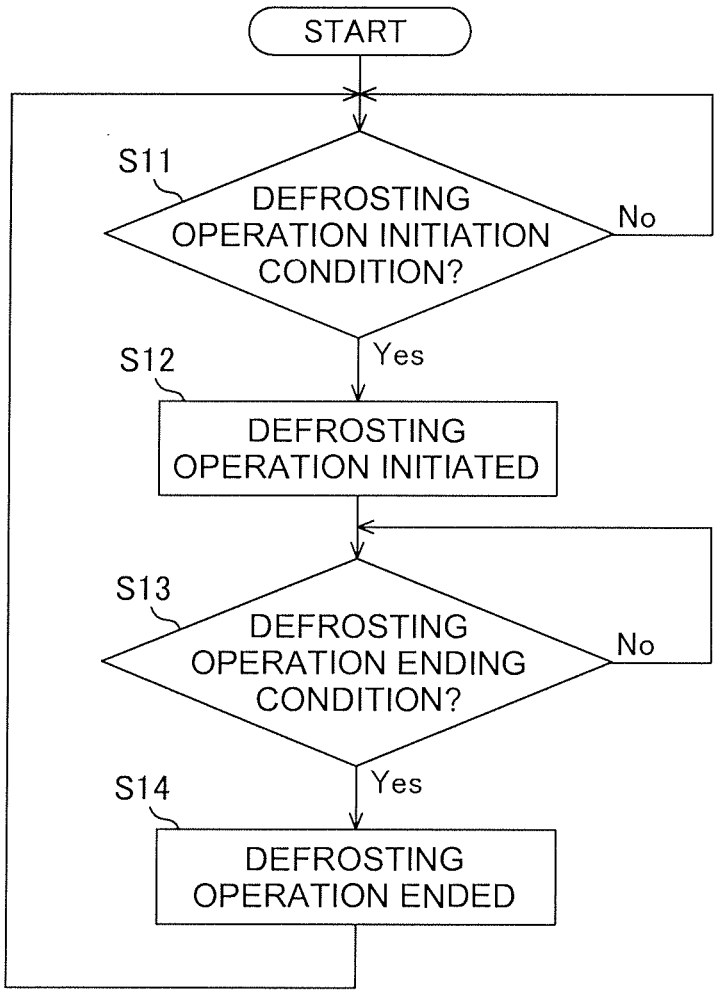
FIG. 4 is a flowchart showing the defrosting operation in Modification 2 of the first embodiment, Modification 2 of the second embodiment, and Modification 2 of the third embodiment.

Operation in the defrosting operation is described below with reference to FIG. 4.

It is first determined whether predetermined defrosting operation start conditions have been satisfied (i.e., whether defrosting of the heat-source-side heat exchanger 24 is required; step S21). Here, it is determined whether defrosting operation start conditions have been satisfied based on whether a defrosting time interval Δtdf (i.e., the cumulative operation time from the end of the previous defrosting operation) has reached a predetermined defrosting time interval setting value Δtdfs.

In the case that it has been determined that the defrosting operation start conditions have been satisfied, the following defrosting operation is started (step S12).

When the defrosting operation is started, the heat-source-side switching mechanism 23 is switched to the heat-source-side radiating operation state (the state indicated by the solid line of the heat-source-side switching mechanism 23 of FIG. 3) in the heat-source-side refrigerant circuit 20, and the first usage-side switching mechanism 64*a* is switched to the usage-side evaporating operation state (the state indicated by the broken line of the first usage-side switching mechanism 64*a* of FIG. 3) in the usage-side refrigerant circuit 40*a*, and the intake return expansion valve 26*a* is set in a closed state.

In the heat-source-side refrigerant circuit 20 in such a state, the low-pressure heat-source-side refrigerant in the refrigeration cycle is taken into the heat-source-side compressor 21 by way of the heat-source-side intake tube 21*c*, compressed to high pressure in the refrigeration cycle, and thereafter discharged to the heat-source-side discharge tube 21*b*. The high-pressure heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* by way of the oil return tube 22*b*. The high-pressure, heat-source-side refrigerant from which the refrigeration machine oil has been separated out is sent to the heat-source-side heat exchanger 24 by way of the heat-source-side switching mechanism 23 and the first heat-source-side gas-refrigerant tube 23*a*. The high-pressure, heat-source-side refrigerant sent to the heat-source-side heat exchanger 24 undergoes heat exchange with ice deposited in the heat-source-side heat exchanger 24 and heat is released in the heat-source-side heat exchanger 24. The high-pressure, heat-source-side refrigerant having released heat in the heat-source-side heat exchanger is sent to the subcooler 27 by way of the heat-source-side expansion valve 25. The heat-source-side refrigerant sent to the subcooler 27 is sent from the heat source unit 2 to the liquid refrigerant communication tube 13 by way of the heat-source-side liquid-refrigerant tube 24*a* and the liquid-side shutoff valve 29 without undergoing heat exchange because the heat-source-side refrigerant does not flow in the intake return tube 26.

The heat-source-side refrigerant sent to the liquid refrigerant communication tube 13 is sent to the first usage unit 4*a*.

The heat-source-side refrigerant sent to the first usage unit 4*a* is sent to the first usage-side flow rate adjustment valve 42*a*. The heat-source-side refrigerant sent to the first usage-side flow rate adjustment valve 42*a* is depressurized in the first usage-side flow rate adjustment valve 42*a* to a low-pressure gas-liquid two-phase state, and sent to the first usage-side heat exchanger 41*a* through the first usage-side liquid refrigerant tube 45*a*. The low-pressure heat-source-side refrigerant sent to the first usage-side heat exchanger 41*a* is heat-exchanged with the high-pressure usage-side refrigerant in the refrigeration cycle that circulates through the usage-side refrigerant circuit 40*a* and evaporated in the first usage-side heat exchanger 41*a*. The low-pressure heat-source-side refrigerant evaporated in the first usage-side heat exchanger 41*a* is sent from the first usage unit 4*a* to the gas refrigerant communication tube 14 through the first usage-side gas refrigerant tube 54*a*.

The heat-source-side refrigerant sent from the first usage unit 4*a* to the gas refrigerant communication tube 14 is sent to the heat source unit 2. The low-pressure heat-source-side refrigerant sent to the heat source unit 2 is sent to the heat-source-side accumulator 28 through the gas-side shutoff valve 30, the second heat-source-side gas refrigerant tube 23*b*, and the heat-source-side switching mechanism 23. The low-pressure heat-source-side refrigerant sent to the heat-source-side accumulator 28 is again drawn into the heat-source-side compressor 21 through the heat-source-side intake tube 21*c*.

The high-pressure, usage-side refrigerant in the refrigeration cycle that circulates through the usage-side refrigerant circuit 40*a* releases heat in the usage-side refrigerant circuit 40*a* by the evaporation of the heat-source-side refrigerant in the first usage-side heat exchanger 41*a*. The high-pressure, usage-side refrigerant having released heat in the first usage-side heat exchanger 41*a* is sent to the refrigerant/water heat exchange-side flow rate adjustment valve 66*a*. The high-pressure, usage-side refrigerant sent to the refrigerant/water heat exchange-side flow rate adjustment valve 66*a* is depressurized in the refrigerant/water heat exchange-side flow rate adjustment valve 66*a* to become a low-pressure gas-liquid two-phase state, and is then sent to the refrigerant/water heat exchanger 65*a* by way of the cascade-side liquid-refrigerant tube 68*a*. The low-pressure, usage-side refrigerant sent to the refrigerant/water heat exchanger 65*a* undergoes heat exchange with the aqueous medium circulated through the aqueous medium circuit 80*a* by the circulation pump 43*a* and evaporates in the refrigerant/water heat exchanger 65*a*. The low-pressure, usage-side refrigerant thus evaporated in the refrigerant/water heat exchanger 65*a* is sent to the usage-side accumulator 67*a* by way of the first cascade-side gas-refrigerant tube 72*a* and the second usage-side switching mechanism 64*a*. The low-pressure, usage-side refrigerant sent to the usage-side accumulator 67*a* is taken into the usage-side compressor 62*a* by way of the cascade-side intake tube 71*a*, compressed to high pressure in the refrigeration cycle, and thereafter discharged to the cascade-side discharge tube 70*a*. The high-pressure, usage-side refrigerant discharged to the cascade-side discharge tube 70*a* is again sent to the first usage-side heat exchanger 41*a* by way of the second usage-side switching mechanism 64*a* and the second cascade-side gas-refrigerant tube 69*a*.

In this manner, the defrosting operation is started in which the heat-source-side switching mechanism 23 is set in the heat-source-side radiating operation state to thereby cause the heat-source-side heat exchanger 24 to function as a radiator of the heat-source-side refrigerant; and the first usage-side switching mechanism 64*a* is set in the usage-side evaporating operation state to thereby cause the refrigerant/water heat exchanger 65*a* to function as an evaporator of the usage-side refrigerant and cause the first usage-side heat exchanger 41*a* to function as a radiator of the usage-side refrigerant (i.e., as an evaporator of the heat-source-side refrigerant).

It is determined whether predetermined defrosting operation end conditions have been satisfied (i.e., whether defrosting of the heat-source-side heat exchanger 24 has ended; step S13). Here, it is determined whether the defrosting operation end conditions have been satisfied depending on whether the heat-source-side heat exchanger temperature Thx has reached the predetermined defrosting completion temperature Thxs, or whether the defrosting operation time tdf, which is the time elapsed from the start of the defrosting operation, has reached a predetermined defrosting operation setting time tdfs.

In the case that it has been determined that the defrosting operation end conditions have been satisfied, the defrosting operation is ended and the process returns to the hot-water supply operation mode, the air-warming operation mode, and/or the hot-water supply/air-warming operation mode (step S14).

Thereby, when the heat-source-side heat exchanger 24 is defrosted in this heat pump system 1, not only is the heat-source-side heat exchanger 24 made to function as a radiator of heat-source-side refrigerant by putting the heat-source-side switching mechanism 23 into the heat-source-side radiating operation state, but the refrigerant-water heat exchanger 65*a* is made to function as an evaporator of usage-side refrigerant and the first usage-side heat exchanger 41*a* is made to function as a radiator of usage-side refrigerant by putting the first usage-side switching mechanism 64*a* into the usage-side evaporating operation state; therefore, the heat-source-side refrigerant cooled by heat radiation in the heat-source-side heat exchanger 24 can be heated by the heat radiation of the usage-side refrigerant in the first usage-side heat exchanger 41*a*, the usage-side refrigerant cooled by heat radiation in the first usage-side heat exchanger 41*a* can be heated by being evaporated in the refrigerant-water heat exchanger 65*a*, and the heat-source-side heat exchanger 24 can thereby be reliably defrosted.

In the heat pump system 1 having this type of configuration, when the oil recovery operation becomes necessary in the hot-water-supply operation mode, the oil recovery operation of Modification 1 of the first embodiment can be performed while the first usage-side switching mechanism 64*a* is kept in the usage-side radiating operation state (i.e., is not switched).

(3) Modification 3

Figure 5:
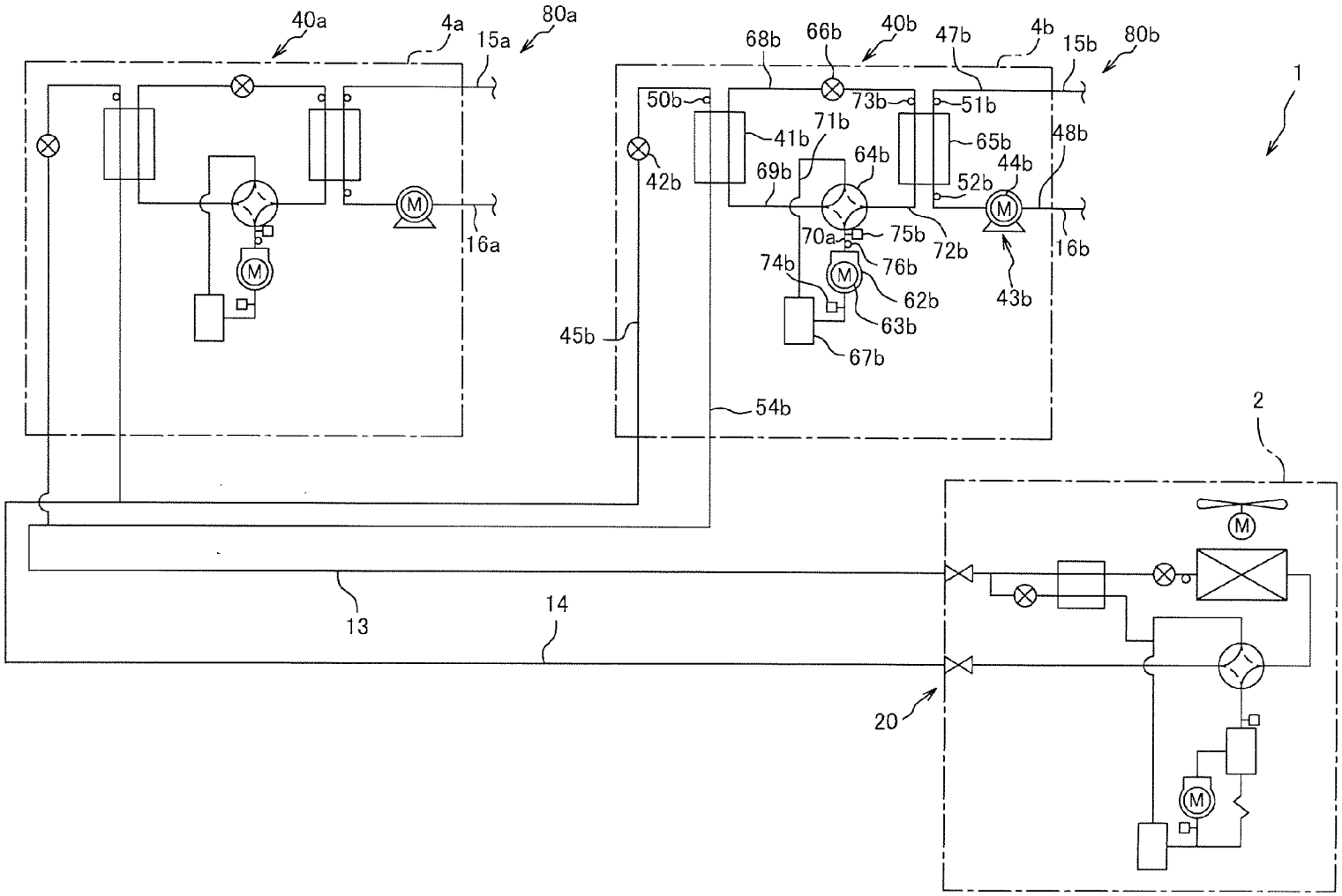
FIG. 5 is a schematic structural diagram of a heat pump system according to Modification 3 of the first embodiment.

With the heat pump system 1 described above (see FIGS. 1 and 3), a single first usage unit 4*a* is connected to the heat source unit 2 via the refrigerant communication tubes 13, 14, but a plurality of first usage units 4*a*, 4*b* (two, in this case) may be connected in parallel to each other via the refrigerant communication tubes 13, 14, as shown in FIG. 5 (in this case, the hot-water/air-warming unit, the hot-water storage unit, the aqueous medium circuits 80*a*, 80*b*, and the like are not shown). The configuration of the first usage unit 4*b* is the same as the configuration of the first usage unit 4*a* with the subscript "b" used in place of the subscript "a" of the reference numerals indicating each part of the first usage unit 4*a*, and a description of each part of the first usage unit 4*b* is therefore omitted. With this heat pump system 1, it is possible to accommodate a plurality of locations and/or applications that require heating of the aqueous medium.

(Second Embodiment)

In the heat pump system 1 in the first embodiment and modifications thereof described above (see FIGS. 1, 3, and 5), it is preferred that hot-water supply operation as well as indoor air warming can be performed.

Figure 7:
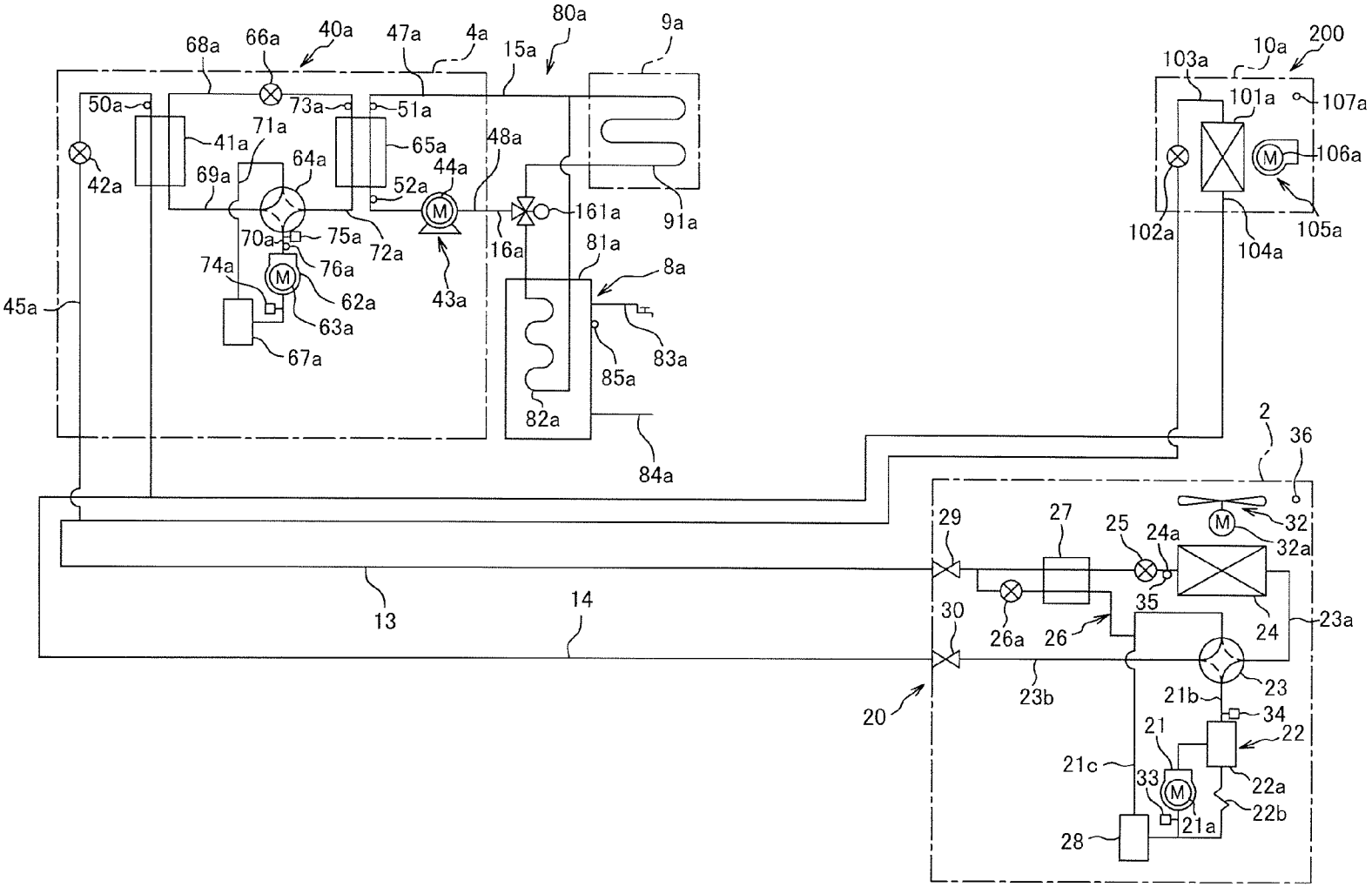
FIG. 7 is a schematic structural diagram of a heat pump system according to Modification 2 of the second embodiment.

In view of the above, with a heat pump system 200, a second usage-side heat exchanger 101*a*, which is capable of heating an air medium by functioning as a radiator of the heat-source-side refrigerant in the configuration of the heat pump system 1 (see FIG. 1) according to the first embodiment described above, is further provided to the heat-source-side refrigerant circuit 20, as shown in FIG. 7. The configuration of the heat pump system 200 is described below.

<Configuration>

—Overall Configuration—

Figure 6:
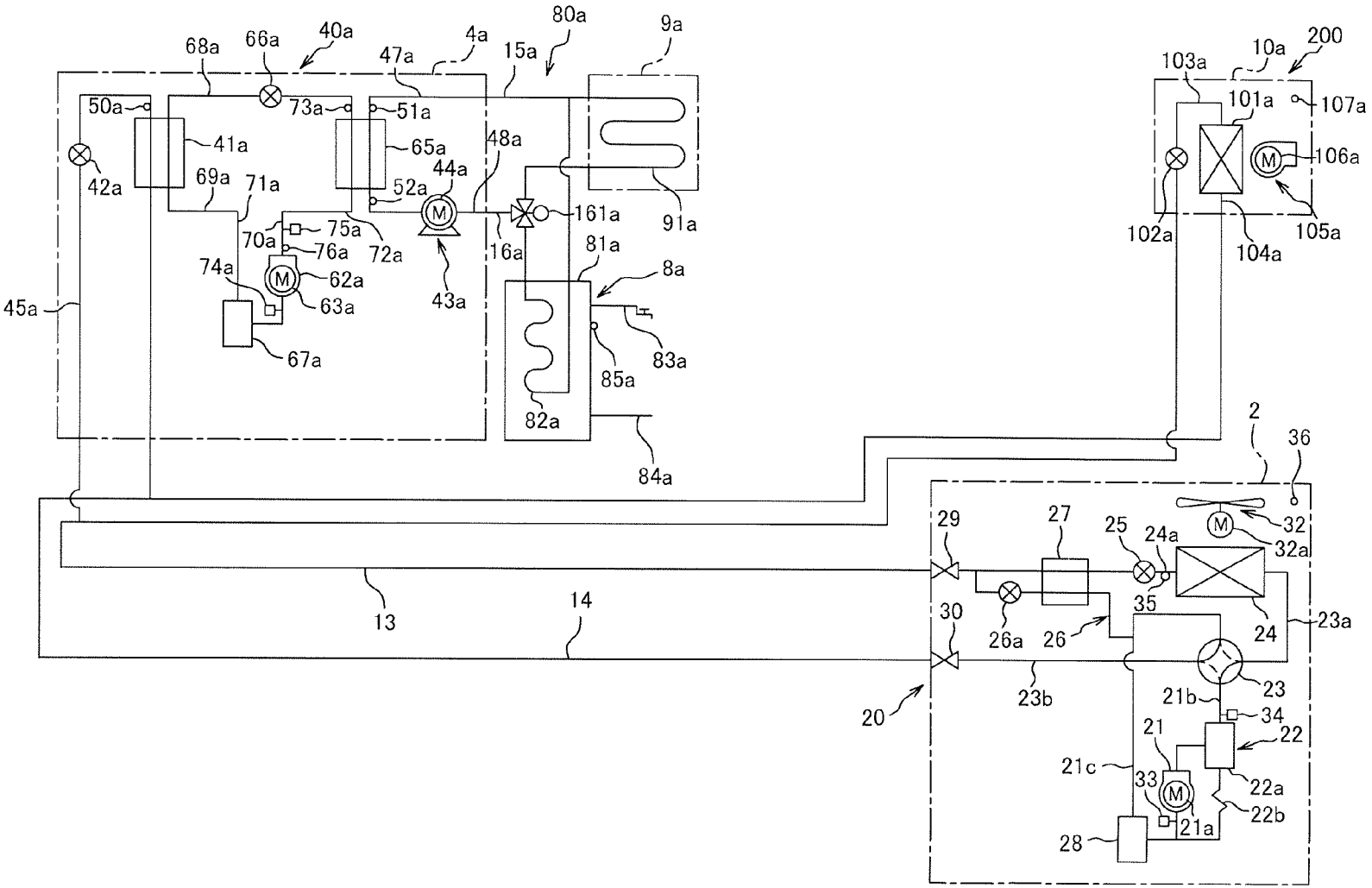
FIG. 6 is a schematic structural diagram of a heat pump system according to the second embodiment and Modification 1 of the second embodiment.

FIG. 6 is a view showing the general configuration of the heat pump system 200 according to a second embodiment of the present invention. The heat pump system 200 is an apparatus capable of performing operation for heating an aqueous medium and performing other operations using a vapor compression heat pump cycle.

The heat pump system 200 mainly has a heat source unit 2, a first usage unit 4*a*, a second usage unit 10*a*, a liquid-refrigerant communication tube 13, a gas-refrigerant communication tube 14, a hot-water storage unit 8*a*, a hot-water air-warming unit 9*a*, an aqueous medium communication tube 15*a*, and an aqueous medium communication tube 16*a*. The heat source unit 2, the first usage unit 4*a*, and the second usage unit 10*a* are connected via the refrigerant communication tubes 13, 14 to thereby constitute a heat-source-side refrigerant circuit 20. The first usage unit 4*a* constitutes a usage-side refrigerant circuit 40*a*. The first usage unit 4*a*, the hot-water storage unit 8*a*, and the hot-water air-warming unit 9*a* are connected via the aqueous medium communication tubes 15*a*, 16*a* to thereby constitute an aqueous medium circuit 80*a*. HFC-410A, which is a type of HFC-based refrigerant, is enclosed inside the heat-source-side refrigerant circuit 20 as a heat-source-side refrigerant, and an ester-based or ether-based refrigeration machine oil having compatibility in relation to the HFC-based refrigerant is enclosed for lubrication of the heat-source-side compressor 21. HFC-134a, which is a type of HFC-based refrigerant, is enclosed inside the usage-side refrigerant circuit 40*a* as a usage-side refrigerant, and an ester-based or ether-based refrigeration machine oil having compatibility in relation to the HFC-based refrigerant is enclosed for lubrication of the usage-side compressor 62*a*. The usage-side refrigerant is preferably one in which the pressure that corresponds to a saturated gas temperature of 65° C. is a maximum gauge pressure of 2.8 MPa or less, and more preferably 2.0 MPa or less from the viewpoint of using a refrigerant that is advantageous for a high-temperature refrigeration cycle. The weight of the usage-side refrigerant enclosed in the usage-side refrigerant circuit 40*a* is one to three times the weight of the refrigeration machine oil enclosed in order to lubricate the usage-side compressor 62*a*. HFC-134a is a type of refrigerant having such saturation pressure characteristics. Water constituting the aqueous medium circulates in the aqueous medium circuit 80*a*.

In the description related to the configurations below, the same reference numerals will be used and a description omitted for the configuration of the heat source unit 2, the first usage unit 4*a*, the hot-water storage unit 8*a*, the hot-water air-warming unit 9*a*, the liquid refrigerant communication tube 13, the gas-refrigerant communication tube 14, and the aqueous medium communication tubes 15*a*, 16*a*, all of which have the same configuration as those of heat pump system 1 in the first embodiment (see FIG. 1). Only the configuration of the second usage unit 10*a* will be described.

—Second Usage Unit—

The second usage unit 10*a* is installed indoors, is connected to the heat source unit 2 via the refrigerant communication tubes 13, 14, and constitutes a portion of the heat-source-side refrigerant circuit 20.

The second usage unit 10*a* has primarily a second usage-side heat exchanger 101*a* and a second usage-side flow rate adjustment valve 102*a*.

The second usage-side heat exchanger 101*a* is a heat exchanger for functioning as a radiator or evaporator of the heat-source-side refrigerant by exchanging heat between the heat-source-side refrigerant and indoor air as the air medium, a second usage-side liquid refrigerant tube 103*a* is connected to the liquid side of the second usage-side heat exchanger 101*a*, and a second usage-side gas refrigerant tube 104*a* is connected to the gas side of the second usage-side heat exchanger 101*a*. The liquid refrigerant communication tube 13 is connected to the second usage-side liquid refrigerant tube 103*a*, and the gas refrigerant communication tube 14 is connected to the second usage-side gas refrigerant tube 104*a*.

The air medium for exchanging heat with the heat-source-side refrigerant in the second usage-side heat exchanger 101*a* is fed by a usage-side fan 105*a* driven by a usage-side fan motor 106*a*.

The second usage-side flow rate adjustment valve 102*a* is an electrical expansion valve whereby the flow rate of heat-source-side refrigerant flowing through the second usage-side heat exchanger 101*a* can be varied by controlling the opening degree of the second usage-side flow rate adjustment valve 102*a*, and the second usage-side flow rate adjustment valve 102*a* is provided to the second usage-side liquid refrigerant tube 103*a*.

The second usage unit 10*a* is thereby configured so that an air-cooling operation can be performed in which the second usage-side heat exchanger 101*a* is caused to function as an evaporator of the heat-source-side refrigerant introduced from the liquid refrigerant communication tube 13 in the heat-source-side radiating operation state of the heat-source-side switching mechanism 23, whereby the heat-source-side refrigerant evaporated in the second usage-side heat exchanger 101*a* is directed to the gas refrigerant communication tube 14, and the air medium is cooled by evaporation of the heat-source-side refrigerant in the second usage-side heat exchanger 101*a*. The second usage unit 10*a* is also configured so that an air-warming operation can be performed in which the second usage-side heat exchanger 101*a* is caused to function as a radiator of the heat-source-side refrigerant introduced from the gas refrigerant communication tube 14 in the heat-source-side evaporating operation state of the heat-source-side switching mechanism 23, whereby the heat-source-side refrigerant radiated in the second usage-side heat exchanger 101*a* is directed to the liquid refrigerant communication tube 13, and the air medium is heated by radiation of the heat-source-side refrigerant in the second usage-side heat exchanger 101*a*.

Various sensors are provided to the second usage unit 10*a*. Specifically, the second usage unit 10*a* is provided with an outdoor temperature sensor 107*a* for detecting an outdoor temperature Tr.

A control unit (not shown) for performing the following operations and/or various controls is provided to the heat pump system 200.

<Operation>

Next, the operation of the heat pump system 200 will be described.

The operation modes of the heat pump system 200 include a hot-water supply operation mode in which only the hot-water supply operation of the first usage unit 4*a* is performed (i.e., operation of the hot-water storage unit 8*a* and/or the hot-water air-warming unit 9*a*), an air-cooling operation mode in which only air-cooling operation of the second usage unit 10*a* is performed, an air-warming operation mode in which only air-warming operation of the second usage unit 10*a* is performed, and a hot-water supply/air-warming operation mode in which hot-water supply operation of the first usage unit 4*a* is performed together with the air-warming operation of the second usage unit 10*a*.

Operation in the four operation modes of the heat pump system 200 is described below.

—Hot-Water Supply Operation Mode—

In the case that only hot-water supply operation of the first usage unit 4*a* is to be performed, the heat-source-side switching mechanism 23 is switched to the heat-source-side evaporating operation state (the state of the heat-source-side switching mechanism 23 indicated by the broken line in FIG. 6) in the heat-source-side refrigerant circuit 20, and an intake-return expansion valve 26*a* and the second usage-side flow rate adjustment valve 102*a* are set in a closed state. Also, in the aqueous medium circuit 80*a*, the aqueous-medium-side switching mechanism 161*a* is switched to a state in which the aqueous medium is fed to the hot-water storage unit 8*a* and/or hot-water air-warming unit 9*a*.

In the heat-source-side refrigerant circuit 20 in such a state, the low-pressure, heat-source-side refrigerant in the refrigeration cycle is taken into the heat-source-side compressor 21 via the heat-source-side intake tube 21*c*, and is discharged to a heat-source-side discharge tube 21*b* after having been compressed to a high pressure in the refrigeration cycle. The high-pressure, heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* via the oil return tube 22*b*. The high-pressure, heat-source-side refrigerant from which the refrigeration machine oil has been separated out is sent from the heat source unit 2 to the gas-refrigerant communication tube 14 via the heat-source-side switching mechanism 23, the second heat-source-side gas refrigerant tube 23*b*, and the gas-side shutoff valve 30.

The high-pressure, heat-source-side refrigerant sent to the gas-refrigerant communication tube 14 is sent to the first usage unit 4*a*. The high-pressure, heat-source-side refrigerant sent to the first usage unit 4*a* is sent to the first usage-side heat exchanger 41*a* via the first usage-side gas refrigerant tube 54*a*. The high-pressure, heat-source-side refrigerant sent to the first usage-side heat exchanger 41*a* undergoes heat exchange with the low-pressure, usage-side refrigerant in the refrigeration cycle that is circulating through the usage-side refrigerant circuit 40*a* and releases heat in the first usage-side heat exchanger 41*a*.

The high-pressure, heat-source-side refrigerant having released heat in the first usage-side heat exchanger 41*a* is sent from the first usage unit 4*a* to the liquid refrigerant communication tube 13 via the first usage-side flow rate adjustment valve 42*a* and the first usage-side liquid refrigerant tube 45*a*.

The heat-source-side refrigerant sent to the liquid refrigerant communication tube 13 is sent to the heat source unit 2. The heat-source-side refrigerant sent to the heat source unit 2 is sent to the subcooler 27 via a liquid-side shutoff valve 29. The heat-source-side refrigerant sent to the subcooler 27 does not undergo heat exchange and is sent to the heat-source-side expansion valve 25 because the heat-source-side refrigerant does not flow in the intake return tube 26. The heat-source-side refrigerant sent to the heat-source-side expansion valve 25 is depressurized in the heat-source-side expansion valve 25 to become a low-pressure gas-liquid two-phase state, and is then sent to the heat-source-side heat exchanger 24 via a heat-source-side liquid-refrigerant tube 24*a*. The low-pressure refrigerant sent to the heat-source-side heat exchanger 24 undergoes heat exchange with outdoor air fed by the heat-source-side fan 32 and is evaporated in the heat-source-side heat exchanger 24. The low-pressure, heat-source-side refrigerant evaporated in the heat-source-side heat exchanger 24 is sent to the heat-source-side accumulator 28 via the first heat-source-side gas-refrigerant tube 23*a* and the heat-source-side switching mechanism 23. The low-pressure, heat-source-side refrigerant sent to the heat-source-side accumulator 28 is again taken into the heat-source-side compressor 21 via the heat-source-side intake tube 21*c*.

In the usage-side refrigerant circuit 40*a*, the low-pressure, usage-side refrigerant in the refrigeration cycle that is circulating through the usage-side refrigerant circuit 40*a* is heated and evaporated by the radiation of the heat-source-side refrigerant in the first usage-side heat exchanger 41*a*. The low-pressure, usage-side refrigerant evaporated in the first usage-side heat exchanger 41*a* is sent to the usage-side accumulator 67*a* via the second cascade-side gas-refrigerant tube 69*a*. The low-pressure, usage-side refrigerant sent to the usage-side accumulator 67*a* is taken into the usage-side compressor 62*a* via the cascade-side intake tube 71*a*, is compressed to high pressure in the refrigeration cycle, and is thereafter discharged to the cascade-side discharge tube 70*a*. The high-pressure, usage-side refrigerant discharged to the cascade-side discharge tube 70*a* is sent to the refrigerant/water heat exchanger 65*a* via the first cascade-side gas-refrigerant tube 72*a*. The high-pressure, usage-side refrigerant sent to the refrigerant/water heat exchanger 65*a* undergoes heat exchange with the aqueous medium being circulated through the aqueous medium circuit 80*a* by the circulation pump 43*a* and releases heat in the refrigerant/water heat exchanger 65*a*. The high-pressure, usage-side refrigerant having released heat in the refrigerant/water heat exchanger 65*a* is depressurized in the refrigerant/water heat-exchange-side flow rate adjustment valve 66*a* to become a low-pressure gas-liquid two-phase state, and is then sent again to the first usage-side heat exchanger 41*a* via the cascade-side liquid-refrigerant tube 68*a*.

In the aqueous medium circuit 80*a*, the aqueous medium circulating through the aqueous medium circuit 80*a* is heated by the radiation of the usage-side refrigerant in the refrigerant/water heat exchanger 65*a*. The aqueous medium heated in the refrigerant/water heat exchanger 65*a* is taken into the circulation pump 43*a* via the first usage-side water outlet tube 48*a* and pressurized, and is then sent from the first usage unit 4*a* to the aqueous medium communication tube 16*a*. The aqueous medium sent to the aqueous medium communication tube 16*a* is sent to the hot-water storage unit 8*a* and/or the hot-water air-warming unit 9*a* via the aqueous-medium-side switching mechanism 161*a*. The aqueous medium sent to the hot-water storage unit 8*a* undergoes heat exchange with the aqueous medium inside a hot-water storage tank 81*a* and releases heat in the heat exchange coil 82*a*, whereby the aqueous medium inside the hot-water storage tank 81*a* is heated. The aqueous medium sent to the hot-water air-warming unit 9*a* releases heat in the heat exchange panel 91*a*, whereby indoor walls or the like are heated and indoor floors are heated.

Operation in the hot-water supply operation mode for performing only hot-water supply operation of the first usage unit 4*a* is performed in this manner.

—Air-Cooling Operation Mode—

In the case that only air-cooling operation of the second usage unit 10*a* is to be performed, the heat-source-side switching mechanism 23 is switched to the heat-source-side radiating operation state (the state of the heat-source-side switching mechanism 23 indicated by the solid line in FIG. 6) in the heat-source-side refrigerant circuit 20, and the first usage-side flow rate adjustment valve 42*a* is set in a shutoff state.

In the heat-source-side refrigerant circuit 20 in such a state, the heat-source-side refrigerant at the low pressure in the refrigeration cycle is drawn into the heat-source-side compressor 21 through the heat-source-side intake tube 21*c* and compressed to the high pressure in the refrigeration cycle, and subsequently discharged to the heat-source-side discharge tube 21*b*. In the oil separator 22*a*, the refrigeration machine oil is separated from the high-pressure heat-source-side refrigerant discharged to the heat-source-side discharge tube 21*b*. The refrigeration machine oil separated from the heat-source-side refrigerant in the oil separator 22*a* is returned to the heat-source-side intake tube 21*c* through the oil return tube 22*b*. The high-pressure heat-source-side refrigerant from which the refrigeration machine oil has been separated is sent to the heat-source-side heat exchanger 24 through the heat-source-side switching mechanism 23 and the first heat-source-side gas refrigerant tube 23*a*. The high-pressure heat-source-side refrigerant sent to the heat-source-side heat exchanger 24 is heat-exchanged with the outdoor air fed by the heat-source-side fan 32 and radiated in the heat-source-side heat exchanger 24. The high-pressure heat-source-side refrigerant radiated in the heat-source-side heat exchanger is sent to the subcooler 27 through the heat-source-side expansion valve 25. The heat-source-side refrigerant sent to the subcooler 27 is heat-exchanged with the heat-source-side refrigerant diverted to the intake return tube 26 from the heat-source-side liquid refrigerant tube 24*a*, and is cooled to a subcooled state. The heat-source-side refrigerant flowing through the intake return tube 26 is returned to the heat-source-side intake tube 21*c*. The heat-source-side refrigerant cooled in the subcooler 27 is sent from the heat source unit 2 to the liquid refrigerant communication tube 13 through the heat-source-side liquid refrigerant tube 24*a* and the liquid-side shutoff valve 29.

The high-pressure heat-source-side refrigerant sent to the liquid refrigerant communication tube 13 is sent to the second usage unit 10*a*. The high-pressure heat-source-side refrigerant sent to the second usage unit 10*a* is sent to the second usage-side flow rate adjustment valve 102*a*. The high-pressure heat-source-side refrigerant sent to the second usage-side flow rate adjustment valve 102*a* is depressurized in the second usage-side flow rate adjustment valve 102*a* to a low-pressure gas-liquid two-phase state, and sent to the second usage-side heat exchanger 101*a* through the second usage-side liquid refrigerant tube 103*a*. The low-pressure heat-source-side refrigerant sent to the second usage-side heat exchanger 101*a* is heat-exchanged with the air medium fed by the usage-side fan 105*a* and evaporated in the second usage-side heat exchanger 101*a*, and indoor air cooling is thereby performed. The low-pressure heat-source-side refrigerant evaporated in the second usage-side heat exchanger 101*a* is sent from the second usage unit 10*a* to the gas refrigerant communication tube 14 through the second usage-side gas refrigerant tube 104*a*.

The low-pressure heat-source-side refrigerant sent to the gas refrigerant communication tube 14 is sent to the heat source unit 2. The low-pressure heat-source-side refrigerant sent to the heat source unit 2 is sent to the heat-source-side accumulator 28 through the gas-side shutoff valve 30, the second heat-source-side gas refrigerant tube 23*b*, and the heat-source-side switching mechanism 23. The low-pressure heat-source-side refrigerant sent to the heat-source-side accumulator 28 is again drawn into the heat-source-side compressor 21 through the heat-source-side intake tube 21*c*.

The operations in the air-cooling operation mode for performing only the air-cooling operation of the second usage unit 10*a* are thus performed.

—Air-Warming Operation Mode—

In the case that only air-warming operation of the second usage unit 10*a* is to be performed, the heat-source-side switching mechanism 23 is switched to the heat-source-side evaporating operation state (the state of the heat-source-side switching mechanism 23 indicated by the broken line in FIG. 6) in the heat-source-side refrigerant circuit 20, and the intake-return expansion valve 26*a* and the first usage-side flow rate adjustment valve 42*a* are in a shutoff state.

In the heat-source-side refrigerant circuit 20 in such a state, the heat-source-side refrigerant at a low pressure in the refrigeration cycle is drawn into the heat-source-side compressor 21 through the heat-source-side intake tube 21*c* and compressed to a high pressure in the refrigeration cycle, and subsequently discharged to the heat-source-side discharge tube 21*b*. In the oil separator 22*a*, the refrigeration machine oil is separated from the high-pressure heat-source-side refrigerant discharged to the heat-source-side discharge tube 21*b*. The refrigeration machine oil separated from the heat-source-side refrigerant in the oil separator 22*a* is returned to the heat-source-side intake tube 21*c* through the oil return tube 22*b*. The high-pressure heat-source-side refrigerant from which the refrigeration machine oil has been separated is sent from the heat source unit 2 to the gas refrigerant communication tube 14 through the heat-source-side switching mechanism 23, the second heat-source-side gas refrigerant tube 23*b*, and the gas-side shutoff valve 30.

The high-pressure heat-source-side refrigerant sent to the gas refrigerant communication tube 14 is sent to the second usage unit 10*a*. The high-pressure heat-source-side refrigerant sent to the second usage unit 10*a* is sent to the second usage-side heat exchanger 101*a* through the second usage-side gas refrigerant tube 104*a*. The high-pressure heat-source-side refrigerant sent to the second usage-side heat exchanger 101*a* is heat-exchanged with the air medium fed by the usage-side fan 105*a* and radiated in the second usage-side heat exchanger 101*a*, and indoor air warming is thereby performed. The high-pressure heat-source-side refrigerant radiated in the second usage-side heat exchanger 101*a* is sent from the second usage unit 10*a* to the liquid refrigerant communication tube 13 through the second usage-side flow rate adjustment valve 102*a* and the second usage-side liquid refrigerant tube 103*a*.

The heat-source-side refrigerant sent to the liquid refrigerant communication tube 13 is sent to the heat source unit 2. The heat-source-side refrigerant sent to the heat source unit 2 is sent to the subcooler 27 through the liquid-side shutoff valve 29. Since the heat-source-side refrigerant does not flow in the intake return tube 26, the heat-source-side refrigerant sent to the subcooler 27 is sent to the heat-source-side expansion valve 25 without exchanging heat. The heat-source-side refrigerant sent to the heat-source-side expansion valve 25 is depressurized in the heat-source-side expansion valve 25 to a low-pressure gas-liquid two-phase state, and sent to the heat-source-side heat exchanger 24 through the heat-source-side liquid refrigerant tube 24*a*. The low-pressure refrigerant sent to the heat-source-side heat exchanger 24 is heat-exchanged with the outdoor air fed by the heat-source-side fan 32 and evaporated in the heat-source-side heat exchanger 24. The low-pressure heat-source-side refrigerant evaporated in the heat-source-side heat exchanger 24 is sent to the heat-source-side accumulator 28 through the first heat-source-side gas refrigerant tube 23*a* and the heat-source-side switching mechanism 23. The low-pressure heat-source-side refrigerant sent to the heat-source-side accumulator 28 is again drawn into the heat-source-side compressor 21 through the heat-source-side intake tube 21*c*.

The operations in the air-warming operation mode for performing only the air-warming operation of the second usage unit 10*a* are thus performed.

—Hot-Water Supply/Air-Warming Operation Mode—

In the case that hot-water supply operation of the first usage unit 4*a* and the air-warming operation of the second usage unit 10*a* are to be performed together, the heat-source-side switching mechanism 23 is switched to the heat-source-side evaporating operation state (the state of the heat-source-side switching mechanism 23 indicated by the broken line in FIG. 6) in the heat-source-side refrigerant circuit 20, and the intake-return expansion valve 26*a* is in a shutoff state. Also, the aqueous-medium-side switching mechanism 161*a* is switched in the aqueous medium circuit 80*a* to a state in which the aqueous medium is fed to the hot-water storage unit 8*a* and/or the hot-water air-warming unit 9*a*.

In the heat-source-side refrigerant circuit 20 in such a state, the low-pressure, heat-source-side refrigerant in the refrigeration cycle is taken into the heat-source-side compressor 21 via the heat-source-side intake tube 21*c*, is compressed to high pressure in the refrigeration cycle, and is thereafter discharged to the heat-source-side discharge tube 21*b*. The high-pressure, heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* via the oil return tube 22*b*. The high-pressure, heat-source-side refrigerant from which the refrigeration machine oil has been separated out is sent from the heat source unit 2 to the gas-refrigerant communication tube 14 via the heat-source-side switching mechanism 23, the second heat-source-side gas refrigerant tube 23*b*, and the gas-side shutoff valve 30.

The high-pressure, heat-source-side refrigerant sent to the gas-refrigerant communication tube 14 is sent to the first usage unit 4*a* and the second usage unit 10*a*.

The high-pressure heat-source-side refrigerant sent to the second usage unit 10*a* is sent to the second usage-side heat exchanger 101*a* through the second usage-side gas refrigerant tube 104*a*. The high-pressure heat-source-side refrigerant sent to the second usage-side heat exchanger 101*a* undergoes heat exchange with the air medium fed by the usage-side fan 105*a* and releases heat in the second usage-side heat exchanger 101*a*, whereby indoor air warming is performed. The high-pressure heat-source-side refrigerant having released heat in the second usage-side heat exchanger 101*a* is sent from the second usage unit 10*a* to the liquid refrigerant communication tube 13 through the second usage-side flow rate adjustment valve 102*a* and the second usage-side liquid refrigerant tube 103*a*.

The high-pressure heat-source-side refrigerant sent to the first usage unit 4*a* is sent to the first usage-side heat exchanger 41*a* through the first usage-side gas refrigerant tube 54*a*. The high-pressure heat-source-side refrigerant sent to the first usage-side heat exchanger 41*a* undergoes heat exchange with the low-pressure, usage-side refrigerant in the refrigeration cycle that is circulating through the usage-side refrigerant circuit 40*a* and releases heat in the first usage-side heat exchanger 41*a*. The high-pressure, heat-source-side refrigerant having released heat in the first usage-side heat exchanger 41*a* is sent from the first usage unit 4*a* to the liquid refrigerant communication tube 13 via the first usage-side flow rate adjustment valve 42*a* and the first usage-side liquid refrigerant tube 45*a*.

The heat-source-side refrigerant sent from the first usage unit 4*a* and the second usage unit 10*a* to the liquid refrigerant communication tube 13 merges in the liquid refrigerant communication tube 13 and is sent to the heat source unit 2. The heat-source-side refrigerant sent to the heat source unit 2 is sent to the subcooler 27 through the liquid-side shutoff valve 29. Since the heat-source-side refrigerant does not flow in the intake return tube 26, the heat-source-side refrigerant sent to the subcooler 27 is sent to the heat-source-side expansion valve 25 without exchanging heat. The heat-source-side refrigerant sent to the heat-source-side expansion valve 25 is depressurized in the heat-source-side expansion valve 25 to a low-pressure gas-liquid two-phase state and sent to the heat-source-side heat exchanger 24 through the heat-source-side liquid refrigerant tube 24*a*. The low-pressure refrigerant sent to the heat-source-side heat exchanger 24 is heat-exchanged with the outdoor air fed by the heat-source-side fan 32 and evaporated in the heat-source-side heat exchanger 24. The low-pressure heat-source-side refrigerant evaporated in the heat-source-side heat exchanger 24 is sent to the heat-source-side accumulator 28 through the first heat-source-side gas refrigerant tube 23*a* and the heat-source-side switching mechanism 23. The low-pressure heat-source-side refrigerant sent to the heat-source-side accumulator 28 is again drawn into the heat-source-side compressor 21 through the heat-source-side intake tube 21*c*.

In the usage-side refrigerant circuit 40*a*, the low-pressure usage-side refrigerant in the refrigeration cycle that is circulated through the usage-side refrigerant circuit 40*a* is heated and evaporated by the heat released by the heat-source-side refrigerant in the first usage-side heat exchanger 41*a*. The low-pressure usage-side refrigerant evaporated in the first usage-side heat exchanger 41*a* is sent to the usage-side accumulator 67*a* through the second cascade-side gas-refrigerant tube 69*a*. The low-pressure usage-side refrigerant sent to the usage-side accumulator 67*a* is drawn into the usage-side compressor 62*a* through the cascade-side intake tube 71*a*, compressed to high pressure in the refrigeration cycle, and thereafter discharged to the cascade-side discharge tube 70*a*.

The high-pressure usage-side refrigerant discharged to the cascade-side discharge tube 70*a* is sent to the refrigerant/water heat exchanger 65*a* through the first cascade-side gas-refrigerant tube 72*a*. The high-pressure usage-side refrigerant sent to the refrigerant/water heat exchanger 65*a* undergoes heat exchange with the aqueous medium being circulated through the aqueous medium circuit 80*a* by the circulation pump 43*a* and releases heat in the refrigerant/water heat exchanger 65*a*. The high-pressure usage-side refrigerant having released heat in the refrigerant/water heat exchanger 65*a* is depressurized in the refrigerant/water heat-exchange-side flow rate adjustment valve 66*a* to a low-pressure gas-liquid two-phase state, and is again sent to the first usage-side heat exchanger 41*a* through the cascade-side liquid-refrigerant tube 68*a*.

The aqueous medium circulating through the aqueous medium circuit 80*a* is heated in the aqueous medium circuit 80*a* by the heat released by the usage-side refrigerant in the refrigerant/water heat exchanger 65*a*. The aqueous medium heated in the refrigerant/water heat exchanger 65*a* is drawn into the circulation pump 43*a* through the first usage-side water outlet tube 48*a*, pressurized, and subsequently sent from the first usage unit 4*a* to the aqueous medium communication tube 16*a*. The aqueous medium sent to the aqueous medium communication tube 16*a* is sent to the hot-water storage unit 8*a* and/or the hot-water air-warming unit 9*a* through the aqueous medium-side switching mechanism 161*a*. The aqueous medium sent to the hot-water storage unit 8*a* undergoes heat exchange with the aqueous medium inside the hot-water storage tank 81*a* and releases heat in the heat exchange coil 82*a*, whereby the aqueous medium in the hot-water storage tank 81*a* is heated. The aqueous medium sent to the hot-water air-warming unit 9*a* is radiated in the heat exchange panel 91*a*, the walls and other indoor areas are thereby heated, and the indoor floor is heated.

The operations in the hot-water supply/air-warming operation mode for performing the hot-water supply operation of the first usage unit 4*a* as well as the air-warming operation of the second usage unit 10*a* are thus performed.

In the configuration of the heat pump system 200 in which the first usage unit 4*a* for the hot-water-supply operation and the second usage unit 10*a* for the air-cooling and air-warming operations are connected to the heat source unit 2, discharge saturation temperature control of the refrigerant circuits 20, 40*a* and subcooling degree control of the outlets of the heat exchangers 41*a*, 65*a* are performed, similar to the heat pump system 1 (see FIG. 1) in the first embodiment.

It is thereby possible with this heat pump system 200 to achieve the same operational effects as the heat pump system 1 in the first embodiment. Since the second usage unit 10*a* having the second usage-side heat exchanger 101*a* is provided and it is possible to perform the operation (the air-warming operation in this case) of heating the air medium by the heat radiation of the heat-source-side refrigerant in the second usage-side heat exchanger 101*a* as well as the operation (the air-cooling operation in this case) of cooling the air medium by the evaporation of the heat-source-side refrigerant in the second usage-side heat exchanger 101*a*, not only can the aqueous medium heated in the first usage-side heat exchanger 41*a* and the usage-side refrigerant circuit 40*a* be used to supply hot water, but the air medium heated in the second usage-side heat exchanger 101*a* can be used for air-warming of the room interior as well.

(1) Modification 1

Even in a configuration such as that of the above-described heat pump system 200 (see FIG. 6) in which the first usage unit 4*a* for the hot-water-supply operation and the second usage unit 10*a* for the air-cooling and air-warming operations are connected to the heat source unit 2, since an oil separation mechanism is not provided to the discharge of the usage-side compressor 62*a* similar to the heat pump system 1 (see FIG. 1) in Modification 1 of the first embodiment, the refrigeration machine oil is readily led with the usage-side refrigerant into the refrigerant-water heat exchanger 65*a* functioning as a radiator of usage-side refrigerant, and under high-temperature conditions, biphasic separation of the liquid usage-side refrigerant and the refrigeration machine oil readily occurs in the refrigerant-water heat exchanger 65*a*; therefore, refrigeration machine oil readily gets backed up in the refrigerant-water heat exchanger 65*a* functioning as a radiator of usage-side refrigerant. When subcooling degree control of the outlet of the refrigerant-water heat exchanger 65*a* is being performed, liquid usage-side refrigerant in an amount corresponding to the usage-side refrigerant degree of subcooling SC2 accumulates in the refrigerant-water heat exchanger 65*a*, and biphasic separation of the liquid usage-side refrigerant and the refrigeration machine oil therefore occurs even more readily.

In view of this, the same oil recovery operation control (see FIG. 2) as that of the heat pump system 1 (see FIG. 1) of the first embodiment is performed in this heat pump system 200 as well.

It is thereby possible to ensure that there will be no insufficiency of refrigeration machine oil in the usage-side compressor 62*a*. During the oil recovery operation, the operation of making the refrigerant-water heat exchanger 65*a* function as a radiator of usage-side refrigerant and heating the aqueous medium can be continued, and the adverse effect that the oil recovery operation has on the hot-water-supply operation and on the hot-water-supply/air-warming operation can thereby be reduced as much as possible.

(2) Modification 2

In the heat pump system 200 described above (see FIG. 6), the usage-side refrigerant circuit 40*a* may be further provided with a first usage-side switching mechanism 64*a* capable of switching between a usage-side radiating operation state in which the refrigerant/water heat exchanger 65*a* is made to function as a radiator of the usage-side refrigerant and the first usage-side heat exchanger 41*a* is made to function as an evaporator of the usage-side refrigerant, and a usage-side evaporating operation state in which the refrigerant/water heat exchanger 65*a* is made to function as an evaporator of the usage-side refrigerant and the first usage-side heat exchanger 41*a* is made to function as a radiator of the usage-side refrigerant, as shown in FIG. 7, in the same manner as the heat pump system 1 in Modification 2 of the first embodiment (see FIG. 3), even in a configuration in which the first usage unit 4*a* for hot-water supply operation and the second usage unit 10*a* for air-warming and cooling operations are connected to the heat source unit 2.

In the heat pump system 200 having such a configuration, in the case that defrosting of the heat-source-side heat exchanger 24 has been determined to be required by operation of the hot-water supply operation mode, the air-warming operation mode, and/or the hot-water supply/air-warming operation mode, defrosting operation can be performed in which the heat-source-side switching mechanism 23 is set in the heat-source-side radiating operation state, whereby the heat-source-side heat exchanger 24 is made to function as a radiator of the heat-source-side refrigerant, and the second usage-side heat exchanger 101*a* is made to function as an evaporator of the heat-source-side refrigerant; and the first usage-side switching mechanism 64*a* is set in the usage-side evaporating operation state, whereby the refrigerant/water heat exchanger 65*a* is made to function as an evaporator of the usage-side refrigerant and the first usage-side heat exchanger 41*a* is made to function as a radiator of the usage-side refrigerant.

Operation in the defrosting operation is described below with reference to FIG. 4.

It is first determined whether predetermined defrosting operation start conditions have been satisfied (i.e., whether defrosting of the heat-source-side heat exchanger 24 is required; step S11). Here, it is determined whether defrosting operation start conditions have been satisfied based on whether a defrosting time interval Δtdf (i.e., the cumulative operation time from the end of the previous defrosting operation) has reached a predetermined defrosting time interval setting value Δtdfs.

In the case that it has been determined that the defrosting operation start conditions have been satisfied, the following defrosting operation is started (step S12).

Figure 8:
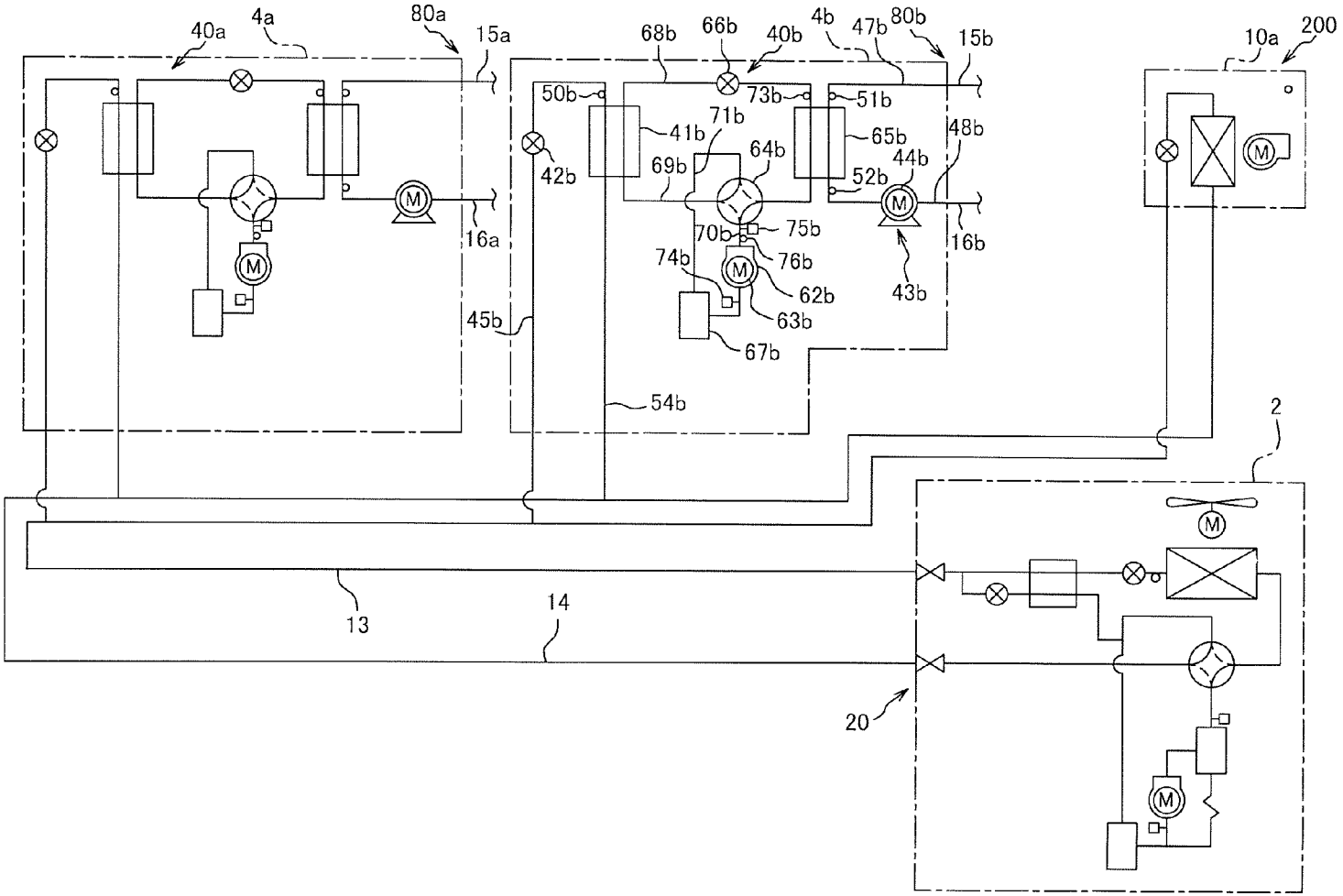
FIG. 8 is a schematic structural diagram of a heat pump system according to Modification 3 of the second embodiment.

When the defrosting operation is started, the heat-source-side switching mechanism 23 is switched to the heat-source-side radiating operation state (the state indicated by the solid line of heat-source-side switching mechanism 23 of FIG. 7) in the heat-source-side refrigerant circuit 20, and the first usage-side switching mechanism 64*a* is switched to the usage-side evaporating operation state (the state indicated by the broken line of the first usage-side switching mechanism 64*a* of FIG. 8) in the usage-side refrigerant circuit 40*a*, and the intake return expansion valve 26*a* is set in a closed state.

In the heat-source-side refrigerant circuit 20 in such a state, the low-pressure heat-source-side refrigerant in the refrigeration cycle is taken into the heat-source-side compressor 21 by way of the heat-source-side intake tube 21*c*, compressed to high pressure in the refrigeration cycle, and thereafter discharged to the heat-source-side discharge tube 21*b*. The high-pressure heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* by way of the oil return tube 22*b*. The high-pressure, heat-source-side refrigerant from which the refrigeration machine oil has been separated out is sent to the heat-source-side heat exchanger 24 by way of the heat-source-side switching mechanism 23 and the first heat-source-side gas-refrigerant tube 23*a*. The high-pressure, heat-source-side refrigerant sent to the heat-source-side heat exchanger 24 undergoes heat exchange with ice deposited in the heat-source-side heat exchanger 24 and heat is released in the heat-source-side heat exchanger 24. The high-pressure, heat-source-side refrigerant having released heat in the heat-source-side heat exchanger is sent to the subcooler 27 by way of the heat-source-side expansion valve 25. The heat-source-side refrigerant sent to the subcooler 27 is sent from the heat source unit 2 to the liquid refrigerant communication tube 13 by way of the heat-source-side liquid-refrigerant tube 24*a* and the liquid-side shutoff valve 29 without undergoing heat exchange because the heat-source-side refrigerant does not flow in the intake return tube 26.

The heat-source-side refrigerant sent to the liquid refrigerant communication tube 13 branches in the liquid refrigerant communication tube 13 and is sent to the first usage unit 4*a* and the second usage unit 10*a*.

The heat-source-side refrigerant sent to the second usage unit 10*a* is sent to the second usage-side flow rate adjustment valve 102*a*. The heat-source-side refrigerant sent to the second usage-side flow rate adjustment valve 102*a* is depressurized in the second usage-side flow rate adjustment valve 102*a* to become a low-pressure gas-liquid two-phase state, and is then sent to the second usage-side heat exchanger 101*a* by way of the second usage-side liquid refrigerant tube 103*a*. The low-pressure, heat-source-side refrigerant sent to the second usage-side heat exchanger 101*a* undergoes heat exchange with an air medium fed by the usage-side fan 105*a* and evaporates in the second usage-side heat exchanger 101*a*. The low-pressure, heat-source-side refrigerant thus evaporated in the second usage-side heat exchanger 101*a* is sent from the second usage unit 10*a* to the gas refrigerant communication tube 14 by way of the second usage-side gas refrigerant tube 104*a*.

The heat-source-side refrigerant sent to the first usage unit 4*a* is sent to the first usage-side flow rate adjustment valve 42*a*. The heat-source-side refrigerant sent to the first usage-side flow rate adjustment valve 42*a* is depressurized in the first usage-side flow rate adjustment valve 42*a* to become a low-pressure gas-liquid two-phase state, and is then sent to the first usage-side heat exchanger 41*a* by way of the first usage-side liquid refrigerant tube 45*a*. The low-pressure, heat-source-side refrigerant sent to the first usage-side heat exchanger 41*a* undergoes heat exchange with the high-pressure usage-side refrigerant in the refrigeration cycle that is circulated through the usage-side refrigerant circuit 40*a* and evaporates in the first usage-side heat exchanger 41*a*. The low-pressure, heat-source-side refrigerant thus evaporated in the first usage-side heat exchanger 41*a* is sent from the first usage unit 4*a* to the gas refrigerant communication tube 14 by way of the first usage-side gas refrigerant tube 54*a* and the first usage-side gas on-off valve 56*a* constituting the first usage-side switching mechanism 53*a*.

The heat-source-side refrigerant sent from the second usage unit 10*a* and the first usage unit 4*a* to the gas refrigerant communication tube 14 merges in the gas refrigerant communication tube 14 and is sent to the heat source unit 2. The low-pressure, heat-source-side refrigerant sent to the heat source unit 2 is sent to the heat-source-side accumulator 28 by way of the gas-side shutoff valve 30, the second heat-source-side gas refrigerant tube 23*b*, and the heat-source-side switching mechanism 23. The low-pressure, heat-source-side refrigerant sent to the heat-source-side accumulator 28 is again taken into the heat-source-side compressor 21 by way of the heat-source-side intake tube 21*c*.

The high-pressure, usage-side refrigerant in the refrigeration cycle that circulates through the usage-side refrigerant circuit 40*a* releases heat in the usage-side refrigerant circuit 40*a* by the evaporation of the heat-source-side refrigerant in the first usage-side heat exchanger 41*a*. The high-pressure, usage-side refrigerant having released heat in the first usage-side heat exchanger 41*a* is sent to the refrigerant/water heat exchange-side flow rate adjustment valve 66*a*. The high-pressure, usage-side refrigerant sent to the refrigerant/water heat exchange-side flow rate adjustment valve 66*a* is depressurized in the refrigerant/water heat exchange-side flow rate adjustment valve 66*a* to become a low-pressure gas-liquid two-phase state, and is then sent to the refrigerant/water heat exchanger 65*a* by way of the cascade-side liquid-refrigerant tube 68*a*. The low-pressure, usage-side refrigerant sent to the refrigerant/water heat exchanger 65*a* undergoes heat exchange with the aqueous medium circulated through the aqueous medium circuit 80*a* by the circulation pump 43*a* and evaporates in the refrigerant/water heat exchanger 65*a*. The low-pressure, usage-side refrigerant thus evaporated in the refrigerant/water heat exchanger 65*a* is sent to the usage-side accumulator 67*a* by way of the first cascade-side gas-refrigerant tube 72*a* and the second usage-side switching mechanism 64*a*. The low-pressure, usage-side refrigerant sent to the usage-side accumulator 67*a* is taken into the usage-side compressor 62*a* by way of the cascade-side intake tube 71*a*, compressed to high pressure in the refrigeration cycle, and thereafter discharged to the cascade-side discharge tube 70*a*. The high-pressure, usage-side refrigerant discharged to the cascade-side discharge tube 70*a* is again sent to the first usage-side heat exchanger 41*a* by way of the second usage-side switching mechanism 64*a* and the second cascade-side gas-refrigerant tube 69*a*.

In this manner, the defrosting operation is started in which the heat-source-side heat exchanger 24 is made to function as a radiator of the heat-source-side refrigerant by setting the heat-source-side switching mechanism 23 in the heat-source-side heat-release operation state; the second usage-side heat exchanger 101*a* is made to function as an evaporator of the heat-source-side refrigerant and the refrigerant/water heat exchanger 65*a* is made to function as an evaporator of the usage-side refrigerant by setting the second usage-side switching mechanism 64*a* in a usage-side evaporating operation state; and the first usage-side heat exchanger 41*a* is made to function as a radiator of the usage-side refrigerant (i.e., as an evaporator of the heat-source-side refrigerant).

It is determined whether predetermined defrosting operation end conditions have been satisfied (i.e., whether defrosting of the heat-source-side heat exchanger 24 has ended; step S13). Here, it is determined whether the defrosting operation end conditions have been satisfied depending on whether the heat-source-side heat exchanger temperature Thx has reached the predetermined defrosting completion temperature Thxs, or whether the defrosting operation time tdf, which is the time elapsed from the start of the defrosting operation, has reached a predetermined defrosting operation setting time tdfs.

In the case that it has been determined that the defrosting operation end conditions have been satisfied, the defrosting operation is ended and the process returns to the hot-water supply operation mode, the air-warming operation mode, and/or the hot-water supply/air-warming operation mode (step S14).

With the heat pump system 200, when the heat-source-side heat exchanger 24 is to be defrosted, not only is the heat-source-side heat exchanger 24 made to function as a radiator of the heat-source-side refrigerant by setting the heat-source-side switching mechanism 23 in the heat-source-side heat-release operation state, but also the refrigerant/water heat exchanger 65*a* is made to function as an evaporator of the usage-side refrigerant by setting the second usage-side switching mechanism 64*a* in the usage-side evaporating operation state because the first usage-side heat exchanger 41*a* is made to function as a radiator of the usage-side refrigerant, the heat-source-side refrigerant cooled by heat release in the heat-source-side heat exchanger 24 is heated by the radiation of the usage-side refrigerant in the first usage-side heat exchanger 41*a*, and the usage-side refrigerant cooled by heat release in the first usage-side heat exchanger 41*a* can be heated by evaporation in the refrigerant/water heat exchanger 65*a*. The defrosting of the heat-source-side heat exchanger 24 can thereby be reliably performed. The defrosting operation time tdf can be shortened, and it is possible to prevent the air medium cooled in the second usage unit 10*a* from reaching a low temperature because the second usage-side heat exchanger 101*a* is also made to function as an evaporator of the heat-source-side refrigerant.

In the heat pump system 200 having such a configuration, when the oil recovery operation becomes necessary in the hot-water-supply operation mode or the hot-water-supply/air-warming operation mode, the oil recovery operation of Modification 1 of the first embodiment can be performed while the first usage-side switching mechanism 64*a* is kept in the usage-side radiating operation state (i.e., is not switched).

(3) Modification 3

Figure 9:
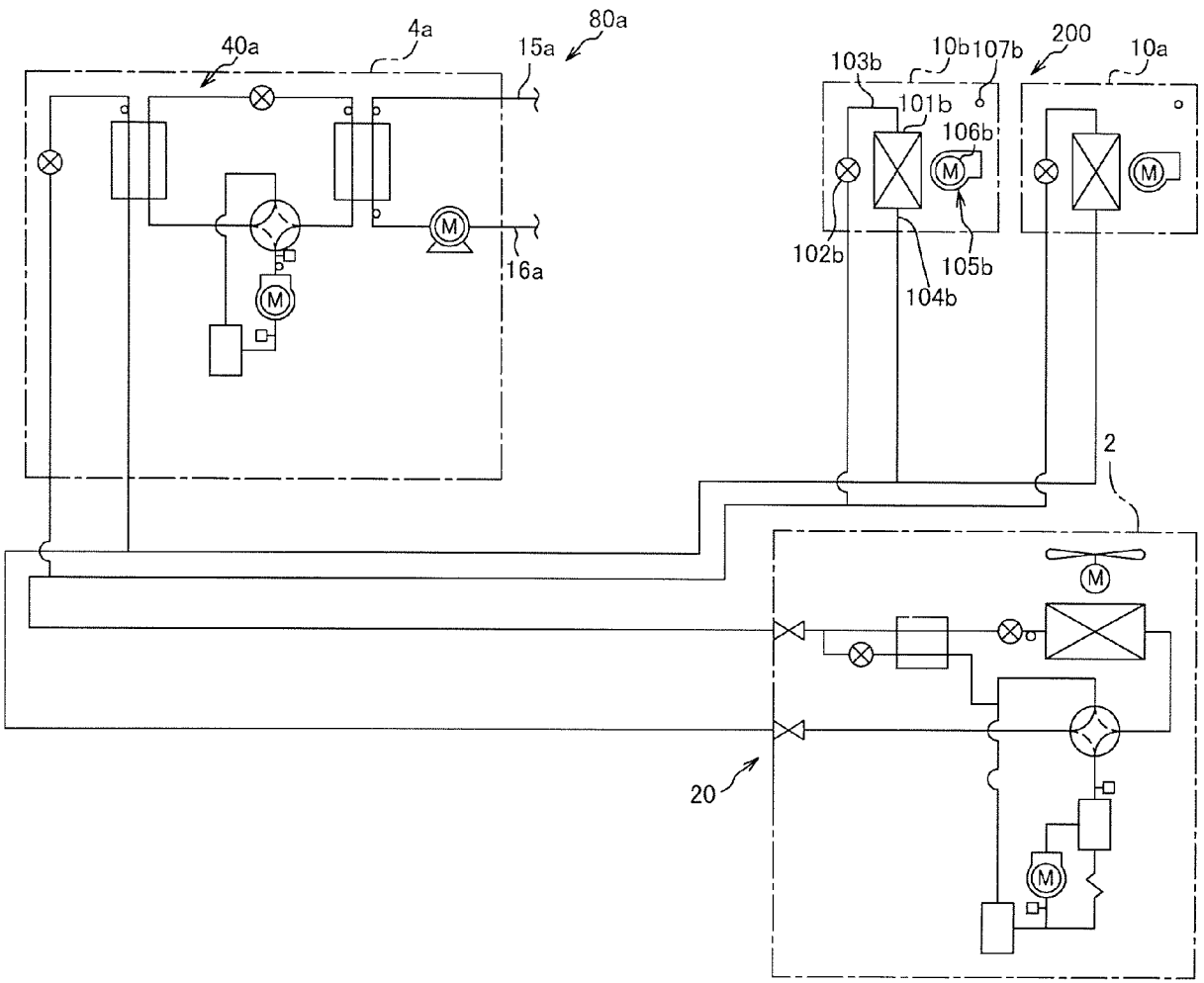
FIG. 9 is a schematic structural diagram of a heat pump system according to Modification 3 of the second embodiment.
Figure 10:
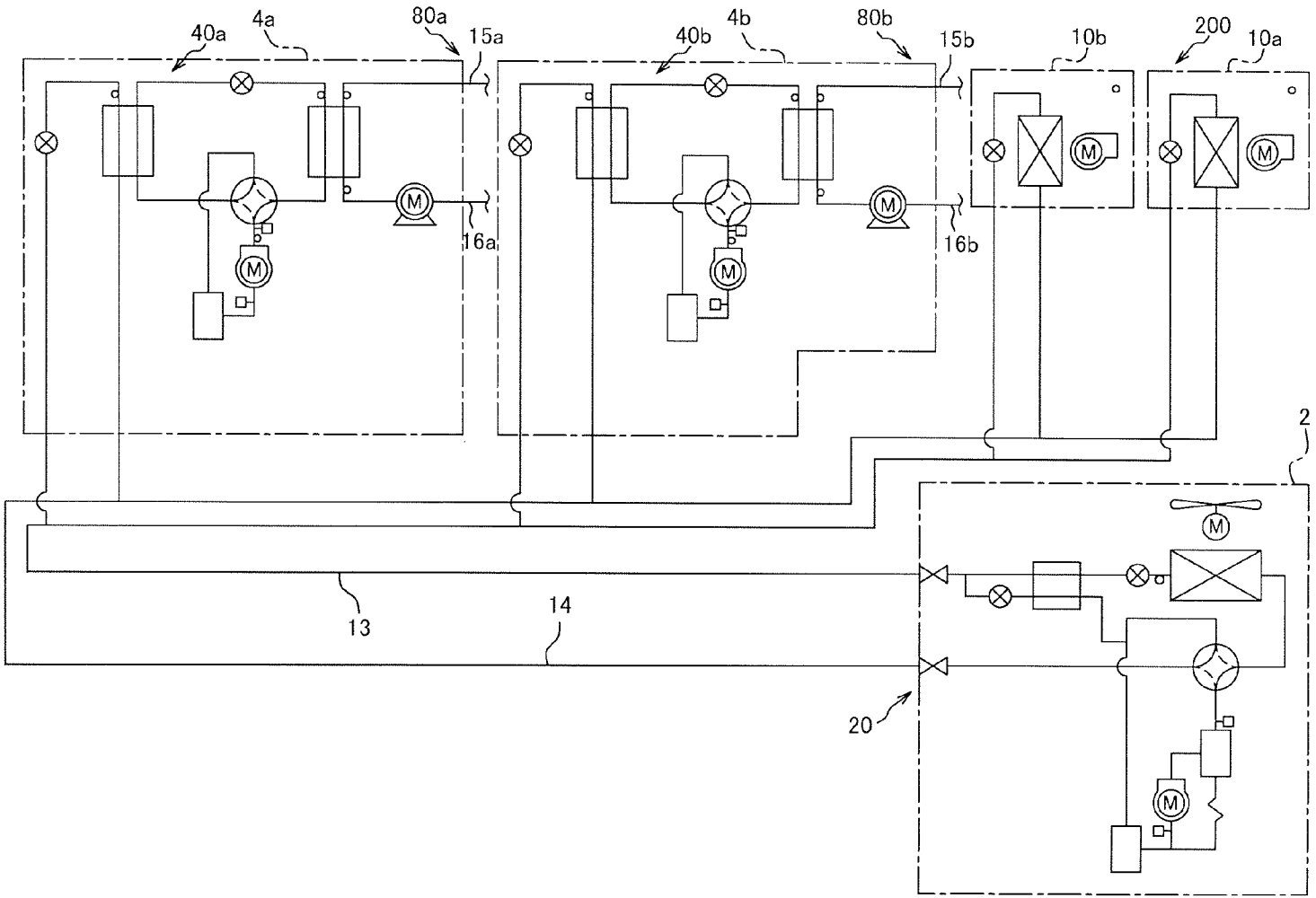
FIG. 10 is a schematic structural diagram of a heat pump system according to Modification 3 of the second embodiment.

In the heat pump systems 200 described above (see FIGS. 6 and 7), a single first usage unit 4*a* and a single second usage unit 10*a* are connected to the heat source unit 2 via the refrigerant communication tubes 13, 14, but a plurality of first usage units 4*a*, 4*b* (two, in this case) may be connected in parallel to each other via the refrigerant communication tubes 13, 14, and/or a plurality of second usage units 10*a*, 10*b* (two, in this case) may be connected in parallel to each other via the refrigerant communication tubes 13, 14, as shown in FIGS. 8 to 10 (in this case, the hot-water/air-warming unit, the hot-water storage unit, the aqueous medium circuits 80*a*, 80*b*, and the like are not shown). The configuration of the first usage unit 4*b* is the same as the configuration of the first usage unit 4*a* with the subscript "b" used in place of the subscript "a" of the reference numerals indicating each part of the first usage unit 4*a*, and a description of each part of the first usage unit 4*b* is therefore omitted. Also, the configuration of the second usage unit 10*b* is the same as the configuration of the second usage unit 10*a* with the subscript "b" used in place of the subscript "a" of the reference numerals indicating each part of the second usage unit 10*b*, and a description of each part is therefore omitted.

In these heat pump systems 200, it is possible to accommodate a plurality of locations and/or applications that require heating of the aqueous medium, and it is possible to accommodate a plurality of locations and/or applications that require cooling of the air medium.

(4) Modification 4

Figure 11:
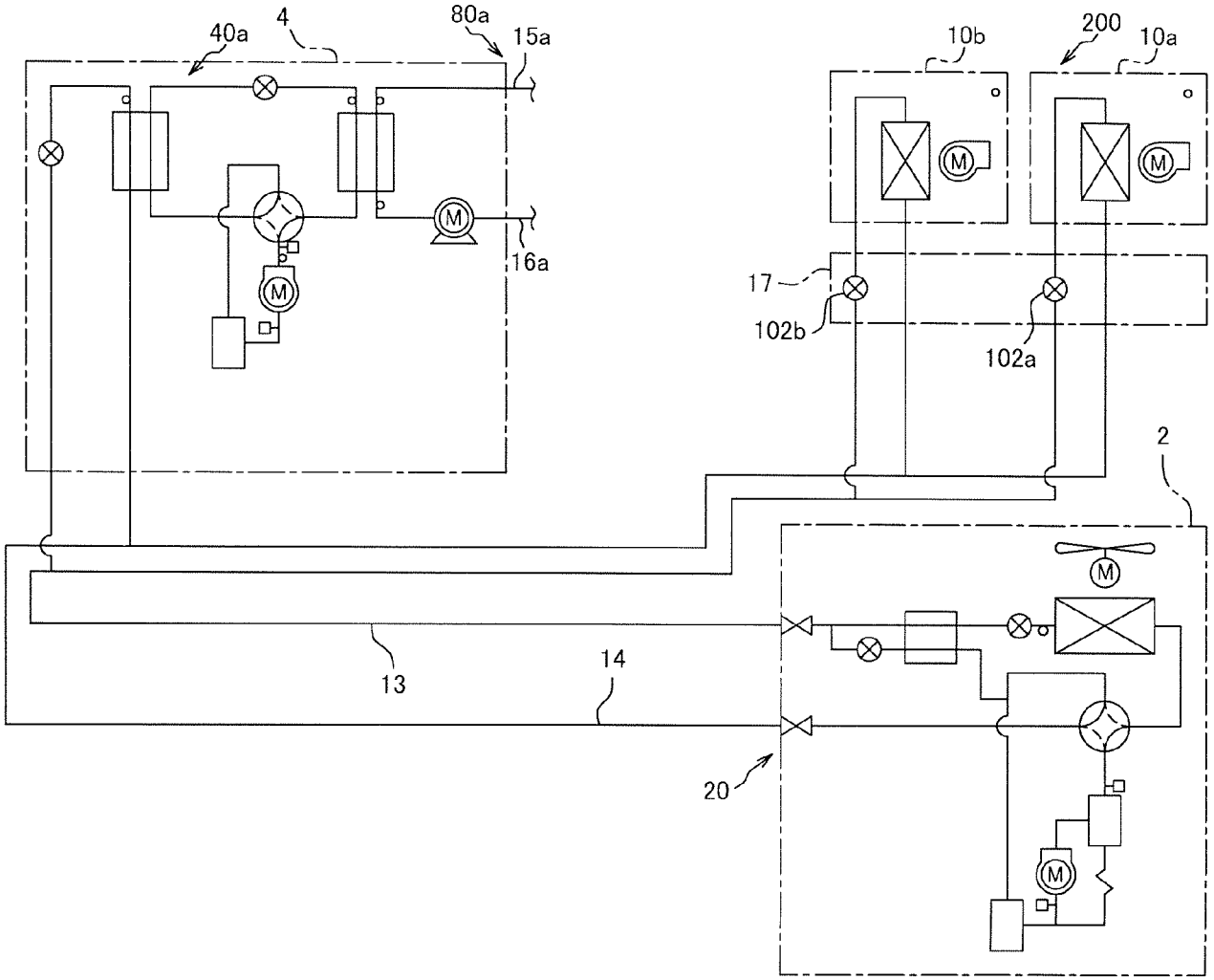
FIG. 11 is a schematic structural diagram of a heat pump system according to Modification 4 of the second embodiment.

In the heat pump systems 200 described above (see FIGS. 6 to 10), the second usage-side flow rate adjustment valves 102*a*, 102*b* are provided inside the second usage units 10*a*, 10*b*, but it is possible to omit the second usage-side flow rate adjustment valves 102*a*, 102*b* from the second usage units 10*a*, 10*b* and to provide an expansion valve unit 17 having the second usage-side flow rate adjustment valves 102*a*, 102*b*, as shown in FIG. 11 (in this case, the hot-water/air-warming unit, the hot-water storage unit, the aqueous medium circuit 80*a*, and the like are not shown).

(Third Embodiment)

In the heat pump systems 200 in the second embodiment and modifications thereof described above (see FIGS. 6 to 11), the air-cooling operation of the second usage unit 10*a* cannot be performed together with the hot-water supply operation of the first usage unit 4*a*. It is therefore preferred that such hot-water supply/air-cooling operation be possible because hot-water supply operation can be performed in an operation state in which the air-cooling operation is being performed during the summer season or the like.

Figure 12:
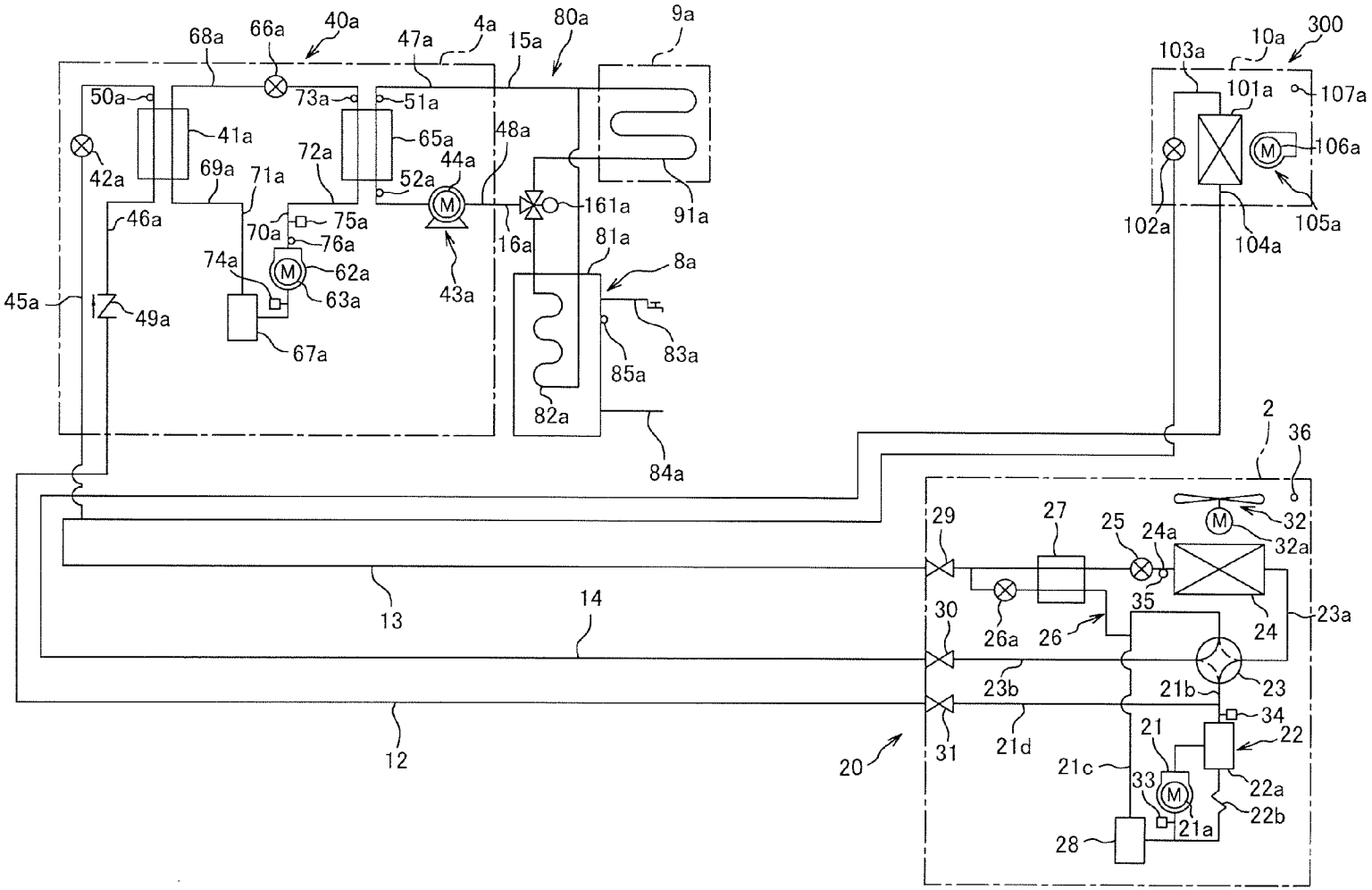
FIG. 12 is a schematic structural diagram of a heat pump system according to the third embodiment and Modification 1 of the third embodiment.

In view of the above, with a heat pump system 300, it is possible to perform hot-water supply and air-cooling operation in which the second usage-side heat exchanger 101*a* is made to function as an evaporator of the heat-source-side refrigerant to thereby cool an air medium, and the first usage-side heat exchanger 41*a* is made to function as a radiator of the heat-source-side refrigerant to thereby heat an aqueous medium, as shown in FIG. 12, in the configuration of the heat pump system 200 of the second embodiment described above (see FIG. 6). The configuration of the heat pump system 300 is described below.

<Configuration>

—Overall Configuration—

FIG. 12 is a view showing the general configuration of the heat pump system 300 according to a third embodiment of the present invention. The heat pump system 300 is an apparatus capable of performing operation for heating an aqueous medium and performing other operations using a vapor compression heat pump cycle.

The heat pump system 300 mainly has a heat source unit 2, a first usage unit 4*a*, a second usage unit 10*a*, a discharge refrigerant communication tube 12, a liquid-refrigerant communication tube 13, a gas-refrigerant communication tube 14, a hot-water storage unit 8*a*, a hot-water air-warming unit 9*a*, an aqueous medium communication tube 15*a*, and an aqueous medium communication tube 16*a*. The heat source unit 2, the first usage unit 4*a*, and the second usage unit 10*a* are connected via the refrigerant communication tubes 12, 13, 14 to thereby constitute a heat-source-side refrigerant circuit 20. The first usage unit 4*a* constitutes a usage-side refrigerant circuit 40*a*. The first usage unit 4*a*, the hot-water storage unit 8*a*, and the hot-water air-warming unit 9*a* are connected via the aqueous medium communication tubes 15*a*, 16*a* to thereby constitute an aqueous medium circuit 80*a*. HFC-410A, which is a type of HFC-based refrigerant, is enclosed inside the heat-source-side refrigerant circuit 20 as a heat-source-side refrigerant, and an ester-based or ether-based refrigeration machine oil having compatibility in relation to the HFC-based refrigerant is enclosed for lubrication of the heat-source-side compressor 21. HFC-134a, which is a type of HFC-based refrigerant, is enclosed inside the usage-side refrigerant circuit 40*a* as a usage-side refrigerant, and an ester-based or ether-based refrigeration machine oil having compatibility in relation to the HFC-based refrigerant is enclosed for lubrication of the usage-side compressor 62*a*. The usage-side refrigerant is preferably one in which the pressure that corresponds to a saturated gas temperature of 65° C. is a maximum gauge pressure of 2.8 MPa or less, and more preferably 2.0 MPa or less from the viewpoint of using a refrigerant that is advantageous for a high-temperature refrigeration cycle. The weight of the usage-side refrigerant enclosed in the usage-side refrigerant circuit 40*a* is one to three times the weight of the refrigeration machine oil enclosed in order to lubricate the usage-side compressor 62*a*. HFC-134a is a type of refrigerant having such saturation pressure characteristics. Water constituting the aqueous medium circulates in the aqueous medium circuit 80*a*.

In the description related to the configurations below, the same reference numerals will be used and a description omitted for the configuration of the second usage unit 10*a*, the hot-water storage unit 8*a*, the hot-water air-warming unit 9*a*, the liquid refrigerant communication tube 13, the gas-refrigerant communication tube 14, and the aqueous medium communication tubes 15*a*, 16*a*, all of which have the same configuration as those of heat pump system 200 in the second embodiment (see FIG. 6). Only the configuration of the heat source unit 2, the discharge refrigerant communication tube 12, and the first usage unit 4*a* will be described.

—Heat Source Unit—

The heat source unit 2 is disposed outdoors, and is connected to the usage units 4*a*, 10*a* via the refrigerant communication tubes 12, 13, 14 and constitutes a portion of the heat-source-side refrigerant circuit 20.

The heat source unit 2 has primarily a heat-source-side compressor 21, an oil separation mechanism 22, a heat-source-side switching mechanism 23, a heat-source-side heat exchanger 24, a heat-source-side expansion valve 25, an intake return tube 26, a subcooler 27, a heat-source-side accumulator 28, a liquid-side shutoff valve 29, a gas-side shutoff valve 30, and a discharge-side shutoff valve 31.

The discharge-side shutoff valve 31 is a valve provided at the connection between the discharge refrigerant communication tube 12 and a heat-source-side discharge branch tube 21*d* which is diverted from the heat-source-side discharge tube 21*b*, which connects the heat-source-side switching mechanism 23 and the discharge of the heat-source-side compressor 21.

The heat source unit 2 is the same as in the heat pump system 200 in the second embodiment (see FIG. 6), except for the configuration related to the discharge-side shutoff valve 31 and the heat-source-side discharge branching tube 21*d*, and the same reference numerals will be used and a description omitted.

—Discharge Refrigerant Communication Tube—

The discharge refrigerant communication tube 12 is connected to the heat-source-side discharge branch tube 21*d* via the discharge-side shutoff valve 31, and is a refrigerant tube capable of directing the heat-source-side refrigerant to the outside of the heat source unit 2 from the discharge of the heat-source-side compressor 21 in any of the heat-source-side radiating operation state and the heat-source-side evaporating operation state of the heat-source-side switching mechanism 23.

—First Usage Unit—

The first usage unit 4*a* is arranged indoors, is connected to the heat source unit 2 and the second usage unit 10*a* via the refrigerant communication tubes 12, 13, and constitutes a portion of the heat-source-side refrigerant circuit 20. The first usage unit 4*a* constitutes the usage-side refrigerant circuit 40*a*. The first usage unit 4*a* is connected to the hot-water storage unit 8*a* and the hot-water air-warming unit 9*a* via the aqueous medium communication tubes 15*a*, 16*a* and constitutes a portion of aqueous medium circuit 80*a*.

The first usage unit 4*a* mainly has the first usage-side heat exchanger 41*a*, the first usage-side flow rate adjustment valve 42*a*, the usage-side compressor 62*a*, the refrigerant/water heat exchanger 65*a*, a refrigerant/water heat exchange-side flow rate adjustment valve 66*a*, a usage-side accumulator 67*a*, and a circulation pump 43*a*.

A first usage-side discharge refrigerant tube 46*a*, to which the discharge refrigerant communication tube 12 is connected, is connected to the first usage-side heat exchanger 41*a* on the gas side of the channel through which the heat-source-side refrigerant flows in lieu of the first usage-side gas refrigerant tube 54*a* connected to the gas-refrigerant communication tube 14 as in the heat pump system 200 (see FIG. 6) in the second embodiment. The first usage-side discharge refrigerant tube 46*a* is provided with a first usage-side discharge non-return valve 49*a* for allowing the heat-source-side refrigerant to flow toward the first usage-side heat exchanger 41*a* from the discharge refrigerant communication tube 12 and preventing the heat-source-side refrigerant from flowing toward the discharge refrigerant communication tube 12 from the first usage-side heat exchanger 41*a*.

The usage unit 4*a* is the same as in the heat pump system 200 (FIG. 6) in the second embodiment, except for the configuration related to the first usage-side discharge refrigerant tube 46*a* connected in place of the first usage-side gas refrigerant tube 54*a*, and the same reference numerals will be used and a description omitted.

The heat pump system 300 is provided with a controller (not shown) for performing the operations and/or various types of control described below.

<Operation>

Next, the operation of the heat pump system 300 will be described.

The operation modes of the heat pump system 300 include a hot-water supply operation mode in which only the hot-water supply operation of the first usage unit 4*a* is performed (i.e., operation of the hot-water storage unit 8*a* and/or the hot-water air-warming unit 9*a*), an air-cooling operation mode in which only air-cooling operation of the second usage unit 10*a* is performed, an air-warming operation mode in which only air-warming operation of the second usage unit 10*a* is performed, a hot-water supply/air-warming operation mode in which hot-water supply operation of the first usage unit 4*a* is performed together with the air-warming operation of the second usage unit 10*a*, and a hot-water supply/air-cooling operation mode for performing the hot-water supply operation of the first usage unit 4*a* as well as the air-cooling operation of the second usage unit 10*a*.

The operation in the five operating modes of the heat pump system 300 will next be described.

—Hot-Water Supply Operation Mode—

In the case of performing only the hot-water supply operation of the first usage unit 4*a*, the heat-source-side switching mechanism 23 is switched to the heat-source-side evaporating operation state (indicated by broken line in the heat-source-side switching mechanism 23 in FIG. 12), and the intake return expansion valve 26*a* and the second usage-side flow rate adjustment valve 102*a* are closed in the heat-source-side refrigerant circuit 20. In the aqueous medium circuit 80*a*, the aqueous-medium-side switching mechanism 161*a* is switched to the state of feeding the aqueous medium to the hot-water storage unit 8*a* and/or the hot-water air-warming unit 9*a*.

In the heat-source-side refrigerant circuit 20 in such a state, the low-pressure, heat-source-side refrigerant in the refrigeration cycle is taken into the heat-source-side compressor 21 by way of the heat-source-side intake tube 21*c*, and is discharged to a heat-source-side discharge tube 21*b* after having been compressed to a high pressure in the refrigeration cycle. The high-pressure, heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* by way of the oil return tube 22*b*. The high-pressure, heat-source-side refrigerant from which the refrigeration machine oil has been separated out is sent from the heat source unit 2 to the discharge refrigerant communication tube 12 by way of the heat-source-side discharge branching tube 21*d* and a discharge-side shutoff valve 31.

The high-pressure, heat-source-side refrigerant sent to the discharge refrigerant communication tube 12 is sent to the first usage unit 4*a*. The high-pressure, heat-source-side refrigerant sent to the first usage unit 4*a* is sent to the first usage-side heat exchanger 41*a* via the first usage-side discharge refrigerant tube 46*a* and the first usage-side discharge non-return valve 49*a*. The high-pressure, heat-source-side refrigerant sent to the first usage-side heat exchanger 41*a* undergoes heat exchange with the low-pressure, usage-side refrigerant in the refrigeration cycle that is circulating through the usage-side refrigerant circuit 40*a* and releases heat in the first usage-side heat exchanger 41*a*. The high-pressure, heat-source-side refrigerant having released heat in the first usage-side heat exchanger 41*a* is sent from the first usage unit 4*a* to the liquid refrigerant communication tube 13 via the first usage-side flow rate adjustment valve 42*a* and the first usage-side liquid refrigerant tube 45*a*.

The heat-source-side refrigerant sent to the liquid refrigerant communication tube 13 is sent to the heat source unit 2. The heat-source-side refrigerant sent to the heat source unit 2 is sent to the subcooler 27 via a liquid-side shutoff valve 29. The heat-source-side refrigerant sent to the subcooler 27 does not undergo heat exchange and is sent to the heat-source-side expansion valve 25 because the heat-source-side refrigerant does not flow in the intake return tube 26. The heat-source-side refrigerant sent to the heat-source-side expansion valve 25 is depressurized in the heat-source-side expansion valve 25 to become a low-pressure gas-liquid two-phase state, and is then sent to the heat-source-side heat exchanger 24 by way of a heat-source-side liquid-refrigerant tube 24*a*. The low-pressure refrigerant sent to the heat-source-side heat exchanger 24 undergoes heat exchange with outdoor air fed by the heat-source-side fan 32 and is evaporated in the heat-source-side heat exchanger 24. The low-pressure, heat-source-side refrigerant evaporated in the heat-source-side heat exchanger 24 is sent to the heat-source-side accumulator 28 via the first heat-source-side gas-refrigerant tube 23*a* and the heat-source-side switching mechanism 23. The low-pressure, heat-source-side refrigerant sent to the heat-source-side accumulator 28 is again taken into the heat-source-side compressor 21 via the heat-source-side intake tube 21*c*.

In the usage-side refrigerant circuit 40*a*, the low-pressure, usage-side refrigerant in the refrigeration cycle that is circulating through the usage-side refrigerant circuit 40*a* is heated and evaporated by the radiation of the heat-source-side refrigerant in the first usage-side heat exchanger 41*a*. The low-pressure, usage-side refrigerant evaporated in the first usage-side heat exchanger 41*a* is sent to the usage-side accumulator 67*a* via the second cascade-side gas-refrigerant tube 69*a*. The low-pressure, usage-side refrigerant sent to the usage-side accumulator 67*a* is taken into the usage-side compressor 62*a* via the cascade-side intake tube 71*a*, is compressed to high pressure in the refrigeration cycle, and is thereafter discharged to the cascade-side discharge tube 70*a*. The high-pressure, usage-side refrigerant discharged to the cascade-side discharge tube 70*a* is sent to the refrigerant/water heat exchanger 65*a* via the first cascade-side gas-refrigerant tube 72*a*. The high-pressure, usage-side refrigerant sent to the refrigerant/water heat exchanger 65*a* undergoes heat exchange with the aqueous medium being circulated through the aqueous medium circuit 80*a* by the circulation pump 43*a* and releases heat in the refrigerant/water heat exchanger 65*a*. The high-pressure, usage-side refrigerant having released heat in the refrigerant/water heat exchanger 65*a* is depressurized in the refrigerant/water heat exchange-side flow rate adjustment valve 66*a* to become a low-pressure gas-liquid two-phase state, and is then sent again to the first usage-side heat exchanger 41*a* by way of the cascade-side liquid-refrigerant tube 68*a*.

In the aqueous medium circuit 80*a*, the aqueous medium circulating through the aqueous medium circuit 80*a* is heated by the radiation of the usage-side refrigerant in the refrigerant/water heat exchanger 65*a*. The aqueous medium heated in the refrigerant/water heat exchanger 65*a* is taken into the circulation pump 43*a* by way of the first usage-side water outlet tube 48*a* and pressurized, and is then sent from the first usage unit 4*a* to the aqueous medium communication tube 16*a*. The aqueous medium sent to the aqueous medium communication tube 16*a* is sent to the hot-water storage unit 8*a* and/or the hot-water air-warming unit 9*a* by way of the aqueous-medium-side switching mechanism 161*a*. The aqueous medium sent to the hot-water storage unit 8*a* undergoes heat exchange with the aqueous medium inside the hot-water storage tank 81*a* and releases heat in the heat exchange coil 82*a*, whereby the aqueous medium inside the hot-water storage tank 81*a* is heated. The aqueous medium sent to the hot-water air-warming unit 9*a* releases heat in the heat exchange panel 91*a*, whereby indoor walls or the like are heated and indoor floors are heated.

Operation in the hot-water supply operation mode for performing only hot-water supply operation of the first usage unit 4*a* is performed in this manner.

—Air-Cooling Operation Mode—

In the case of performing only the air-cooling operation of the second usage unit 10*a*, the heat-source-side switching mechanism 23 is switched to the heat-source-side radiating operation state (indicated by solid lines in the heat-source-side switching mechanism 23 in FIG. 12), and the first usage-side flow rate adjustment valve 42*a* is closed in the heat-source-side refrigerant circuit 20.

In the heat-source-side refrigerant circuit 20 in such a state, the low-pressure, heat-source-side refrigerant in the refrigeration cycle is taken into the heat-source-side compressor 21 via the heat-source-side intake tube 21*c*, and is discharged to the heat-source-side discharge tube 21*b* after having been compressed to high pressure in the refrigeration cycle. The high-pressure, heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* by way of the oil return tube 22*b*. The high-pressure, heat-source-side refrigerant from which the refrigeration machine oil has been separated out is sent to the heat-source-side heat exchanger 24 by way of the heat-source-side switching mechanism 23 and a first heat-source-side gas-refrigerant tube 23*a*. The high-pressure, heat-source-side refrigerant sent to the heat-source-side heat exchanger 24 undergoes heat exchange with outdoor air fed by a heat-source-side fan 32 and releases heat in the heat-source-side heat exchanger 24. The high-pressure, heat-source-side refrigerant having released heat in the heat-source-side heat exchanger is sent to the subcooler 27 via the heat-source-side expansion valve 25. The heat-source-side refrigerant sent to the subcooler 27 undergoes heat exchange with the heat-source-side refrigerant branched from the heat-source-side liquid-refrigerant tube 24*a* to the intake return tube 26 and is cooled to a subcooled state. The heat-source-side refrigerant that flows through the intake return tube 26 is returned to the heat-source-side intake tube 21*c*. The heat-source-side refrigerant cooled in the subcooler 27 is sent from the heat source unit 2 to the liquid refrigerant communication tube 13 by way of the heat-source-side liquid-refrigerant tube 24*a* and the liquid-side shutoff valve 29.

The high-pressure, heat-source-side refrigerant sent to the liquid refrigerant communication tube 13 is sent to the second usage unit 10*a*. The high-pressure, heat-source-side refrigerant sent to the second usage unit 10*a* is sent to the second usage-side flow rate adjustment valve 102*a*. The high-pressure, heat-source-side refrigerant sent to the second usage-side flow rate adjustment valve 102*a* is depressurized in the second usage-side flow rate adjustment valve 102*a* to become a low-pressure gas-liquid two-phase state, and is then sent to the second usage-side heat exchanger 101*a* by way of the second usage-side liquid refrigerant tube 103*a*. The low-pressure, heat-source-side refrigerant sent to the second usage-side heat exchanger 101*a* undergoes heat exchange with an air medium fed by the usage-side fan 105*a* and evaporates in the second usage-side heat exchanger 101*a* to thereby perform indoor air cooling. The low-pressure, heat-source-side refrigerant thus evaporated in the second usage-side heat exchanger 101*a* is sent from the second usage unit 10*a* to the gas refrigerant communication tube 14 by way of the second usage-side gas refrigerant tube 104*a*.

The low-pressure, heat-source-side refrigerant sent to the gas-refrigerant communication tube 14 is sent to the heat source unit 2. The low-pressure, heat-source-side refrigerant sent to the heat source unit 2 is sent to the heat-source-side accumulator 28 by way of the gas-side shutoff valve 30, the second heat-source-side gas refrigerant tube 23*b*, and the heat-source-side switching mechanism 23. The low-pressure, heat-source-side refrigerant sent to the heat-source-side accumulator 28 is again taken into the heat-source-side compressor 21 by way of the heat-source-side intake tube 21*c*.

Operation in the air-cooling operation mode for performing only air-cooling operation of the second usage unit 10*a* is performed in this manner.

—Air-Warming Operation Mode—

In the case of performing only the air-warming operation of the second usage unit 10*a*, the heat-source-side switching mechanism 23 is switched to the heat-source-side radiating operation state (indicated by broken lines in the heat-source-side switching mechanism 23 in FIG. 12), and the intake return expansion valve 26*a* and the first usage-side flow rate adjustment valve 42*a* are closed in the heat-source-side refrigerant circuit 20.

In the heat-source-side refrigerant circuit 20 in such a state, low-pressure, heat-source-side refrigerant in the refrigeration cycle is taken into the heat-source-side compressor 21 via the heat-source-side intake tube 21*c*, is compressed to a high pressure in the refrigeration cycle, and is thereafter discharged to the heat-source-side discharge tube 21*b*.

The refrigeration machine oil of the high-pressure, heat-source-side refrigerant discharged to the heat-source-side discharge tube 21*b* is separated out in the oil separator 22*a*. The refrigeration machine oil separated out from the heat-source-side refrigerant in the oil separator 22*a* is returned to the heat-source-side intake tube 21*c* by way of the oil return tube 22*b*. The high-pressure, heat-source-side refrigerant from which the refrigeration machine oil has been separated out is sent from the heat source unit 2 to the gas-refrigerant communication tube 14 by way of the heat-source-side switching mechanism 23, the second heat-source-side gas refrigerant tube 23*b*, and the gas-side shutoff valve 30.

The high-pressure, heat-source-side refrigerant sent to the gas-refrigerant communication tube 14 is sent to the second usage unit 10*a*. The high-pressure, heat-source-side refrigerant sent to the second usage unit 10*a* is sent to the second usage-side heat exchanger 101*a* by way of the second usage-side gas refrigerant tube 104*a*. The high-pressure, heat-source-side refrigerant sent to the second usage-side heat exchanger 101*a* undergoes heat exchange with an air medium fed by the usage-side fan 105*a* and releases heat in the second usage-side heat exchanger 101*a* to thereby perform indoor air warming. The high-pressure, heat-source-side refrigerant thus having released heat in the second usage-side heat exchanger 101*a* is sent from the second usage unit 10*a* to the liquid refrigerant communication tube 13 by way of the second usage-side flow rate adjustment valve 102*a* and the second usage-side liquid refrigerant tube 103*a*.

The heat-source-side refrigerant sent to the liquid-refrigerant communication tube 13 is sent to the heat source unit 2. The heat-source-side refrigerant sent to the heat source unit 2 is sent to the subcooler 27 by way of the liquid-side shutoff valve 29. The heat-source-side refrigerant sent to the subcooler 27 is sent to the heat-source-side expansion valve 25 without undergoing heat exchange because the heat-source-side refrigerant does not flow in the intake return tube 26. The heat-source-side refrigerant sent to the heat-source-side expansion valve 25 is depressurized in the heat-source-side expansion valve 25 to form a low-pressure, gas-liquid two-phase state, and is then sent to the heat-source-side heat exchanger 24 by way of the heat-source-side liquid-refrigerant tube 24*a*. The low-pressure, heat-source-side refrigerant sent to the heat-source-side heat exchanger 24 undergoes heat exchange with outdoor air fed by the heat-source-side fan 32 and is evaporated in the heat-source-side heat exchanger 24. The low-pressure, heat-source-side refrigerant evaporated in the heat-source-side heat exchanger 24 is sent to the heat-source-side accumulator 28 by way of the first heat-source-side gas-refrigerant tube 23*a* and the heat-source-side switching mechanism 23. The low-pressure, heat-source-side refrigerant sent to the heat-source-side accumulator 28 is again taken into the heat-source-side compressor 21 by way of the heat-source-side intake tube 21*c*.

Operation in the air-warming operation mode for performing only air-warming operation of the second usage unit 10*a* is performed in this manner.

—Hot-Water Supply/Air-Warming Operation Mode—

In the case of performing the hot-water supply operation of the first usage unit 4*a* as well as the air-warming operation of the second usage unit 10*a*, the heat-source-side switching mechanism 23 is switched to the heat-source-side evaporating operation state (indicated by broken lines in the heat-source-side switching mechanism 23 in FIG. 12), and the intake return expansion valve 26*a* is closed in the heat-source-side refrigerant circuit 20. In the aqueous medium circuit 80*a*, the aqueous-medium-side switching mechanism 161*a* is switched to a state in which the aqueous medium is fed to the hot-water storage unit 8*a* and/or the hot-water air-warming unit 9*a*.

In the heat-source-side refrigerant circuit 20 in such a state, the low-pressure, heat-source-side refrigerant in the refrigeration cycle is taken into the heat-source-side compressor 21 by way of the heat-source-side intake tube 21*c*, is compressed to high pressure in the refrigeration cycle, and is thereafter discharged to the heat-source-side discharge tube 21*b*. The high-pressure, heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* by way of the oil return tube 22*b*. A portion of the high-pressure, heat-source-side refrigerant from which the refrigeration machine oil has been separated out is sent from the heat source unit 2 to the discharge refrigerant communication tube 12 by way of the heat-source-side discharge branching tube 21*d* and a discharge-side shutoff valve 31, and the remainder is sent from the heat source unit 2 to the gas-refrigerant communication tube 14 by way of the heat-source-side switching mechanism 23, the second heat-source-side gas refrigerant tube 23*b* and the gas-side shutoff valve 30.

The high-pressure, heat-source-side refrigerant sent to the gas-refrigerant communication tube 14 is sent to the second usage unit 10*a*. The high-pressure, heat-source-side refrigerant sent to the second usage unit 10*a* is sent to the second usage-side heat exchanger 101*a* by way of the second usage-side gas refrigerant tube 104*a*. The high-pressure, heat-source-side refrigerant sent to the second usage-side heat exchanger 101*a* undergoes heat exchange with the air medium fed by the usage-side fan 105*a* to release heat in the second usage-side heat exchanger 101*a* and thereby perform indoor air warming. The high-pressure, heat-source-side refrigerant having released heat in the second usage-side heat exchanger 101*a* is sent from the second usage unit 10*a* to the liquid refrigerant communication tube 13 by way of the second usage-side flow rate adjustment valve 102*a* and the second usage-side liquid refrigerant tube 103*a*.

The high-pressure, heat-source-side refrigerant sent to the discharge refrigerant communication tube 12 is sent to the first usage unit 4*a*. The high-pressure, heat-source-side refrigerant sent to the first usage unit 4*a* is sent to the first usage-side heat exchanger 41*a* by way of the first usage-side discharge refrigerant tube 46*a* and the first usage-side discharge non-return valve 49*a*. The high-pressure, heat-source-side refrigerant sent to the first usage-side heat exchanger 41*a* undergoes heat exchange with the low-pressure, usage-side refrigerant in the refrigeration cycle that is circulating through the usage-side refrigerant circuit 40*a* and releases heat in the first usage-side heat exchanger 41*a*. The high-pressure, heat-source-side refrigerant having released heat in the first usage-side heat exchanger 41*a* is sent from the first usage unit 4*a* to the liquid refrigerant communication tube 13 by way of the first usage-side flow rate adjustment valve 42*a* and the first usage-side liquid refrigerant tube 45*a*.

The heat-source-side refrigerant sent from the second usage unit 10*a* and the first usage unit 4*a* to the liquid refrigerant communication tube 13 merges in the liquid refrigerant communication tube 13 and is sent to the heat source unit 2. The heat-source-side refrigerant sent to the heat source unit 2 is sent to the subcooler 27 by way of the liquid-side shutoff valve 29. The heat-source-side refrigerant sent to the subcooler 27 is sent to the heat-source-side expansion valve 25 without undergoing heat exchange because the heat-source-side refrigerant does not flow in the intake return tube 26. The heat-source-side refrigerant sent to the heat-source-side expansion valve 25 is depressurized in the heat-source-side expansion valve 25 to become a low-pressure gas-liquid two-phase state, and is then sent to the heat-source-side heat exchanger 24 by way of the heat-source-side liquid-refrigerant tube 24*a*. The low-pressure refrigerant sent to the heat-source-side heat exchanger 24 undergoes heat exchange with outdoor air fed by the heat-source-side fan 32 and evaporates in the heat-source-side heat exchanger 24. The low-pressure, heat-source-side refrigerant evaporated in the heat-source-side heat exchanger 24 is sent to the heat-source-side accumulator 28 by way of the first heat-source-side gas-refrigerant tube 23*a* and the heat-source-side switching mechanism 23. The low-pressure, heat-source-side refrigerant sent to the heat-source-side accumulator 28 is again taken into the heat-source-side compressor 21 by way of the heat-source-side intake tube 21*c*.

In the usage-side refrigerant circuit 40*a*, the low-pressure, usage-side refrigerant in the refrigeration cycle that is circulating through the usage-side refrigerant circuit 40*a* is heated and evaporated by the radiation of the heat-source-side refrigerant in the first usage-side heat exchanger 41*a*. The low-pressure, usage-side refrigerant evaporated in the first usage-side heat exchanger 41*a* is sent to the usage-side accumulator 67*a* via the second cascade-side gas-refrigerant tube 69*a*. The low-pressure, usage-side refrigerant sent to the usage-side accumulator 67*a* is taken into the usage-side compressor 62*a* by way of the cascade-side intake tube 71*a*, is compressed to high pressure in the refrigeration cycle, and is thereafter discharged to the cascade-side discharge tube 70*a*. The high-pressure, usage-side refrigerant discharged to the cascade-side discharge tube 70*a* is sent to the refrigerant/water heat exchanger 65*a* by way of the first cascade-side gas-refrigerant tube 72*a*. The high-pressure, usage-side refrigerant sent to the refrigerant/water heat exchanger 65*a* undergoes heat exchange with the aqueous medium being circulated through the aqueous medium circuit 80*a* by the circulation pump 43*a* and releases heat in the refrigerant/water heat exchanger 65*a*. The high-pressure, usage-side refrigerant having released heat in the refrigerant/water heat exchanger 65*a* is depressurized in the refrigerant/water heat exchange-side flow rate adjustment valve 66*a* to become a low-pressure gas-liquid two-phase state, and is then sent again to the first usage-side heat exchanger 41*a* by way of the cascade-side liquid-refrigerant tube 68*a*.

In the aqueous medium circuit 80*a*, the aqueous medium circulating through the aqueous medium circuit 80*a* is heated by the radiation of the usage-side refrigerant in the refrigerant/water heat exchanger 65*a*. The aqueous medium heated in the refrigerant/water heat exchanger 65*a* is taken into the circulation pump 43*a* by way of the first usage-side water outlet tube 48*a* and pressurized, and is then sent from the first usage unit 4*a* to the aqueous medium communication tube 16*a*. The aqueous medium sent to the aqueous medium communication tube 16*a* is sent to the hot-water storage unit 8*a* and/or the hot-water air-warming unit 9*a* by way of the aqueous-medium-side switching mechanism 161*a*. The aqueous medium sent to the hot-water storage unit 8*a* undergoes heat exchange with the aqueous medium inside the hot-water storage tank 81*a* and releases heat in the heat exchange coil 82*a*, whereby the aqueous medium inside the hot-water storage tank 81*a* is heated. The aqueous medium sent to the hot-water air-warming unit 9*a* releases heat in the heat exchange panel 91*a*, whereby indoor walls or the like are heated and indoor floors are heated.

Operation in the hot-water supply/air-warming operation mode for performing hot-water supply operation of the first usage unit 4*a* and air-warming operation of the second usage unit 10*a* are performed in this manner.

—Hot-Water Supply/Air-Cooling Operation Mode—

In the case of performing the hot-water supply operation of the first usage unit 4*a* as well as the air-cooling operation of the second usage unit 10*a*, the heat-source-side switching mechanism 23 is switched to the heat-source-side radiating operation state (indicated by solid lines in the heat-source-side switching mechanism 23 in FIG. 12) in the heat-source-side refrigerant circuit 20. In the aqueous medium circuit 80*a*, the aqueous-medium-side switching mechanism 161*a* is switched to a state in which the aqueous medium is fed to the hot-water storage unit 8*a*.

In the heat-source-side refrigerant circuit 20 in such a state, the low-pressure, heat-source-side refrigerant in the refrigeration cycle is taken into the heat-source-side compressor 21 by way of the heat-source-side intake tube 21*c*, is compressed to high pressure in the refrigeration cycle, and is thereafter discharged to the heat-source-side discharge tube 21*b*. The high-pressure, heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* by way of the oil return tube 22*b*. A portion of the high-pressure, heat-source-side refrigerant from which the refrigeration machine oil has been separated out is sent from the heat source unit 2 to the discharge refrigerant communication tube 12 by way of the heat-source-side discharge branching tube 21*d* and a discharge-side shutoff valve 31, and the remainder is sent to the heat-source-side heat exchanger 24 by way of the heat-source-side switching mechanism 23 and the first heat-source-side gas-refrigerant tube 23*a*. The high-pressure, heat-source-side refrigerant sent to the heat-source-side heat exchanger 24 undergoes heat exchange with outdoor air fed by the heat-source-side fan 32 and releases heat in the heat-source-side heat exchanger 24. The high-pressure, heat-source-side refrigerant having released heat in the heat-source-side heat exchanger is sent to the subcooler 27 by way of the heat-source-side expansion valve 25. The heat-source-side refrigerant sent to the subcooler 27 undergoes heat exchange with the heat-source-side refrigerant branched from the heat-source-side liquid-refrigerant tube 24*a* to the intake return tube 26 and is cooled to a subcooled state. The heat-source-side refrigerant that flows through the intake return tube 26 is returned to the heat-source-side intake tube 21*c*. The heat-source-side refrigerant cooled in the subcooler 27 is sent from the heat source unit 2 to the liquid refrigerant communication tube 13 by way of the heat-source-side liquid-refrigerant tube 24*a* and the liquid-side shutoff valve 29.

The high-pressure, heat-source-side refrigerant sent to the discharge refrigerant communication tube 12 is sent to the first usage unit 4*a*. The high-pressure, heat-source-side refrigerant sent to the first usage unit 4*a* is sent to the first usage-side heat exchanger 41*a* by way of the first usage-side discharge refrigerant tube 46*a* and the first usage-side discharge non-return valve 49*a*. The high-pressure, heat-source-side refrigerant sent to the first usage-side heat exchanger 41*a* undergoes heat exchange with the low-pressure, usage-side refrigerant in the refrigeration cycle that circulates through the usage-side refrigerant circuit 40*a* and releases heat in the first usage-side heat exchanger 41*a*. The high-pressure, heat-source-side refrigerant having released heat in the first usage-side heat exchanger 41*a* is sent from the first usage unit 4*a* to the liquid refrigerant communication tube 13 by way of the first usage-side flow rate adjustment valve 42*a* and the first usage-side liquid refrigerant tube 45*a*.

The heat-source-side refrigerant sent from the heat source unit 2 and the first usage unit 4*a* to the liquid refrigerant communication tube 13 merges in the liquid refrigerant communication tube 13 and is sent to the second usage unit 10*a*. The heat-source-side refrigerant sent to the second usage unit 10*a* is sent to the second usage-side flow rate adjustment valve 102*a*. The heat-source-side refrigerant sent to the second usage-side flow rate adjustment valve 102*a* is depressurized in the second usage-side flow rate adjustment valve 102*a* to become a low-pressure gas-liquid two-phase state, and is then sent to the second usage-side heat exchanger 101*a* by way of the second usage-side liquid refrigerant tube 103*a*. The low-pressure heat-source-side refrigerant sent to the second usage-side heat exchanger 101*a* undergoes heat exchange with the air medium fed by the usage-side fan 105*a* and evaporates in the second usage-side heat exchanger 101*a* to thereby perform indoor air cooling. The low-pressure, heat-source-side refrigerant evaporated in the second usage-side heat exchanger 101*a* is sent from the second usage unit 10*a* to the gas-refrigerant communication tube 14 by way of the second usage-side gas refrigerant tube 104*a*.

The low-pressure, heat-source-side refrigerant sent to the gas-refrigerant communication tube 14 is sent to the heat source unit 2. The low-pressure, heat-source-side refrigerant sent to the heat source unit 2 is sent to the heat-source-side accumulator 28 by way of the gas-side shutoff valve 30, the second heat-source-side gas refrigerant tube 23*b*, and the heat-source-side switching mechanism 23. The low-pressure, heat-source-side refrigerant sent to the heat-source-side accumulator 28 is again taken into the heat-source-side compressor 21 by way of the heat-source-side intake tube 21*c*.

In the usage-side refrigerant circuit 40*a*, the low-pressure, usage-side refrigerant in the refrigeration cycle that is circulating through the usage-side refrigerant circuit 40*a* is heated and evaporated by the radiation of the heat-source-side refrigerant in the first usage-side heat exchanger 41*a*. The low-pressure, usage-side refrigerant evaporated in the first usage-side heat exchanger 41*a* is sent to the usage-side accumulator 67*a* by way of the second cascade-side gas-refrigerant tube

69*a*. The low-pressure, usage-side refrigerant sent to the usage-side accumulator 67*a* is taken into the usage-side compressor 62*a* by way of the cascade-side intake tube 71*a*, is compressed to high pressure in the refrigeration cycle, and is thereafter discharged to the cascade-side discharge tube 70*a*. The high-pressure, usage-side refrigerant discharged to the cascade-side discharge tube 70*a* is sent to the refrigerant/water heat exchanger 65*a* by way of the first cascade-side gas-refrigerant tube 72*a*. The high-pressure, usage-side refrigerant sent to the refrigerant/water heat exchanger 65*a* undergoes heat exchange with the aqueous medium being circulated through the aqueous medium circuit 80*a* by the circulation pump 43*a* and releases heat in the refrigerant/water heat exchanger 65*a*. The high-pressure, usage-side refrigerant having released heat in the refrigerant/water heat exchanger 65*a* is depressurized in the refrigerant/water heat exchange-side flow rate adjustment valve 66*a* to become a low-pressure gas-liquid two-phase state, and is then sent again to the first usage-side heat exchanger 41*a* by way of the cascade-side liquid-refrigerant tube 68*a*.

In the aqueous medium circuit 80*a*, the aqueous medium circulating through the aqueous medium circuit 80*a* is heated by the radiation of the usage-side refrigerant in the refrigerant/water heat exchanger 65*a*. The aqueous medium heated in the refrigerant/water heat exchanger 65*a* is taken into the circulation pump 43*a* by way of the first usage-side water outlet tube 48*a* and pressurized, and is then sent from the first usage unit 4*a* to the aqueous medium communication tube 16*a*. The aqueous medium sent to the aqueous medium communication tube 16*a* is sent to the hot-water storage unit 8*a* by way of the aqueous-medium-side switching mechanism 161*a*. The aqueous medium sent to the hot-water storage unit 8*a* undergoes heat exchange with the aqueous medium inside the hot-water storage tank 81*a* and releases heat in the heat exchange coil 82*a*, whereby the aqueous medium inside the hot-water storage tank 81*a* is heated.

Operation in the hot-water supply/air-cooling operation mode for performing hot-water supply operation of the first usage unit 4*a* and air-cooling operation of the second usage unit 10*a* are performed in this manner.

In the configuration of the heat pump system 300, in which the first usage unit 4*a* for the hot-water-supply operation and the second usage unit 10*a* for the air-cooling and air-warming operations are connected to the heat source unit 2 so as to enable the hot-water-supply/air-cooling operation, discharge saturation temperature control of the refrigerant circuits 20, 40*a* and subcooling degree control of the outlets of the heat exchangers 41*a*, 65*a* are performed, similar to the heat pump system 200 in the second embodiment (see FIG. 6).

It is thereby possible in this heat pump system 300, not only to obtain the same operational effects as the heat pump system 200 in the second embodiment, but also to perform an operation of heating the aqueous medium by the first usage-side heat exchanger 41*a* and the usage-side refrigerant circuit 40*a* and to use the heat of cooling of the heat-source-side refrigerant resulting from heating the aqueous medium in an operation of cooling the air medium by evaporation of the heat-source-side refrigerant in the second usage-side heat exchanger 101*a*. Therefore, the heat of cooling of the heat-source-side refrigerant resulting from heating the aqueous medium can be effectively used, such as in using the aqueous medium heated by the first usage-side heat exchanger 41*a* and the usage-side refrigerant circuit 40*a* for a hot water supply and using the air medium cooled in the second usage-side heat exchanger 101*a* for air-cooling of the room interior, for example, and energy can thereby be conserved.

(1) Modification 1

Even in a configuration such as that of the above-described heat pump system 300 (see FIG. 12), wherein the first usage unit 4*a* for the hot-water-supply operation and the second usage unit 10*a* for the air-cooling and air-warming operations are connected to the heat source unit 2 so as to enable the hot-water-supply/air-cooling operation, since an oil separation mechanism is not provided to the discharge of the usage-side compressor 62*a*, refrigeration machine oil is readily led with the usage-side refrigerant into the refrigerant-water heat exchanger 65*a* functioning as a radiator of the usage-side refrigerant, and under high-temperature conditions, biphasic separation of the liquid usage-side refrigerant and the refrigeration machine oil occurs readily in the refrigerant-water heat exchanger 65*a*, and refrigeration machine oil therefore readily backs up within the refrigerant-water heat exchanger 65*a* functioning as a radiator of the usage-side refrigerant, similar to the heat pump system 200 (see FIG. 6) in Modification 1 of the second embodiment. When subcooling degree control of the outlet of the refrigerant-water heat exchanger 65*a* is performed, the liquid usage-side refrigerant accumulates in the refrigerant-water heat exchanger 65*a* in an amount corresponding to the usage-side refrigerant degree of subcooling SC2, therefore making biphasic separation of the liquid usage-side refrigerant and the refrigeration machine oil occur even more readily.

In view of this, the same oil recovery operation control (see FIG. 2) as in the heat pump system 200 in the second embodiment (see FIG. 6) is performed in this heat pump system 300 as well.

It is thereby possible to ensure that there will be no insufficiency of refrigeration machine oil in the usage-side compressor 62*a*. During the oil recovery operation, the operation of making the refrigerant-water heat exchanger 65*a* function as a radiator of usage-side refrigerant and heating the aqueous medium can be continued, and the adverse effect that the oil recovery operation has on the hot-water-supply operation, the hot-water-supply/air-warming operation, and the hot-water-supply/air-cooling operation can thereby be reduced as much as possible.

(2) Modification 2

Figure 13:
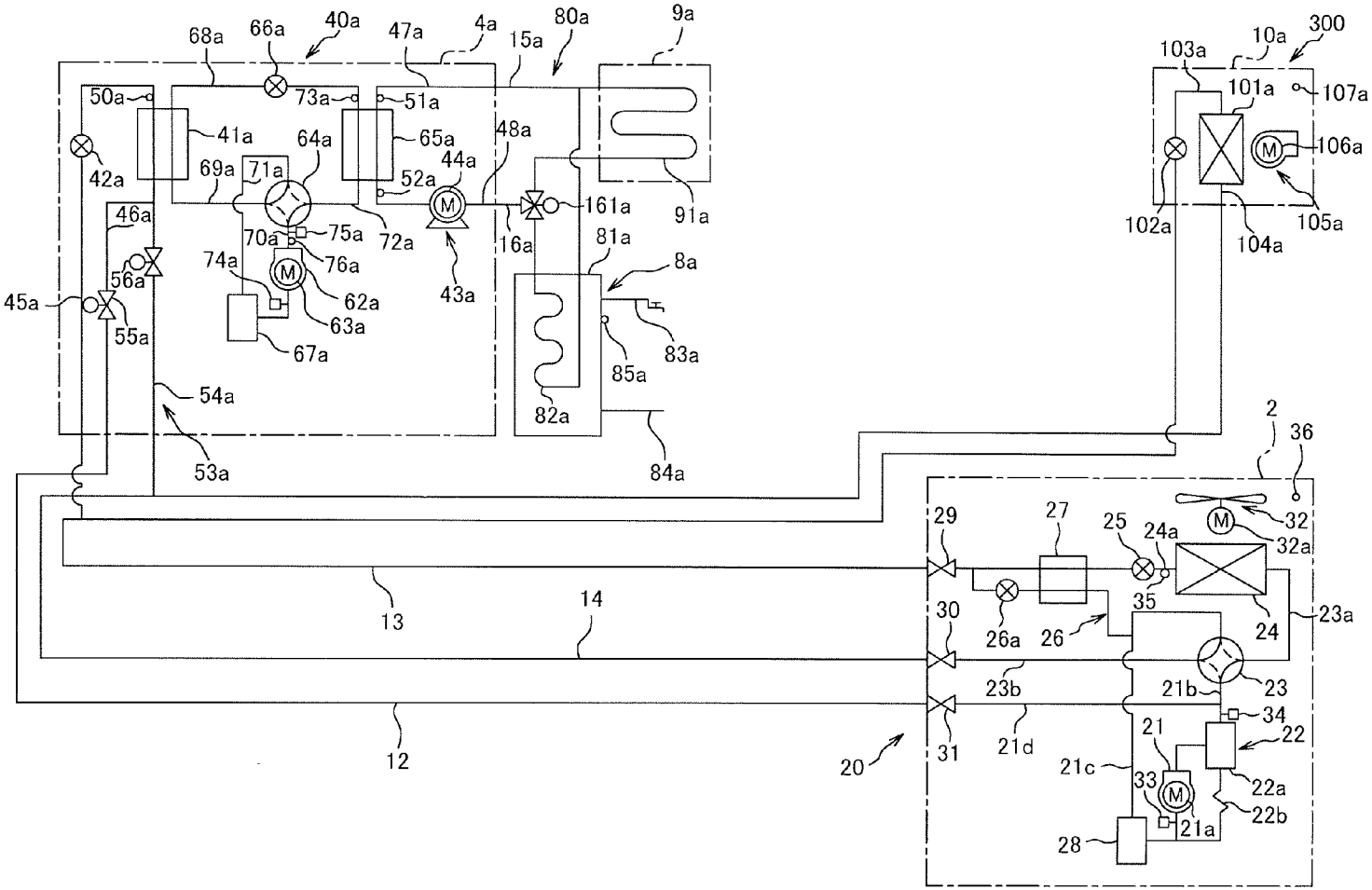
FIG. 13 is a schematic structural diagram of a heat pump system according to Modification 2 of the third embodiment.

In the heat pump system 300 (see FIG. 12) described above, as shown in FIG. 13, it is possible to furthermore provide the usage-side refrigerant circuit 40*a* with a first usage-side switching mechanism 64*a* (the same as the first usage-side switching mechanism 64*a* provided to the heat pump system 200 in the second embodiment) capable of switching between a usage-side radiating operation state in which the refrigerant/water heat exchanger 65*a* is made to function as a radiator of the usage-side refrigerant and the first usage-side heat exchanger 41*a* is made to function as an evaporator of the usage-side refrigerant, and a usage-side evaporating operation state in which the refrigerant/water heat exchanger 65*a* is made to function as an evaporator of the usage-side refrigerant and the first usage-side heat exchanger 41*a* is made to function as a radiator of the usage-side refrigerant; and it is possible to further connect the first usage unit 4*a* to the gas-refrigerant communication tube 14 and to further provide a second usage-side switching mechanism 53*a* capable of switching between an aqueous medium-heating operation state in which the first usage-side heat exchanger 41*a* is made to function as a radiator of the heat-source-side refrigerant introduced from the discharge refrigerant communication tube 12, and an aqueous medium-cooling operation state in which the first usage-side heat exchanger 41*a* is made to function as an evaporator of the heat-source-side refrigerant introduced from the liquid refrigerant communication tube 13.

Here, the first usage-side gas refrigerant tube 54*a* is connected together with the first usage-side discharge refrigerant tube 46*a* to the gas side of the channel through which the heat-source-side refrigerant of the first usage-side heat exchanger 41*a* flows. The gas-refrigerant communication tube 14 is connected to the first usage-side gas refrigerant tube 54*a*. The second usage-side switching mechanism 53*a* has a first usage-side discharge on-off valve 55*a* (in this case, the first usage-side discharge non-return valve 49*a* is omitted) provided to the first usage-side discharge refrigerant tube 46*a*, and a first usage-side gas on-off valve 56*a* provided to the first usage-side gas refrigerant tube 54*a*; and is used for setting an aqueous medium-heating operation state by opening the first usage-side discharge on-off valve 55*a* and closing the first usage-side gas on-off valve 56*a*, and setting an aqueous medium-cooling operation state by closing the first usage-side discharge on-off valve 55*a* and opening the first usage-side gas on-off valve 56*a*. The first usage-side discharge on-off valve 55*a* and the first usage-side gas on-off valve 56*a* are composed of solenoid valves, both being capable of on-off control. The second usage-side switching mechanism 53*a* may be configured using a three-way valve or the like.

With the heat pump system 300 having such a configuration, in the case that defrosting of the heat-source-side heat exchanger 24 has been determined to be required, depending on operation in the hot-water supply operation mode, the air-warming operation mode, and the hot-water supply/air-warming operation mode, it is possible to perform a defrosting operation in which the heat-source-side heat exchanger 24 is made to function as a radiator of the heat-source-side refrigerant by setting the heat-source-side switching mechanism 23 in a heat-source-side radiating operation state; the second usage-side heat exchanger 101*a* is made to function as an evaporator of the heat-source-side refrigerant and the refrigerant/water heat exchanger 65*a* is made to function as an evaporator of the usage-side refrigerant by setting the first usage-side switching mechanism 64*a* in a usage-side evaporating operation state; and the first usage-side heat exchanger 41*a* is made to function as a radiator of the usage-side refrigerant.

Operation in the defrosting operation is described below with reference to FIG. 4.

First, it is determined whether predetermined defrosting operation start conditions have been satisfied (i.e., whether defrosting of the heat-source-side heat exchanger 24 is required) (step S11). Here, it is determined whether the defrosting operation start conditions have been satisfied on the basis of whether the defrosting time interval Δtdf (i.e., the cumulative operation time from the end of the previous defrosting operation) has reached the predetermined defrosting time interval setting value Δtdfs.

The process starts the defrosting operation below in the case that it has been determined that the defrosting operation start conditions have been satisfied (step S12).

Figure 14:
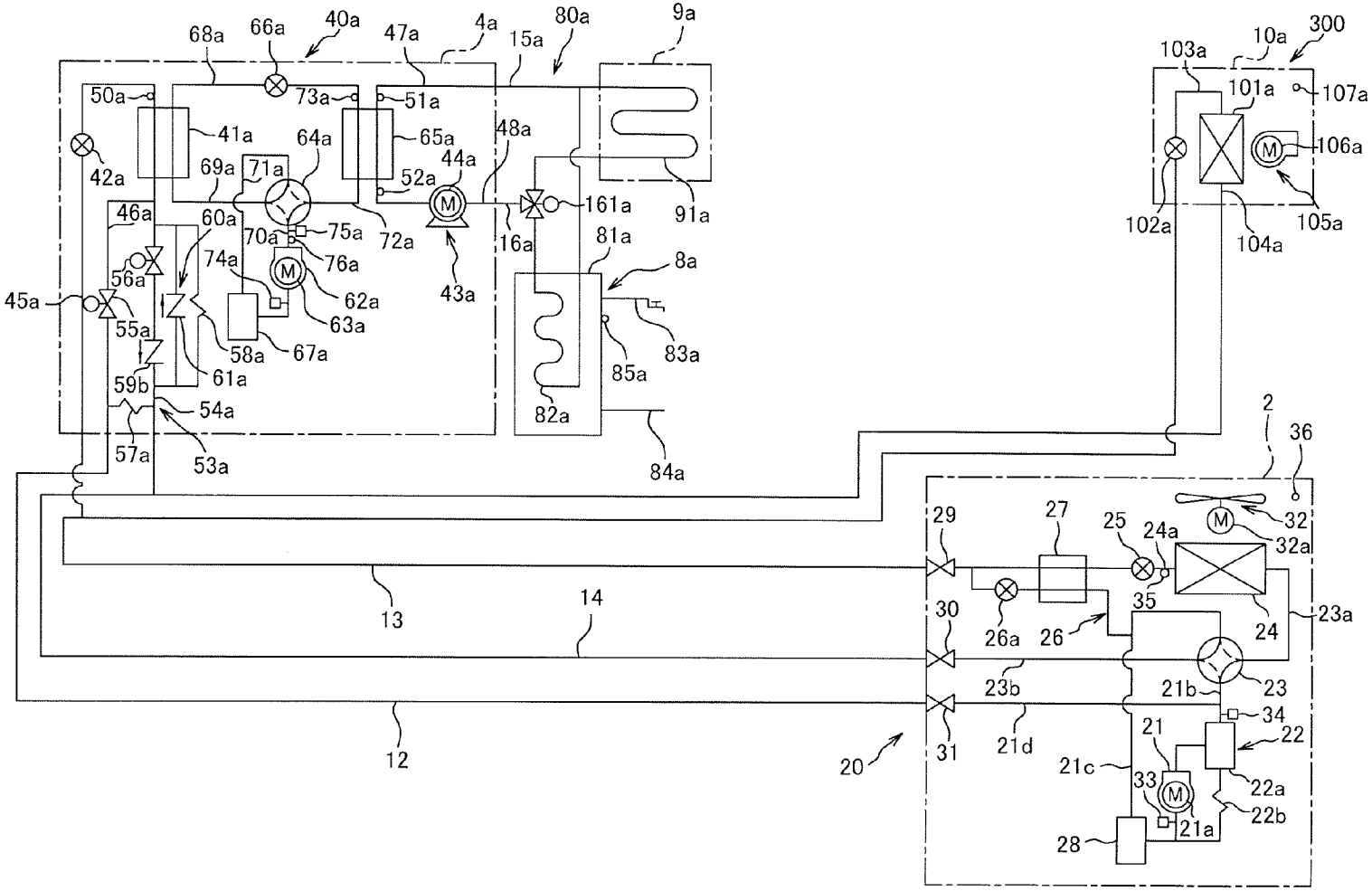
FIG. 14 is a schematic structural diagram of a heat pump system according to Modification 3 of the third embodiment.

When the defrosting operation is started, a switch is made in the heat-source-side refrigerant circuit 20 to switch the heat-source-side switching mechanism 23 to the heat-source-side radiating operation state (the state indicated by the solid lines of heat-source-side switching mechanism 23 of FIG. 14), a switch is made in the usage-side refrigerant circuit 40*a* to switch the first usage-side switching mechanism 64*a* to the usage-side evaporating operation state (the state indicated by the broken lines of first usage-side switching mechanism 64*a* in FIG. 14), the second usage-side switching mechanism 53*a* is switched to the aqueous medium-cooling operation state (i.e., the state in which the first usage-side discharge on-off value 55*a* is closed and the first usage-side gas on-off valve 56*a* is open), and the intake-return expansion valve 26*a* is set in a closed state.

In the heat-source-side refrigerant circuit 20 in such a state, the low-pressure heat-source-side refrigerant in the refrigeration cycle is taken into the heat-source-side compressor 21 by way of the heat-source-side intake tube 21*c*, compressed to high pressure in the refrigeration cycle, and thereafter discharged to the heat-source-side discharge tube 21*b*. The high-pressure heat-source-side refrigerant discharged to the heat-source-side discharge tube 21*b* has the refrigeration machine oil separated out in the oil separator 22*a*. The refrigeration machine oil separated out from the heat-source-side refrigerant in the oil separator 22*a* is returned to the heat-source-side intake tube 21*c* by way of the oil return tube 22*b*. The high-pressure, heat-source-side refrigerant from which the refrigeration machine oil has been separated out is sent to the heat-source-side heat exchanger 24 by way of the heat-source-side switching mechanism 23 and the first heat-source-side gas-refrigerant tube 23*a*. The high-pressure, heat-source-side refrigerant sent to the heat-source-side heat exchanger 24 undergoes heat exchange with ice deposited in the heat-source-side heat exchanger 24 and heat is released in the heat-source-side heat exchanger 24. The high-pressure, heat-source-side refrigerant having released heat in the heat-source-side heat exchanger is sent to the subcooler 27 by way of the heat-source-side expansion valve 25. The heat-source-side refrigerant sent to the subcooler 27 is sent from the heat source unit 2 to the liquid refrigerant communication tube 13 by way of the heat-source-side liquid-refrigerant tube 24*a* and the liquid-side shutoff valve 29 without undergoing heat exchange because the heat-source-side refrigerant does not flow in the intake return tube 26.

The heat-source-side refrigerant sent to the liquid refrigerant communication tube 13 branches in the liquid refrigerant communication tube 13 and is sent to the first usage unit 4*a* and the second usage unit 10*a*.

The heat-source-side refrigerant sent to the second usage unit 10*a* is sent to the second usage-side flow rate adjustment valve 102*a*. The heat-source-side refrigerant sent to the second usage-side flow rate adjustment valve 102*a* is depressurized in the second usage-side flow rate adjustment valve 102*a* to become a low-pressure gas-liquid two-phase state, and is then sent to the second usage-side heat exchanger 101*a* by way of the second usage-side liquid refrigerant tube 103*a*. The low-pressure, heat-source-side refrigerant sent to the second usage-side heat exchanger 101*a* undergoes heat exchange with an air medium fed by the usage-side fan 105*a* and evaporates in the second usage-side heat exchanger 101*a*. The low-pressure, heat-source-side refrigerant thus evaporated in the second usage-side heat exchanger 101*a* is sent from the second usage unit 10*a* to the gas refrigerant communication tube 14 by way of the second usage-side gas refrigerant tube 104*a*.

The heat-source-side refrigerant sent to the first usage unit 4*a* is sent to the first usage-side flow rate adjustment valve 42*a*. The heat-source-side refrigerant sent to the first usage-side flow rate adjustment valve 42*a* is depressurized in the first usage-side flow rate adjustment valve 42*a* to become a low-pressure gas-liquid two-phase state, and is then sent to the first usage-side heat exchanger 41*a* by way of the first usage-side liquid refrigerant tube 45*a*. The low-pressure, heat-source-side refrigerant sent to the first usage-side heat exchanger 41*a* undergoes heat exchange with the high-pressure usage-side refrigerant in the refrigeration cycle that is circulated through the usage-side refrigerant circuit 40*a* and evaporates in the first usage-side heat exchanger 41*a*. The low-pressure, heat-source-side refrigerant thus evaporated in the first usage-side heat exchanger 41*a* is sent from the first usage unit 4*a* to the gas refrigerant communication tube 14 by way of the first usage-side gas refrigerant tube 54*a* and the first usage-side gas on-off valve 56*a* constituting the first usage-side switching mechanism 53*a*.

The heat-source-side refrigerant sent from the second usage unit 10*a* and the first usage unit 4*a* to the gas refrigerant communication tube 14 merges in the gas refrigerant communication tube 14 and is sent to the heat source unit 2. The low-pressure, heat-source-side refrigerant sent to the heat source unit 2 is sent to the heat-source-side accumulator 28 by way of the gas-side shutoff valve 30, the second heat-source-side gas refrigerant tube 23*b*, and the heat-source-side switching mechanism 23. The low-pressure, heat-source-side refrigerant sent to the heat-source-side accumulator 28 is again taken into the heat-source-side compressor 21 by way of the heat-source-side intake tube 21*c*.

The high-pressure, usage-side refrigerant in the refrigeration cycle that circulates through the usage-side refrigerant circuit 40*a* releases heat in the usage-side refrigerant circuit 40*a* by the evaporation of the heat-source-side refrigerant in the first usage-side heat exchanger 41*a*. The high-pressure, usage-side refrigerant having released heat in the first usage-side heat exchanger 41*a* is sent to the refrigerant/water heat exchange-side flow rate adjustment valve 66*a*. The high-pressure, usage-side refrigerant sent to the refrigerant/water heat exchange-side flow rate adjustment valve 66*a* is depressurized in the refrigerant/water heat exchange-side flow rate adjustment valve 66*a* to become a low-pressure gas-liquid two-phase state, and is then sent to the refrigerant/water heat exchanger 65*a* by way of the cascade-side liquid-refrigerant tube 68*a*. The low-pressure, usage-side refrigerant sent to the refrigerant/water heat exchanger 65*a* undergoes heat exchange with the aqueous medium circulated through the aqueous medium circuit 80*a* by the circulation pump 43*a* and evaporates in the refrigerant/water heat exchanger 65*a*. The low-pressure, usage-side refrigerant thus evaporated in the refrigerant/water heat exchanger 65*a* is sent to the usage-side accumulator 67*a* by way of the first cascade-side gas-refrigerant tube 72*a* and the second usage-side switching mechanism 64*a*. The low-pressure, usage-side refrigerant sent to the usage-side accumulator 67*a* is taken into the usage-side compressor 62*a* by way of the cascade-side intake tube 71*a*, compressed to high pressure in the refrigeration cycle, and thereafter discharged to the cascade-side discharge tube 70*a*. The high-pressure, usage-side refrigerant discharged to the cascade-side discharge tube 70*a* is again sent to the first usage-side heat exchanger 41*a* by way of the second usage-side switching mechanism 64*a* and the second cascade-side gas-refrigerant tube 69*a*.

In this manner, the defrosting operation is started in which the heat-source-side heat exchanger 24 is made to function as a radiator of the heat-source-side refrigerant by setting the heat-source-side switching mechanism 23 in the heat-source-side heat-release operation state; the second usage-side heat exchanger 101*a* is made to function as an evaporator of the heat-source-side refrigerant and the refrigerant/water heat exchanger 65*a* is made to function as an evaporator of the usage-side refrigerant by setting the second usage-side switching mechanism 64*a* in a usage-side evaporating operation state; and the first usage-side heat exchanger 41*a* is made to function as a radiator of the usage-side refrigerant (i.e., as an evaporator of the heat-source-side refrigerant).

It is determined whether predetermined defrosting operation end conditions have been satisfied (i.e., whether defrosting of the heat-source-side heat exchanger 24 has ended; step S13). Here, it is determined whether the defrosting operation end conditions have been satisfied depending on whether the heat-source-side heat exchanger temperature Thx has reached the predetermined defrosting completion temperature Thxs, or whether the defrosting operation time tdf, which is the time elapsed from the start of the defrosting operation, has reached a predetermined defrosting operation setting time tdfs.

In the case that it has been determined that the defrosting operation end conditions have been satisfied, the defrosting operation is ended and the process returns to the hot-water supply operation mode, the air-warming operation mode, and/or the hot-water supply/air-warming operation mode (step S14).

With the heat pump system 300, when the heat-source-side heat exchanger 24 is to be defrosted, not only is the heat-source-side switching mechanism 23 set in the heat-source-side radiating operation state to thereby cause the heat-source-side heat exchanger 24 to function as a radiator of the heat-source-side refrigerant, but also the first usage-side switching mechanism 64*a* is set in the usage-side evaporating operation state to thereby cause the refrigerant/water heat exchanger 65*a* to function as an evaporator of the usage-side refrigerant and cause the first usage-side heat exchanger 41*a* to function as a radiator of the usage-side refrigerant. Therefore, the heat-source-side refrigerant cooled by releasing heat in the heat-source-side heat exchanger 24 is heated by the heat released by the usage-side refrigerant in the first usage-side heat exchanger 41*a*, and the usage-side refrigerant cooled by releasing heat in the first usage-side heat exchanger 41*a* can be heated by evaporation in the refrigerant/water heat exchanger 65*a*, whereby the defrosting of the heat-source-side heat exchanger 24 can be reliably performed. Also, since the second usage-side heat exchanger 101*a* is also made to function as an evaporator of the heat-source-side refrigerant, the defrosting operation time tdf can be reduced and it is possible to inhibit a reduction in the temperature of the air medium cooled in the second usage unit 10*a*.

In the heat pump system 300 having such a configuration, when the oil recovery operation becomes necessary in the hot-water-supply operation mode, the hot-water-supply/air-warming operation mode, or the hot-water-supply/air-cooling operation mode, the oil recovery operation of Modification 2 of the second embodiment can be performed while the first usage-side switching mechanism 64*a* is kept in the usage-side radiating operation state (i.e., is not switched).

(3) Modification 3

A configuration such as that of the heat pump system 300 (see FIG. 13) in Modification 2 is provided with the second usage-side switching mechanism 53*a*, which is capable of switching between an aqueous medium-heating operation state in which the first usage-side heat exchanger 41*a* is made to function as a radiator of the heat-source-side refrigerant introduced from the discharge refrigerant communication tube 12 and an aqueous medium-cooling operation state in which the first usage-side heat exchanger 41*a* is made to function as an evaporator of the heat-source-side refrigerant introduced from the liquid refrigerant communication tube 13. In such a configuration, the heat-source-side refrigerant discharged from the heat-source-side compressor 21 stagnates in the discharge refrigerant communication tube 12 and the flow rate of the heat-source-side refrigerant taken into the heat-source-side compressor 21 is liable to be insufficient (i.e., an insufficient refrigerant-circulation rate) in the case that operation of the first usage unit 4*a* is stopped and the second usage unit 10*a* (air-cooling operation or air-warming operation) is operated (the case in which the discharge refrigerant communication tube 12 is not used).

In view of the above, the heat pump system 300 is provided with a first refrigerant recovery mechanism 57*a* for placing the discharge refrigerant communication tube 12 and the gas refrigerant communication tube 14 in communication when the second usage-side switching mechanism 53*a* is in the aqueous medium-heating operation state or the aqueous medium-cooling operation state, as shown in FIG. 14. Here, the first refrigerant recovery mechanism 57*a* is a refrigerant tube having a capillary tube in which one end is connected to the portion of the first usage-side discharge refrigerant tube 46*a* that connects the first usage-side discharge on-off valve 55*a* and the discharge refrigerant communication tube 12, and the other end is connected to the portion of the first usage-side gas refrigerant tube 54*a* that connects the first usage-side gas on-off valve 56*a* and the gas refrigerant communication tube 14; and the discharge refrigerant communication tube 12 and the gas refrigerant communication tube 14 are in communication regardless of the on-off state of the first usage-side discharge on-off valve 55*a* and/or the first usage-side gas on-off valve 56*a*.

In the heat pump system 300, the heat-source-side refrigerant is thereby made less likely to stagnate in the discharge refrigerant communication tube 12, and it is therefore possible to minimize the occurrence of an insufficient refrigerant-circulation rate in the heat-source-side refrigerant circuit 20.

A configuration such as that of the heat pump system 300 (see FIG. 13) in Modification 2 is provided with the second usage-side switching mechanism 53*a*, which is capable of switching between an aqueous medium-heating operation state in which the first usage-side heat exchanger 41*a* is made to function as a radiator of the heat-source-side refrigerant introduced from the discharge refrigerant communication tube 12 and an aqueous medium-cooling operation state in which the first usage-side heat exchanger 41*a* is made to function as an evaporator of the heat-source-side refrigerant introduced from the liquid refrigerant communication tube 13. In such a configuration, the heat-source-side refrigerant stagnates in the first usage-side heat exchanger 41*a* and the flow rate of the heat-source-side refrigerant taken into the heat-source-side compressor 21 is liable to be insufficient (i.e., an insufficient refrigerant-circulation rate) in the case that operation of the first usage unit 4*a* is stopped and the second usage unit 10*a* (air-cooling operation or air-warming operation) is operated.

In view of the above, in this heat pump system 300, there is provided a second refrigerant recovery mechanism 58*a* for placing the first usage-side heat exchanger 41*a* and the gas refrigerant communication tube 14 in communication when the second usage-side switching mechanism 53*a* is in an aqueous medium-heating operation state or in an aqueous medium-cooling operation state, as shown in FIG. 14. Here, the second refrigerant recovery mechanism 58*a* has a refrigerant tube having a capillary tube in which one end is connected to the portion of the first usage-side gas refrigerant tube 54*a* that connects the gas side of the first usage-side heat exchanger 41*a* and the first usage-side gas on-off valve 56*a*, and the other end is connected to the portion of the first usage-side gas refrigerant tube 54*a* that connects the first usage-side gas on-off valve 56*a* and the gas refrigerant communication tube 14; and the first usage-side gas on-off valve 56*a* is bypassed to place the gas side of the first usage-side heat exchanger 41*a* and the gas refrigerant communication tube 14 in communication even in the case that the operation of the first usage unit 4*a* is stopped.

In this heat pump system 300, the heat-source-side refrigerant is thereby made less likely to stagnate in the first usage-side heat exchanger 41*a*, and it is therefore possible to minimize the occurrence of an insufficient refrigerant-circulation rate in the heat-source-side refrigerant circuit 20.

Furthermore, in the heat pump system 300 (see FIG. 13) in the modifications, the second usage-side switching mechanism 53*a* is composed of the first usage-side discharge on-off valve 55*a* and the first usage-side gas on-off valve 56*a*, and the heat-source-side refrigerant is therefore fed from only the discharge refrigerant communication tube 12 to the first usage unit 4*a* in any operation mode that accompanies a hot-water supply operation.

However, the heat-source-side refrigerant is at the high pressure of the refrigeration cycle not only in the discharge refrigerant communication tube 12, but also in the gas refrigerant communication tube 14 in the hot-water supply operation mode and/or the hot-water supply/air-warming operation mode among the operation modes that accompany hot-water supply operation. Therefore, it is also possible to allow high-pressure, heat-source-side refrigerant to be sent from not only the discharge refrigerant communication tube 12, but also from the gas refrigerant communication tube 14 to the first usage unit 4*a* in the hot-water supply operation mode and/or the hot-water supply/air-warming operation mode.

In view of the above, in this heat pump system 300, a first usage-side gas non-return valve 59*a* and a first usage-side bypass refrigerant tube 60*a* are furthermore provided to the first usage-side gas refrigerant tube 54*a*; and, together with the first usage-side discharge on-off valve 55*a* and the first usage-side gas on-off valve 56*a*, constitute the second usage-side switching mechanism 53*a*, as shown in FIG. 14. Here, the first usage-side gas non-return valve 59*a* is provided to the portion of the first usage-side gas refrigerant tube 54*a* that connects the first usage-side gas on-off valve 56*a* and the gas refrigerant communication tube 14. The first usage-side gas non-return valve 59*a* is a non-return valve that allows the flow of heat-source-side refrigerant from the first usage-side heat exchanger 41*a* toward the gas refrigerant communication tube 14, and prohibits the flow of the heat-source-side refrigerant from the gas refrigerant communication tube 14 toward the first usage-side heat exchanger 41*a*; and the flow of heat-source-side refrigerant from the gas refrigerant communication tube 14 toward the first usage-side heat exchanger 41*a* via the first usage-side gas on-off valve 56*a* is thereby prohibited. The first usage-side bypass refrigerant tube 60*a* is connected to the first usage-side gas refrigerant tube 54*a* so as to bypass the first usage-side gas on-off valve 56*a* and the first usage-side gas non-return valve 59*a*, and constitutes a portion of the first usage-side gas refrigerant tube 54*a*. The first usage-side bypass refrigerant tube 60*a* is provided with a first usage-side bypass non-return valve 61*a* for allowing the flow of heat-source-side refrigerant from the gas refrigerant communication tube 14 to the first usage-side heat exchanger 41*a* and prohibiting the flow of heat-source-side refrigerant from the first usage-side heat exchanger 41*a* to the gas refrigerant communication tube 14, whereby the flow of heat-source-side refrigerant from the gas refrigerant communication tube 14 to the first usage-side heat exchanger 41*a* is allowed via the first usage-side bypass refrigerant tube 60*a*.

In this heat pump system 300, high-pressure, heat-source-side refrigerant can thereby be sent from not only the discharge refrigerant communication tube 12, but also from the gas refrigerant communication tube 14 to the first usage unit 4*a* in the hot-water supply operation mode and the hot-water supply/air-warming operation mode. Therefore, the loss of pressure of the heat-source-side refrigerant fed from the heat source unit 2 to the first usage unit 4*a* is reduced, which can contribute to an improvement in the hot-water supply capacity and/or operation efficiency.

(4) Modification 4

Figure 15:
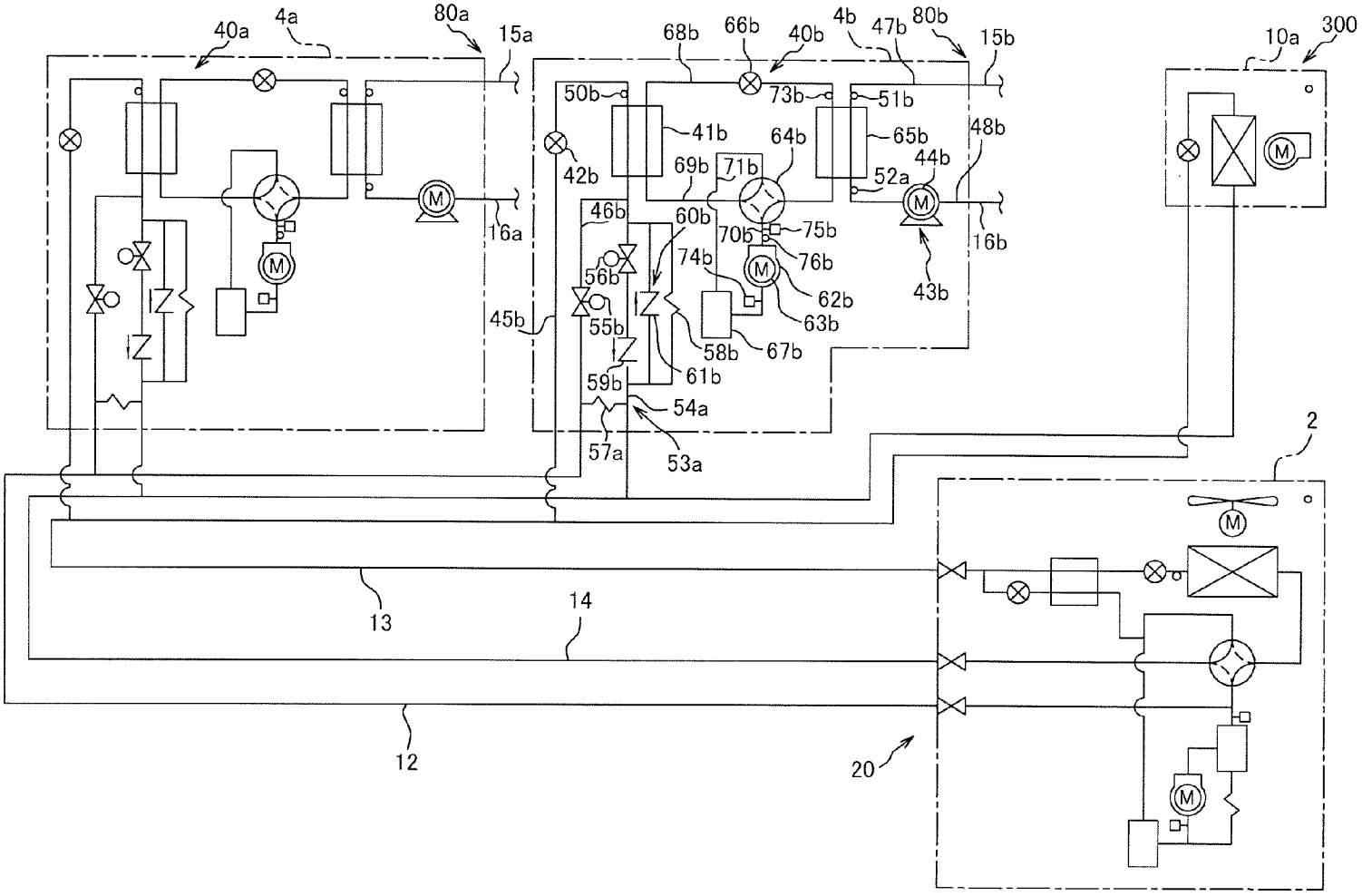
FIG. 15 is a schematic structural diagram of a heat pump system according to Modification 4 of the second embodiment.
Figure 16:
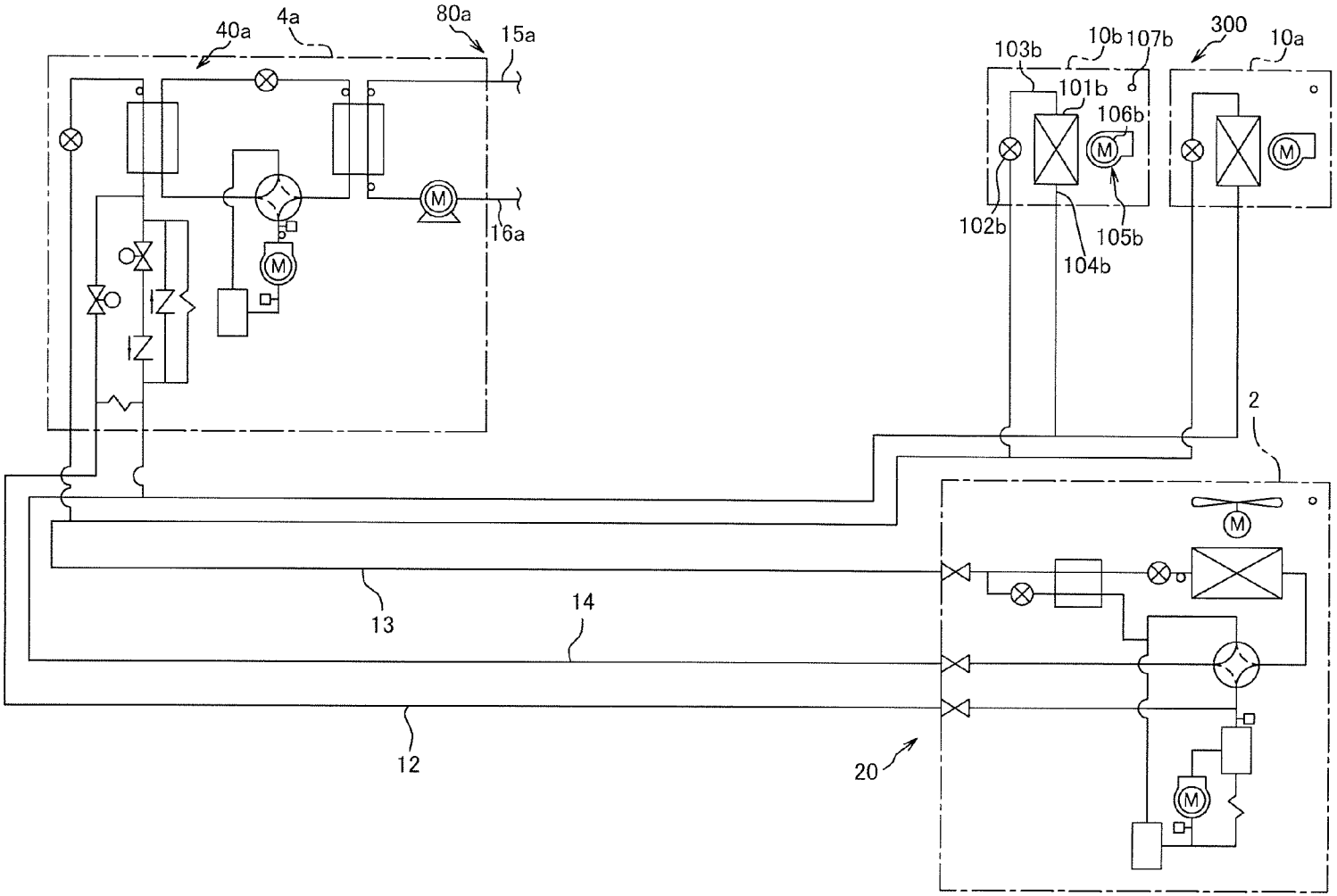
FIG. 16 is a schematic structural diagram of a heat pump system according to Modification 4 of the second embodiment.
Figure 17:
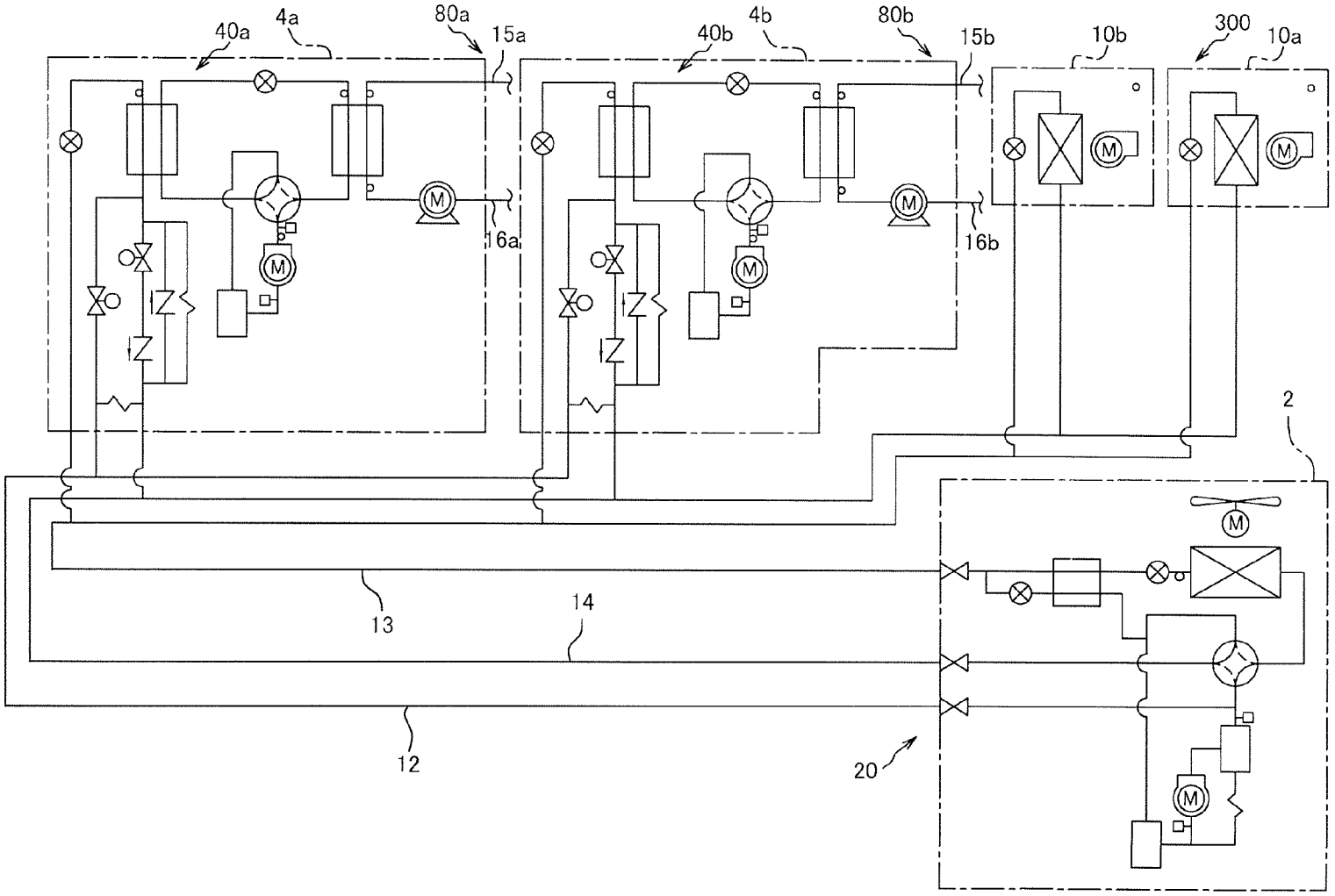
FIG. 17 is a schematic structural diagram of a heat pump system according to Modification 4 of the second embodiment.

In the heat pump systems 300 described above (see FIGS. 12 to 14), a single first usage unit 4*a* and a single second usage unit 10*a* are connected to the heat source unit 2 via the refrigerant communication tubes 12, 13, 14, but a plurality of first usage units 4*a*, 4*b* (two, in this case) may be connected in parallel to each other via the refrigerant communication tubes 13, 14, and/or a plurality of second usage units 10*a*, 10*b* (two, in this case) may be connected in parallel to each other via the refrigerant communication tubes 12, 13, 14, as shown in FIGS. 15 to 17 (in this case, the hot-water/air-warming unit, the hot-water storage unit, the aqueous medium circuits 80*a*, 80*b*, and the like are not shown). The configuration of the first usage unit 4*b* is the same as the configuration of the first usage unit 4*a* with the subscript "b" used in place of the subscript "a" of the reference numerals indicating each part of the first usage unit 4*a*, and a description of each part of the first usage unit 4*b* is therefore omitted. Also, the configuration of the second usage unit 10*b* is the same as the configuration of the second usage unit 10*a* with the subscript "b" used in place of the subscript "a" of the reference numerals indicating each part of the second usage unit 10*b*, and a description of each part is therefore omitted.

In these heat pump systems 300, it is possible to accommodate a plurality of locations and/or applications that require heating of the aqueous medium, and it is possible to accommodate a plurality of locations and/or applications that require cooling of the air medium.

(5) Modification 5

Figure 18:
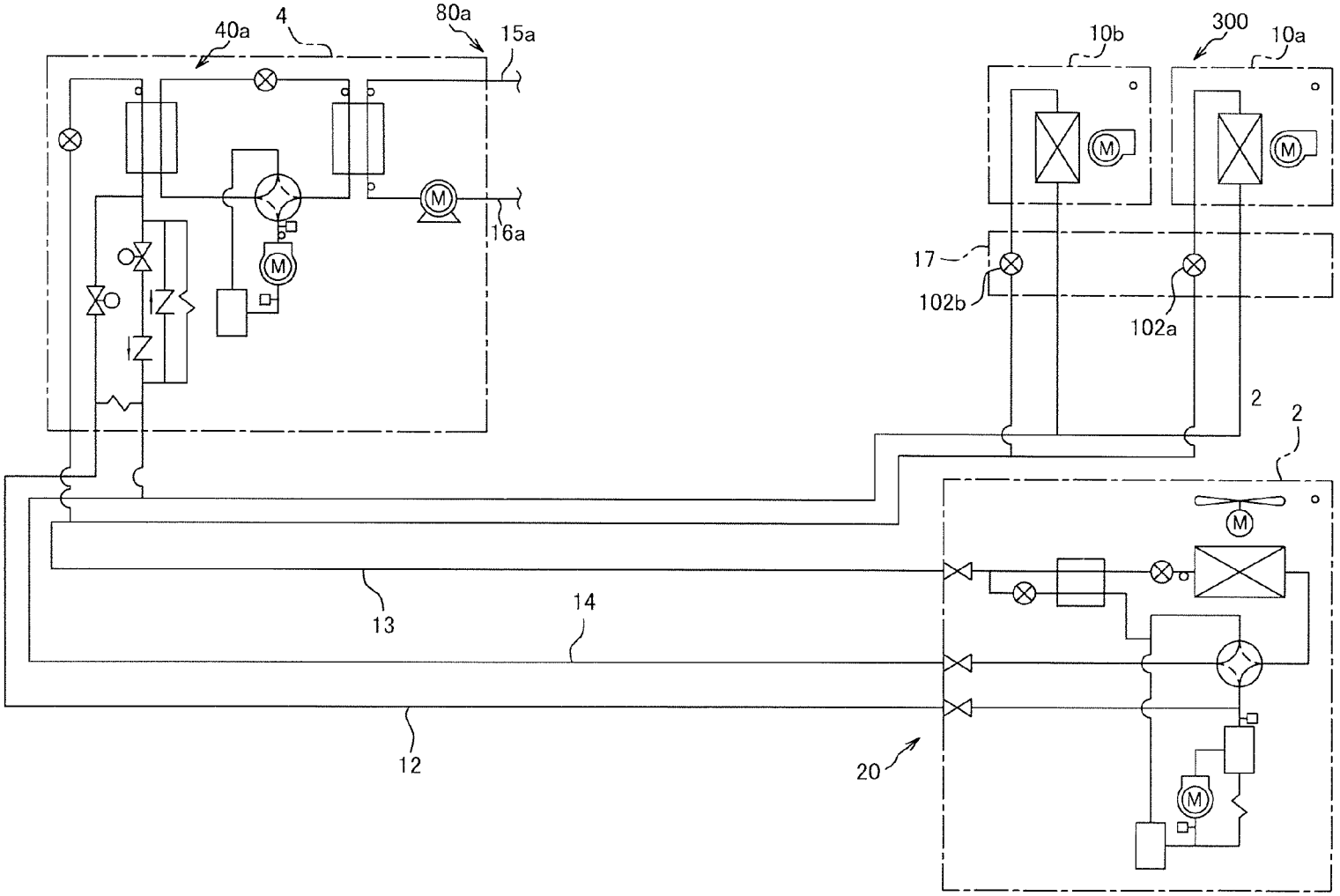
FIG. 18 is a schematic structural diagram of a heat pump system according to Modification 5 of the second embodiment.

In the heat pump systems 300 described above (see FIGS. 12 to 17), the second usage-side flow rate adjustment valves 102*a*, 102*b* are provided inside the second usage units 10*a*, 10*b*, but it is possible to omit the second usage-side flow rate adjustment valves 102*a*, 102*b* from the second usage units 10*a*, 10*b* and to provide an expansion valve unit 17 having the second usage-side flow rate adjustment valves 102*a*, 102*b*, as shown in FIG. 18 (in this case, the hot-water/air-warming unit, the hot-water storage unit, the aqueous medium circuit 80*a*, and the like are not shown).

(Other Embodiments)

Embodiments of the present invention and modifications thereof were described above with reference to the drawings, but specific configurations are not limited to these embodiments and modifications thereof, and it is possible to make modifications within a range that does not depart from the spirit of the invention.

<A>

In the heat pump systems 200, 300 of the second and third embodiments and modifications thereof, the second usage units 10*a*, 10*b* may be used for refrigeration and/or freezing, and purposes other than air cooling and air warming, rather than as usage units used for indoor air cooling and air warming.

<B>

In the heat pump system 300 of the third embodiment and modifications thereof, the gas-refrigerant communication tube 14 may be used as a refrigerant tube in which low-pressure, heat-source-side refrigerant flows in the refrigeration cycle by, e.g., placing the second heat-source-side gas refrigerant tube 23*b* and the heat-source-side intake tube 21*c* in communication, whereby the second usage-side heat exchangers 101*a*, 101*b* are made to function only as evaporators of the heat-source-side refrigerant, and the second usage units 10*a*, 10*b* are used as cooling-dedicated usage units. In this case as well, operation in the hot-water supply/air-cooling operation mode is possible and energy savings can be ensured.

<C>

In the heat pump systems 1, 200, 300 of the first through third embodiments and modifications thereof, HFC-134a is used as the usage-side refrigerant, but no limitation is imposed thereby, and it is also possible to use, e.g., HFO-1234yf (2,3,3,3-tetrafluoro-1-propene) or another refrigerant in which the pressure that corresponds to a saturated gas temperature of 65° C. is a maximum gauge pressure of 2.8 MPa or less, preferably 2.0 MPa or less.

Industrial Applicability

The use of the present invention makes it possible to obtain a high-temperature aqueous medium in a heat pump system that can heat an aqueous medium using a heat pump cycle.

What is claimed is:

1. A heat pump system comprising:

a heat-source-side refrigerant circuit having a heat-source-side compressor arranged to compress a heat-source-side refrigerant, a first usage-side heat exchanger operable as a radiator of the heat-source-side refrigerant, a heat-source-side heat exchanger operable as an evaporator of the heat-source-side refrigerant, and an oil separation mechanism arranged to separate refrigeration machine oil included in the heat-source-side refrigerant that is discharged from the heat-source-side compressor and return the refrigeration machine oil to the heat-source-side compressor;

a usage-side refrigerant circuit having a usage-side compressor arranged to compress a usage-side refrigerant with a pressure of the usage-side refrigerant corresponding to a saturated gas temperature 65° C. being 2.8 MPa or less at gauge pressure, a refrigerant-water heat exchanger operable as a radiator of the usage-side refrigerant to heat an aqueous medium, the first usage-side heat exchanger operable as an evaporator of the usage-side refrigerant by radiation of the heat-source-side refrigerant, a usage-side accumulator configured to temporarily store the usage-side refrigerant in the intake of the usage-side compressor, and a refrigerant-water heat-exchange-side flow rate adjustment valve continued to vary a flow rate of the usage-side refrigerant flowing through the refrigerant-water heat exchanger; and a controller configured to perform an oil recovery operation when the controller has determined that the refrigeration machine oil is insufficient in the usage-side compressor, the usage-side compressor, the first usage-side heat exchanger, and the refrigerant-water heat exchanger forming parts of a first usage unit, a length of a refrigerant tube from the first usage-side heat exchanger functioning as an evaporator of the usage-side refrigerant to the usage-side compressor being 3 m or less, the usage-side refrigerant circuit not being provided with an oil separating mechanism used to separate refrigeration machine oil contained in the usage-side refrigerant discharged from the usage-side compressor and return the oil to an intake of the usage-side compressor, a weight of the usage-side refrigerant enclosed in the usage-side refrigerant circuit being one to three times the weight of a refrigeration machine oil enclosed to lubricate the usage-side compressor, and in the oil recovery operation, the controller returning the usage-side refrigerant containing the refrigeration machine oil in the refrigerant-water heat exchanger to the usage-side accumulator via the refrigerant-water heat-exchange-side flow rate adjustment valve and the first usage-side heat exchanger.

2. The heat pump system according to claim 1, wherein the pressure of the usage-side refrigerant corresponding to a saturated gas temperature of 65° C. is 2.0 MPa or less at gauge pressure.

3. The heat pump system according to claim 1, wherein the controller determines whether or not the refrigeration machine oil is insufficient in the usage-side compressor based on a temperature of the usage-side refrigerant in a discharge of the usage-side compressor or a temperature of the aqueous medium in an outlet of the refrigerant-water heat exchanger.

* * * * *